US006130392A

United States Patent [19]

Blessitt et al.

[11] Patent Number: 6,130,392

[45] Date of Patent: Oct. 10, 2000

[54] STORED ENERGY CIRCUIT BREAKER OPERATOR

[75] Inventors: James H. Blessitt, Peachtree City; Parker A. Bollinger, Jr., Stone Mountain; Milton E. Ramey, Fayetteville; Paul D. Reagan, Grayson; W. Dale Robbins, Lithonia; Jill Stegall, Atlanta, all of Ga.

[73] Assignee: Siemens Energy & Automation, Inc., Alpharetta, Ga.

[21] Appl. No.: 09/277,932

[22] Filed: Mar. 29, 1999

[51] Int. Cl.[7] ..... H01H 5/00

[52] U.S. Cl. ..... 200/400

[58] Field of Search ..... 200/318–327, 200/400, 401

[56] References Cited

U.S. PATENT DOCUMENTS 4,885,444 12/1989 Lazar et al. ..... 200/400 X

*Primary Examiner*—J. R. Scott

[57] ABSTRACT

A stored energy apparatus for association with an operating handle of a circuit breaker contains springs that store energy when charged and that release energy when discharged. Energy is stored when a movement translation assembly is moved in a charging direction by an operator gear, and stored energy is released when a release apparatus releases the operator gear, causing the movement translation assembly to move in a discharging direction. The circuit breaker operating handle is moved to ON position by the charging movement of the movement translation assembly, and as stored energy is released, the discharging movement of the movement translation assembly moves the operating handle to OFF position. The operator gear is operated via an operator handle, operator shaft, and pinion gear assembly. The pinion gear assembly has a carrier pivotally associated with the operator shaft and a pinion gear that rotates the operator gear. The operator gear may also be turned by an electric motor and series of gears to accomplish electric operation of the circuit breaker.

20 Claims, 45 Drawing Sheets

INDICATION
ON/DISCHARGED
WHITE
BLACK
534a
OFF/CHARGED
WHITE
BLACK
534b
MANUAL OFF/ CHARGE HANDLE
537
LOCKING HASP
53B
AUTO/ MANUAL
550c
ON/L
54B
OFF/O
609
S2
MOLDED ENCLOSURE
200
L1
1000
L2
S2B (MANUAL POS. SHOWN)
535b
ORANGE
RED
BRN
MOTOR
521
1200
WHITE
BLACK
LOCAL OFF
609
541
4
S4
CB CLOSED
1234
1235
CB OPEN
531a
1
FUSE
609r
OFF
ON
548r
3
2
535a
S2A
(630A ONLY) HINGED OPEN SWITCH
SOLENOID
532

630
518a
513a
568
518s
509
536
569
592
603
531a
531
567
600
572
542
515
515t
515a
513
513b
574
520a
557a
514
544
549
591
510
553e
553c
553
553b
553a
553d
580
580a
580b
580c
580e
510bb
556
576
545
502
560
561
617
554
558
596
614
614a
603
692
512
512cc
510g
535
557
581
563a
550
550s
563b
520b
564
548a
548b
610
548
566
565b
565a
565
534e
590a
534f
590b
537
537o
537p
534c
534d
534a
534b 547
551c
551b
551a
551

551
547a
551a
547

501
586
501p
605
547
551
560
584

501m
501p
605f
501v
501n
605a
501l
501k
584
501t
547
501j
551a
501n
501g
584

STORED ENERGY CIRCUIT BREAKER OPERATOR

BACKGROUND OF THE INVENTION

1. Field of the Invention

This invention relates to an apparatus, means, system and method for closing a circuit breaker assembly in a time period of on the order of about fifty (50) to one hundred (100) milliseconds either through manual operation or electrical motor operation, and further relates to a control module for such a motor driven circuit breaker operator.

This invention is believed to provide a relatively elegant, cost effective and reliable apparatus, system and method for engaging a charging device to charge or store energy in a stored energy operating mechanism for a circuit breaker system that does not interfere with manual operation of the charging device if electric control power is lost, and for engaging an electrical charging device that does not interfere with manual operations of the electrical charging device. The charging device may be engaged only if the stored energy operating mechanism is not fully charged. Further, if the charging device is manually operated, it can be interrupted or overrun when the electrical charging device is engaged during manual operation of the manual charging device. The charging device automatically disengages when the stored energy operating mechanism is fully charged. It is also believed that this system may provide a useful control module for such a motor driven circuit breaker operator.

2. Description of the Art

In certain circuit breaker applications, it may be necessary to close a circuit breaker relatively quickly, such as on the order of about fifty (50) to one hundred (100) milliseconds. For example, when industrial backup AC generators are parallel switched, the associated circuit breakers may require that the circuit breaker assemblies switch to their closed or ON positions relatively rapidly so as to actuate the circuit breaker to its ON position in a relatively short time. While there are certain circuit breaker stored energy operator accessories that may provide this feature, it is believed that they may be more complicated, may also be more expensive and may not have the features discussed herein.

SUMMARY OF THE INVENTION

It is an object of the present inventions to overcome any deficiencies, limitations or problems of the existing art.

It is another object of the present invention to provide an electrical control module for use with a stored energy circuit breaker assembly having a motor for use with a circuit breaker assembly, the circuit breaker assembly providing an electrical signal through electrical contacts for actuating the circuit breaker assembly, the electrical control module comprising: a rectifying circuit, which receives and rectifies said electrical signal so as to provide a rectified electrical signal; a motor switch circuit connected to the motor; and an electrical signal flow maintenance circuit, which is operatively connected to said rectifying circuit, said motor switch circuit and the motor, wherein said electrical signal flow circuit maintenance maintains at least a threshold rectified electrical when the electrical contacts are closed so that said motor switch circuit is on and the motor operates.

It is yet another object of the present invention to provide the electrical control module of above, wherein said electrical signal is an AC electrical signal.

It is still another object of the present invention to provide the electrical control module of above, wherein said electrical signal is a DC electrical signal.

It is yet another object of the present invention to provide the electrical control module of above, wherein said rectified electrical signal is a full wave rectified DC electrical signal.

It is still another object of the present invention to provide the electrical control module of above, wherein said rectifying circuit comprises a bridge circuit.

It is yet another object of the present invention to provide the electrical control module of above, wherein said bridge circuit comprises diodes.

It is still another object of the present invention to provide the electrical control module of above, wherein said motor switch circuit comprises a thyristor.

It is yet another object of the present invention to provide the electrical control module of above, wherein said thyristor is a silicon-controlled rectifier.

It is still another object of the present invention to provide the electrical control module of above, wherein said electrical signal maintenance circuit comprises a voltage storage element connected across said bridge circuit so as to maintain the on state of the silicon-controlled rectifier.

It is yet another object of the present invention to provide the electrical control module of above, wherein the voltage storage element comprises a capacitor.

It is still another object of the present invention to provide the electrical control module of above, wherein said motor switch circuit comprises a rectified electrical signal filter in parallel with a zener diode, which is used to control a gate of said silicon-controlled rectifier.

It is yet another object of the present invention to provide the electrical control module of above, wherein said signal filter comprises a resistive element in series with at least one other voltage storage structure.

It is still another object of the present invention to provide the electrical control module of above, wherein said silicon-controlled rectifier is connected to an electrical protective element.

It is yet another object of the present invention to provide the electrical control module of above, wherein said electrical protective element comprises a voltage storage element.

It is still another object of the present invention to provide the electrical control module of above, wherein said voltage storage element is a capacitor connected in parallel with respect to said silicon-controlled rectifier.

It is another object of the present invention to provide a stored energy circuit breaker operator assembly for use with a circuit breaker assembly having a light pipe indicator assembly for indicating a status of the stored energy assembly, stored energy assembly comprising: a housing assembly; a movable element having at least two positions so that each of said positions corresponds to a state of the motor operated stored energy assembly, wherein each of said positions has a corresponding shading indicator; at least one light pipe mounted with respect to said housing assembly so that a first end of the light pipe faces said shading indicator and a second end opposite to said first end faces outwardly with respect to said housing assembly so that the light pipe ai indicates the shading indicator corresponding to a position of said movable element.

It is yet another object of the present invention to provide the stored energy assembly of above, wherein said shading indicator comprises a light background for one position of said movable element and a darker background for another position of said movable element.

It is still another object of the present invention to provide the stored energy assembly of above, wherein said light pipe is generally cylinder shaped.

It is yet another object of the present invention to provide the stored energy assembly of above, wherein said light pipe is generally rectangular shaped.

It is still another object of the present invention to provide the stored energy assembly of above, wherein said light pipe comprises acrylic plastic.

It is yet another object of the present invention to provide the stored energy assembly of above, wherein said light pipe is optically clear so that the shading indicator is indicated at said second opposite end of said light pipe.

It is still another object of the present invention to provide the stored energy assembly of above, wherein said movable element is an operator gear.

It is yet another object of the present invention to provide the stored energy assembly of above, wherein said corresponding shading indicator has a lighter portion and a darker portion, said lighter portion facing said one end of said light pipe when said operator gear is in one position and said darker portion facing said one end of said light pipe when said operator gear is in another position.

It is still another object of the present invention to provide the stored energy assembly of above, wherein said lighter portion is essentially white and said darker portion is essentially black.

It is yet another object of the present invention to provide the motor operated stored energy assembly of above, wherein said shading indicator is mounted on said operator gear.

It is still another object of the present invention to provide the stored energy assembly of above, wherein said shading indicator is a circle shaped indicator having said lighter portion associated with one area of said operator gear and said darker portion associated with another area of said operator gear.

It is yet another object of the present invention to provide the stored energy assembly of above, wherein said first position corresponds to a charged energy state of said stored energy assembly and said second position corresponds to a discharged energy state of said stored energy assembly.

It is another object of the present invention to provide a stored energy assembly for use with a circuit breaker assembly having a light pipe indicator assembly for indicating a status of the stored energy assembly, the stored energy assembly comprising: a housing assembly; a movable element having at least two positions so that each of said positions corresponds to a state of the stored energy assembly, wherein each of said positions has a corresponding shading indicator; a first light pipe mounted with respect to said housing assembly so that a first end of said first light pipe faces said shading indicator and a second end opposite to said first end faces outwardly with respect to said housing assembly so that said first light pipe indicates the shading indicator corresponding to a first position of said movable element; and a second light pipe mounted with respect to said housing assembly so that a first end of said second light pipe faces said shading indicator and a second end opposite to said first end faces outwardly with respect to said housing assembly so that said second light pipe indicates a shading indicator corresponding to a second position of said movable element.

It is yet another object of the present invention to provide the stored energy assembly of above, wherein said shading indicator comprises a light background for one position of said movable element and a darker background for another position of said movable element.

It is still another object of the present invention to provide the stored energy assembly of above, wherein said light pipe is generally cylinder shaped.

It is yet another object of the present invention to provide the stored energy assembly of above, wherein said light pipe is generally rectangular shaped.

It is still another object of the present invention to provide the motor operated stored energy assembly of above, wherein said light pipe comprises acrylic plastic.

It is yet another object of the present invention to provide the motor operated stored energy assembly of above, wherein said light pipe is optically clear so that the corresponding shading indicator is indicated at said second opposite end of each of said light pipe.

It is still another object of the present invention to provide the stored energy assembly of above, wherein said movable element is an operator gear.

It is yet another object of the present invention to provide the stored energy assembly of above, wherein said corresponding shading indicator has a lighter portion and a darker portion, said lighter portion facing said one end of said first light pipe when said operator gear is in one position and said darker portion facing said one end of said second light pipe when said operator gear is in another position.

It is still another object of the present invention to provide the stored energy assembly of above, wherein said lighter portion is essentially white and said darker portion is essentially black.

It is yet another object of the present invention to provide the motor operated stored energy assembly of above, wherein said shading indicator is mounted on said operator gear.

It is still another object of the present invention to provide the motor operated stored energy assembly of above, wherein said shading indicator is a circle shaped indicator having said lighter portion associated with one area of said operator gear and said darker portion associated with another area of said operator gear.

It is yet another object of the present invention to provide the stored energy assembly of above, wherein said first position corresponds to a charged energy state of said stored energy assembly and said second position corresponds to a discharged energy state of said stored energy assembly.

It is another object of the present invention to provide a unidirectional clutch assembly for use with a stored energy circuit breaker operator assembly having an operator handle, pinion shaft assembly, a worm gear assembly and a pinion gear assembly, for use with a circuit breaker assembly, the operator handle and pinion shaft assembly including an operator handle having an outer handle hub having a first recess for receiving a first end of the pinion shaft assembly, the worm gear assembly fitting over the pinion shaft assembly and the pinion shaft assembly having a second end for receiving a pinion gear assembly, the unidirectional clutch assembly comprising: a first unidirectional clutch structure, wherein the first unidirectional clutch structure fits over the first end of the pinion shaft and the unidirectional clutch structure is fitted into the first recess of the outer handle hub; and a second unidirectional clutch structure, wherein the second unidirectional clutch structure fits within the worm gear assembly and over the pinion shaft assembly between the first and second ends of the pinion shaft assembly, wherein said first unidirectional clutch structure and said second unidirectional clutch structure are oriented in the same direction so that they slip unidirectionally in the same direction.

It is still another object of the present invention to provide the unidirectional clutch assembly of above, wherein if said first unidirectional clutch structure rotates with the pinion shaft assembly and the operator handle, said second unidirectional clutch structure slips in one direction and the pinion gear assembly does not rotate with the pinion shaft assembly.

It is yet another object of the present invention to provide the unidirectional clutch assembly of above, wherein if said worm gear assembly rotates, said first unidirectional clutch structure slips in one direction so that the operator handle does not move and the worm gear assembly rotates so as to rotate the pinion gear assembly.

It is still another object of the present invention to provide the unidirectional clutch assembly of above, wherein if said first unidirectional clutch structure rotates with the pinion shaft assembly and the operator handle, said second unidirectional clutch structure slips in one direction and the pinion gear assembly does not rotate with the pinion shaft assembly, and further wherein if said worm gear assembly rotates, said first unidirectional clutch structure slips in one direction so that the operator handle does not move and the worm gear assembly rotates so as to rotate the pinion gear assembly.

It is yet another object of the present invention to provide a unidirectional clutch assembly means for use with an operator handle, pinion shaft assembly, a worm gear assembly and a pinion gear assembly of a stored energy assembly for use with a circuit breaker assembly, the operator handle and pinion shaft assembly including an operator handle having an outer handle hub having a first recess for receiving a first end of the pinion shaft assembly, the worm gear assembly fitting over the pinion shaft assembly and the pinion shaft assembly having a second end for receiving a pinion gear assembly, the unidirectional clutch assembly comprising: a first unidirectional clutch means for fitting over the first end of the pinion shaft and for fitting into the first recess of the outer handle hub; and a second unidirectional clutch means for fitting within the worm gear assembly and over the pinion shaft assembly between the first and second ends of the pinion shaft assembly, wherein said first unidirectional clutch means and said second unidirectional clutch means are oriented in the same direction so that they slip unidirectionally in the same direction.

It is still another object of the present invention to provide the unidirectional clutch assembly means of above, wherein if said first unidirectional clutch means rotates with the pinion shaft assembly and the operator handle, said second unidirectional clutch means slips in one direction and the pinion gear assembly does not rotate with the pinion shaft assembly.

It is yet another object of the present invention to provide the unidirectional clutch assembly means of above, wherein if said worm gear assembly rotates, said first unidirectional clutch means slips in one direction so that the operator handle does not move and the worm gear assembly rotates so as to rotate the pinion gear assembly.

It is still another object of the present invention to provide the unidirectional clutch assembly means of above, wherein if said first unidirectional clutch means rotates with the pinion shaft assembly and the operator handle, said second unidirectional clutch means slips in one direction and the pinion gear assembly does not rotate with the pinion shaft assembly, and further wherein if said worm gear assembly rotates, said first unidirectional clutch means slips in one direction so that the operator handle does not move and the worm gear assembly rotates so as to rotate the pinion gear assembly.

It is another object of the present invention to provide an adapter plate assembly for mounting a stored energy circuit breaker operator assembly to a circuit breaker assembly, the adapter plate assembly comprising: a mounting plate, said mounting plate comprising a circuit breaker toggle aperture that receives a circuit breaker toggle, at least one mounting aperture for mounting said adapter plate assembly to the circuit breaker assembly, wherein said mounting plate has at least one hinge connector that hingedly connects the stored energy assembly to said mounting plate, wherein said mounting plate further comprises: a circuit breaker trip aperture; a trip arm mounting aperture; a trip arm comprising a trip flange at one end for being contacted by a tripping member of the stored energy assembly, a mounting member for rotateably mounting said trip arm to said mounting plate, and a trip extension member, located between said trip flange and said mounting member, that is used to actuate the tripping of the circuit breaker assembly.

It is yet another object of the present invention to provide the adapter plate assembly of above, wherein said mounting plate has a terminal bus assembly comprising at least one terminal threaded insert that receives at least one terminal screw, the at least one terminal screw being used to connect wires for operably connecting the stored energy assembly and the circuit breaker assembly.

It is still another object of the present invention to provide the adapter plate assembly of above, wherein said at least one hinge connector comprises at least two hinge flange apertures connected to the lower left and right sides of said mounting plate, each of said at least two hinge flange apertures being used to receive hinge flanges connected to the stored energy assembly, wherein the hinge flanges are rotateably connected to said hinge flange apertures using securing pins.

It is yet another object of the present invention to provide the adapter plate assembly of above, wherein said a mounting plate has a wire aperture that is used to receive wires for operably connecting the stored energy assembly and the circuit breaker assembly.

It is still another object of the present invention to provide the adapter plate assembly of above, wherein said trip arm is rotateably mounted to said mounting member using a return spring, a pin, and a pivot bushing.

It is another object of the present invention to provide a cylinder key lock and locking hasp assembly for use with a stored energy circuit breaker operator assembly, having a housing and an operator mechanism that may be manually actuated, for use with a circuit breaker assembly, the cylinder lock and locking hasp assembly comprising: a cylinder key lock mounted in the stored energy assembly housing, wherein said cylinder key lock extends into the stored energy assembly housing and wherein at least a portion of said cylinder key lock may be moved when actuated, and further wherein said at least a portion of cylinder key lock may be moved to at least one unlocked position or to at least one locked position; a cylinder lock arm, wherein said cylinder lock arm is used to secure one end of said cylinder key lock in the stored energy assembly housing and wherein key actuated movement of said cylinder lock also causes said cylinder lock arm to move to at least one corresponding unsecuring position or to at least one securing position; a lifting member comprising a mounting member and a securing lifting member, wherein movement of said cylinder lock arm causes movement of said lifting member to at least one corresponding unsecured position or to at least one secured position; a locking hasp assembly, mounted in the stored energy assembly housing, comprising a locking hasp receiving member and a locking hasp securing member having an aperture for receiving said lifting member, wherein movement of said lifting member to said at least one corresponding unsecured position allows movement of said locking hasp assembly and further wherein movement of said lifting member to said at least one corresponding secured position prevents movement of said locking hasp assembly.

It is still another object of the present invention to provide the cylinder key lock and locking hasp assembly of above, wherein said cylinder key lock further comprising a cylinder lock base which sits on an external face of the stored energy housing assembly, a key receiving cylinder lock member and a rear cylinder lock member and further wherein said cylinder lock arm is mounted on said rear cylinder lock member.

It is yet another object of the present invention to provide the cylinder key lock and locking hasp assembly of above, wherein said cylinder lock arm has a tapered end and is threadedly mounted on said rear cylinder lock member.

It is still another object of the present invention to provide the cylinder key lock and locking hasp assembly of above, wherein key actuation of said cylinder key lock may cause said cylinder lock arm to rotate.

It is still another object of the present invention to provide the cylinder key lock and locking hasp assembly of above, wherein said lifter mounting member is pivotally mounted on said cylinder lock arm and further wherein said lifter mounting member is rigidly associated with said lifter securing member.

It is yet another object of the present invention to provide the cylinder key lock and locking hasp assembly of above, wherein said lifter mounting member is oriented in a different plane than said lifter securing member.

It is yet another object of the present invention to provide the cylinder key lock and locking hasp assembly of above, wherein said lifter mounting member is perpendicularly oriented with respect to said lifter securing member.

It is still another object of the present invention to provide the cylinder key lock and locking hasp assembly of above, wherein said lifter mounting member lies in a vertical plane and said lifter securing member lies in a horizontal plane.

It is yet another object of the present invention to provide the cylinder key lock and locking hasp assembly of above, wherein said lifter securing member has a first wider end and a second narrower end.

It is still another object of the present invention to provide the cylinder key lock and locking hasp assembly of above, wherein said narrower second end is nearer said lifter mounting member than is said wider first end, wherein when said cylinder lock arm is moved from its said unsecuring position to its said securing position, said cylinder lock arm moves said lifting member upwardly and transversely thereby lifting locking hasp assembly to its securing position so as to prevent manual operation of the operator mechanism of the stored energy assembly.

It is yet another object of the present invention to provide the cylinder key lock and locking hasp assembly of above, wherein when said cylinder lock arm is in its said unsecuring position, said first wider end is farther from said cylinder key lock, and when said cylinder lock arm is in its said securing position, said first wider end is closer to said cylinder key lock.

It is still another object of the present invention to provide the cylinder key lock and locking hasp assembly of above, wherein said lifting member comprises said lifter mounting member integrally associated with said lifter securing member.

It is yet another object of the present invention to provide the cylinder key lock and locking hasp assembly of above further comprising at least one locking hasp return spring, wherein a first end of said at least one locking hasp return spring is attached to said locking hasp assembly and a second end of said at least one locking hasp return spring is attached within the housing of the stored energy assembly, wherein when said locking hasp assembly is moved outwardly from an initial position within the stored energy assembly housing, said at least one locking hasp return spring tends to force said locking hasp assembly to return to said initial position.

It is another object of the present invention to provide a stored energy circuit breaker operator assembly for use with a circuit breaker assembly, having an actuation handle for actuating the circuit breaker assembly to at least one operating state, comprising: a housing; an operator handle assembly comprising an operator handle and operator handle shaft; an operator gear assembly comprising an operator gear and a movement following member; a pinion gear assembly comprising a pinion gear carrier and at least one pinion gear, wherein said pinion gear carrier is pivotally associated with said operator handle shaft and said at least one pinion gear is pivotally associated with said pinion gear carrier, and wherein said pinion gear carrier is movable so that said at least one pinion gear may contact and rotate said operator gear; a stored energy charging and discharging assembly comprising a movement translation apparatus assembly, having at least one charging state movement direction and at least one discharge state movement direction, which is operatively associated said operator gear movement following member and with the actuation handle of the circuit breaker assembly, wherein said movement translation apparatus assembly translates rotational movement of said operator gear into linear movement of said movement translation apparatus assembly thereby moving the actuation handle of the circuit breaker assembly so as to actuate the circuit breaker assembly to at least one of its operating states; an energy storage assembly comprising a structure that stores energy when charged and releases energy when discharged, wherein said stored energy charging and discharging assembly is operatively associated with said stored energy charging and discharging assembly so as to store energy when said movement translation apparatus assembly moves in said at least one charging state movement direction and to discharge energy when said movement translation apparatus moves in said at least discharging state movement direction; a release apparatus operatively associated with said operator gear assembly so as to release said operator gear assembly and allow it to rotate, thereby allowing said movement translation apparatus to move in said at least one discharge movement direction; and a circuit breaker actuation apparatus operatively associated with said movement translation assembly so as to move in the same direction as said movement translation assembly, wherein said operator handle and said pinion gear assembly are operatively connected by said operator handle shaft so that moving said operator handle and correspondingly said operator handle shaft in at least one direction also rotates said at least one pinion gear, thereby rotating said operator gear assembly so as to cause said movement translation apparatus assembly to move in said at least one charging state movement direction so as to charge said energy storage assembly by storing energy therein.

It is yet another object of the present invention to provide the stored energy circuit breaker operator assembly of above further comprising: an electric motor assembly; a reset translation assembly operatively associated with said electric motor assembly and with said operator handle shaft and said pinion gear assembly; an actuating assembly operatively associated with said electric motor assembly, which when actuated causes said electric motor assembly to operate so as to operate said reset translation assembly and thereby rotate said operator handle shaft in at least one direction and also rotate said at least one pinion gear, thereby rotating said operator gear assembly so as to cause said movement translation apparatus assembly to move in said at least one charging state movement direction so as to charge said energy storage assembly by storing energy therein.

It is still another object of the present invention to provide the stored energy circuit breaker operator assembly of above, wherein said reset translation assembly comprises a worm driven by said electric motor assembly, where said worm further drives a worm gear mounted on said operator handle shaft so as to rotate said operator handle shaft.

It is yet another object of the present invention to provide the stored energy circuit breaker operator assembly of above, wherein said actuating assembly comprises an electric switch for actuating said electric motor assembly.

It is still another object of the present invention to provide the stored energy circuit breaker operator assembly of above, wherein said electric motor assembly comprises: an electric motor; at least one drive shaft; and a reduction gear assembly, wherein said electric motor drives said at least one drive shaft which drives said reduction gear assembly and said reset translation assembly.

It is yet another object of the present invention to provide the stored energy circuit breaker operator assembly of above, wherein said apparatus further comprises an electronic control module for controlling operation of the electric motor.

It is still another object of the present invention to provide the stored energy circuit breaker operator assembly of above, wherein said electronic control module comprises a silicon-controlled rectifier.

It is yet another object of the present invention to provide the stored energy circuit breaker operator assembly of above, wherein said movement following member comprises a cam following pin member.

It is still another object of the present invention to provide the stored energy circuit breaker operator assembly of above, wherein said at least one pinion gear comprises an idler pinion gear operatively associated with a driver pinion gear, which drives said operator gear.

It is yet another object of the present invention to provide the stored energy circuit breaker operator assembly of above, wherein said movement translation apparatus comprises: a drive plate, wherein said drive plate has a movement following member aperture for receiving said movement following member; at least one guide shaft, wherein said drive plate is movably mounted on said at least one guide shaft.

It is still another object of the present invention to provide the stored energy circuit breaker operator assembly of above, wherein said circuit breaker actuation apparatus comprises a circuit breaker actuator plate operatively associated with said drive plate so as to move with said drive plate, thereby actuating the circuit breaker assembly to at least one operating state.

It is yet another object of the present invention to provide the stored energy circuit breaker operator assembly of above, wherein said circuit breaker actuator plate is slideably mounted on said at least one guide shaft and is operatively mounted with respect to said drive plate so as to move with said drive plate.

It is still another object of the present invention to provide the stored energy circuit breaker operator assembly of above, wherein said circuit breaker actuation plate is a circuit breaker toggle plate having a toggle handle aperture for receiving a circuit breaker toggle handle.

It is yet another object of the present invention to provide the stored energy circuit breaker operator assembly of above, wherein said energy storage assembly comprises at least one spring operatively associated with said movement translation apparatus so that said at least one spring is charged when said movement translation assembly moves in said at least one movement charging direction.

It is still another object of the present invention to provide the stored energy circuit breaker operator assembly of above, wherein said at least one spring comprises two springs.

It is yet another object of the present invention to provide the stored energy circuit breaker operator assembly of above, wherein each of said springs has a first hook end for mounting with respect to said housing and a second hook end for mounting with respect to said movement translation apparatus.

It is still another object of the present invention to provide the stored energy circuit breaker operator assembly of above, wherein said housing comprises an external housing, a lower gear housing, an upper gear housing and a main internal housing, wherein said external housing houses said lower and upper gear housings and said main internal housing, and further wherein said lower gear housing houses at least said reset translation assembly, and further wherein said electric motor is mounted on said upper gear housing and further wherein said main internal housing houses said stored energy charging and discharging assembly, including said movement translation assembly, and further houses said energy storage assembly.

It is yet another object of the present invention to provide the stored energy circuit breaker operator assembly of above, wherein said operator gear has a release cam and further wherein said release apparatus comprises: a release switch; a release structure operatively associated with said release switch and with said release cam of said operator gear so that said release structure interferes with rotational movement of said release cam and said operator gear when said stored energy circuit breaker actuation apparatus has been charged and does not interfere with rotational movement of said release cam when said release switch is actuated so as to cause said release structure to release said release cam.

It is still another object of the present invention to provide the stored energy circuit breaker operator assembly of above, wherein said release switch is a mechanical ON switch.

It is yet another object of the present invention to provide the stored energy circuit breaker operator assembly of above, wherein said release structure comprises a latch further comprising a semi-cylindrical member, which rotates when said release switch is actuated so that it does not interfere movement of said release cam and of said operator gear, thereby allowing the stored energy assembly to discharge so as to cause said movement translation assembly to move in said at least one discharging state movement direction.

It is another object of the present invention to provide a method for operating a stored energy circuit breaker actuation apparatus, which is used with a circuit breaker assembly, comprising the steps of: selecting from among manual unlocked, manual locked or automatic operation of the stored energy circuit breaker actuation apparatus; if manual unlocked operation is selected, then the method comprises the further steps of: selecting local or remote operation; if local operation is selected, then stored energy circuit breaker actuation apparatus may be used to turn on a circuit breaker assembly by depressing a local ON switch on the stored energy assembly and to turn off the circuit breaker assembly by depressing a local OFF switch on the stored energy assembly and to turn off the circuit breaker assembly by operating an operator handle on the stored energy assembly; if remote operation is selected, then the circuit breaker assembly may not be turned on or off; if manual locked operation is selected, then the method comprises the further steps of: selecting local or remote operation, in which case the stored energy assembly may not be used to turn the circuit breaker assembly on or off either remotely or locally; and if automatic operation is selected, then the method comprises the further steps of: selecting local or remote operation; if local operation is selected, then the stored energy assembly may not be used to turn on the circuit breaker assembly and the stored energy assembly may be used to turn off a circuit breaker assembly by operating an operator handle on the stored energy assembly; if remote operation is selected, then a remote ON button may be used to cause the stored energy assembly to turn on the circuit breaker assembly and a remote OFF button may be used to cause the stored energy assembly to turn off the circuit breaker assembly.

It is yet another object of the present invention to provide the method of above, wherein the step of operating the operator handle of the stored energy assembly comprises the further step of at least partially rotating the operator handle at least one time.

It is still another object of the present invention to provide the method of above, wherein the further step of at least partially rotating the operator handle at least one time comprises the further steps of: rotating the operator handle from an initial position to an end position and returning the operator handle to its initial position until the stored energy assembly is charged.

It is yet another object of the present invention to provide the method of above, wherein the initial position and the end position differ on the order of about ninety degrees.

It is still another object of the present invention to provide the method of above, wherein the rotation from the initial position to the end position is clockwise rotation.

It is yet another object of the present invention to provide the method of above, wherein the rotation from the initial position to the end position is counter-clockwise rotation.

It is another object of the present invention to provide a pinion gear carrier assembly for use with a stored energy circuit breaker operator assembly having an operator handle, operator handle shaft assembly and main operator gear that is used to drive a movement translation assembly so as to charge an energy storage assembly of the stored energy assembly, the pinion gear carrier assembly comprising: a pinion gear carrier having an operator handle shaft aperture and an idler pinion gear mounting member, wherein said pinion gear carrier is mounted on the operator handle shaft using the operator handle shaft aperture; a driver pinion gear mounted on the operator handle shaft; an idler pinion gear mounted on said idler pinion gear mounting member; wherein said driver pinion gear and said idler pinion gear contact one another so that said idler pinion gear rotates when said driver pinion gear is rotated by the operator handle and operator handle shaft.

It is still another object of the present invention to provide the pinion gear carrier assembly of above, wherein said pinion gear carrier is triangularly shaped.

It is yet another object of the present invention to provide the pinion gear carrier assembly of above, wherein said triangularly shaped pinion gear carrier comprises the operator handle shaft aperture at one tapered end and the idler pinion gear mounting member at a second tapered end so that a third tapered end may be used to interfere with a pinion gear carrier stop in the stored energy assembly.

It is still another object of the present invention to provide the pinion gear carrier assembly of above, wherein said idler pinion gear mounting member is a cylinder shaped mounting member.

It is yet another object of the present invention to provide the pinion gear carrier assembly of above, wherein said cylinder shaped mounting member is a pin.

It is still another object of the present invention to provide the pinion gear carrier assembly of above, wherein rotation of the operator handle drives the operator handle shaft so as to rotate pinion gear carrier clockwise about said operator handle shaft aperture so that said idler pinion gear drives the main operator gear so as to cause the movement translation assembly to charge the energy storage assembly, and further wherein said operator handle shaft rotation rotates said pinion gear carrier until said third tapered end meets and is stopped by the pinion gear carrier stop at which time said idler pinion gear no longer contacts the main operator gear.

It is yet another object of the present invention to provide a main operator gear for use with a pinion gear carrier assembly, having a driver pinion gear and an idler pinion gear, and a movement translation assembly for charging an energy storage assembly of a stored energy circuit breaker actuation assembly, the main operator gear comprising: operator gear teeth, wherein said operator gear teeth cover less than the full circumference of said main operator gear, and further wherein the pinion gear carrier may be rotated so as to bring the idler pinion gear into contact with said main operator gear; and a movement following member located on said main operator gear.

It is still another object of the present invention to provide the main operator gear of above, wherein said operator gear teeth cover on the order of about one-half the circumference of said main operator gear.

It is yet another object of the present invention to provide the main operator gear of above, wherein said operator gear teeth cover more than fifty percent and less than seventy percent of the circumference of said main operator gear.

It is still another object of the present invention to provide the main operator gear of above, wherein said operator gear teeth cover sixty-two and one-half percent of the circumference of said main operator gear.

It is yet another object of the present invention to provide the main operator gear of above, wherein said operator gear teeth are adjacent one another with a substantial gap between a first operator gear tooth and an end operator gear tooth.

It is still another object of the present invention to provide the main operator gear of above, wherein said main operator gear is configured for thirty-two operator gear teeth and comprises an operator gear teeth segment of twenty operator gear teeth representing on the order of about 20/32 of the circumference of said main operator gear and a toothless segment representing on the order of about 12/32 of the circumference of said main operator gear, wherein the driver pinion gear drives the idler pinion gear, which contacts and drives said main operator gear so that said movement following member is moved on the order of about a few degrees past a position representing top dead center of said main operator gear.

These and other objects, advantages and features of the present invention will be readily understood and appreciated with reference to the detailed description of preferred embodiments discussed below together with the accompanying drawings.

DETAILED DESCRIPTION OF THE PREFERRED EMBODIMENTS

Figure 1:
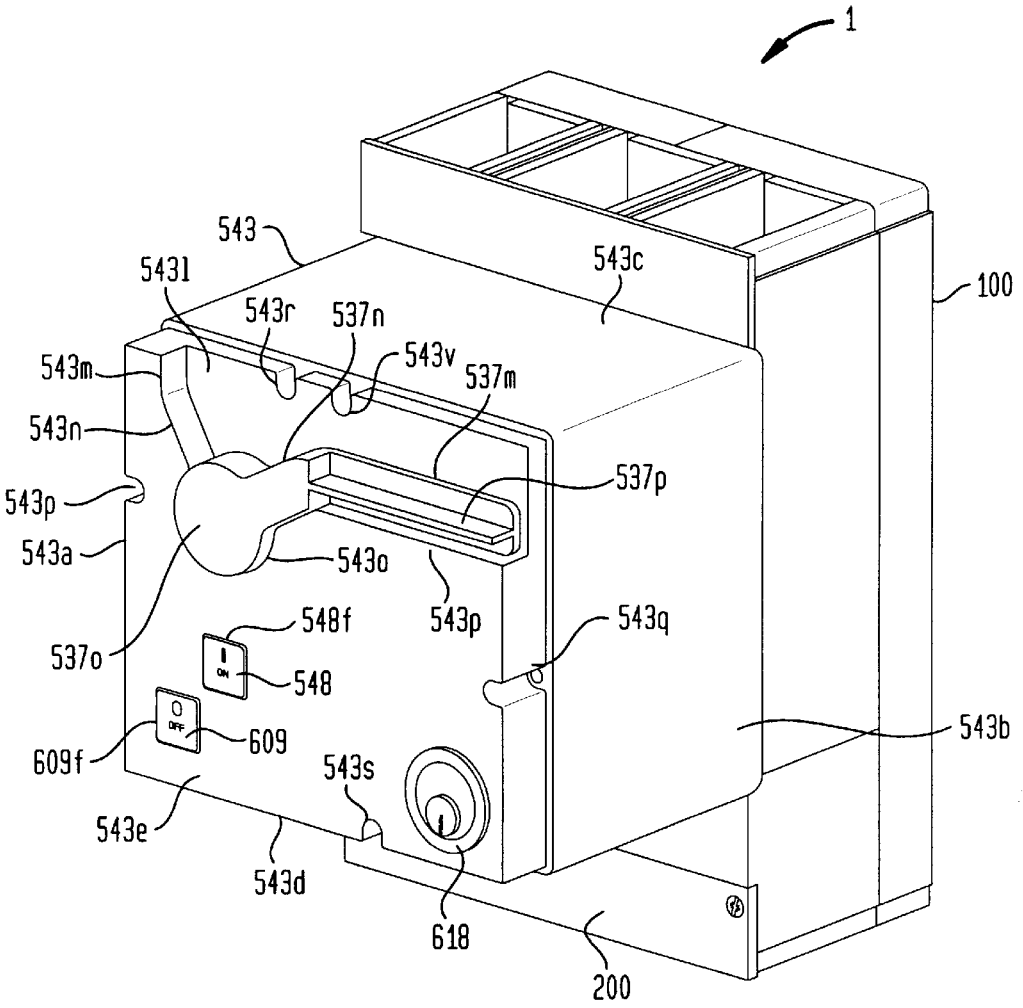
FIG. 1 is a drawing of one embodiment of the apparatus and system of the present invention showing the motor operated stored energy circuit breaker system.
Figure 2:
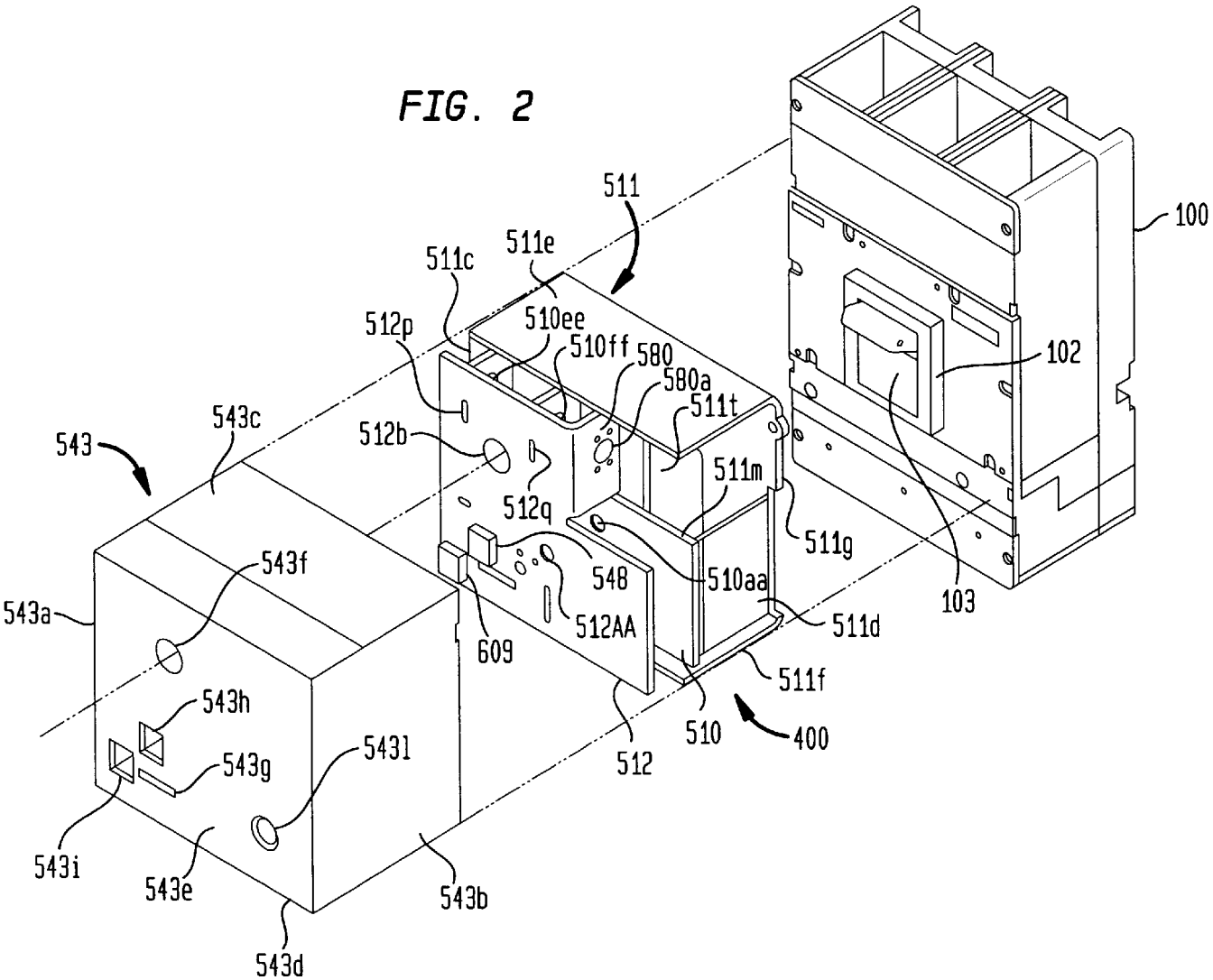
FIG. 2 is an exploded view of some assemblies of the motor operated stored energy assembly and circuit breaker assembly.
Figure 3:
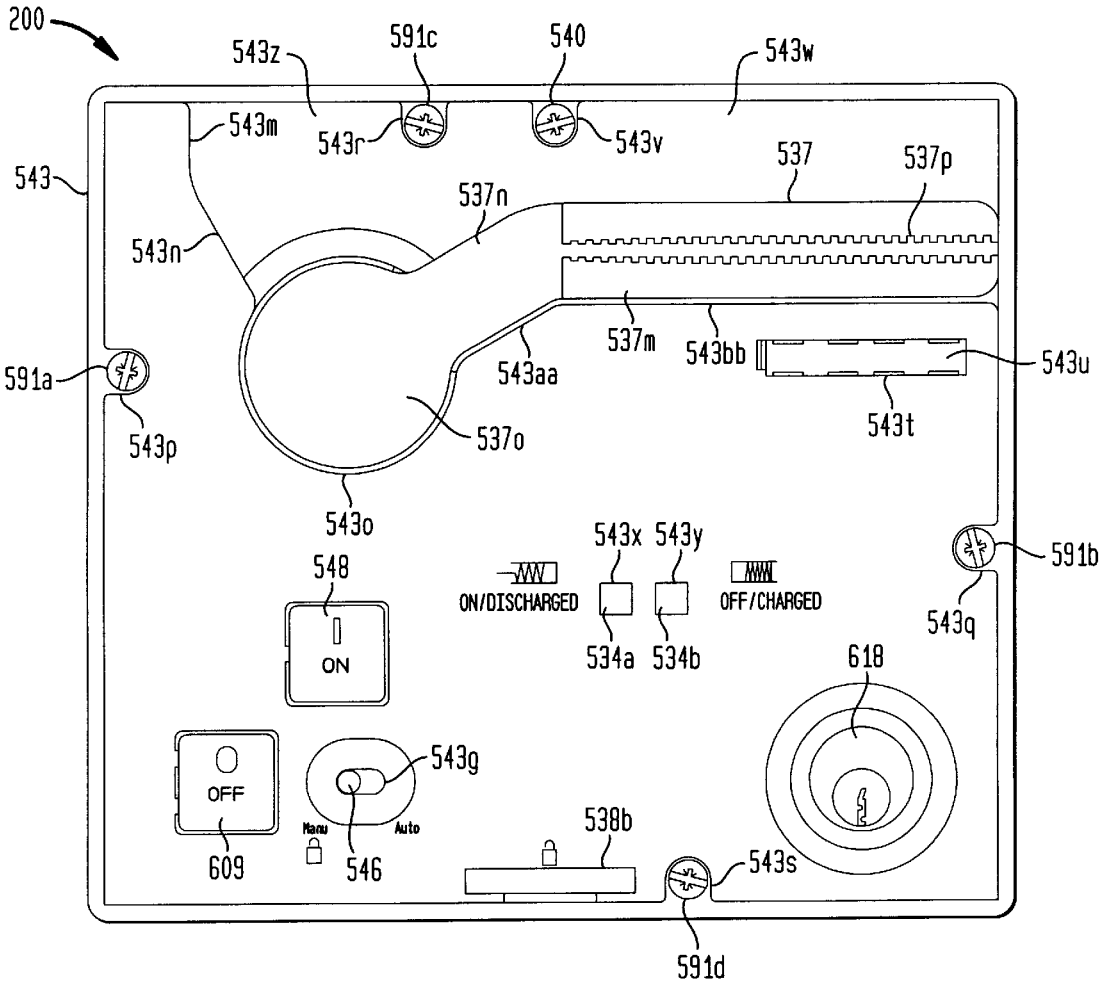
FIG. 3 is an embodiment of the front panel of the motor operated stored energy assembly for a 630 Ampere rated circuit breaker assembly.
Figure 4:
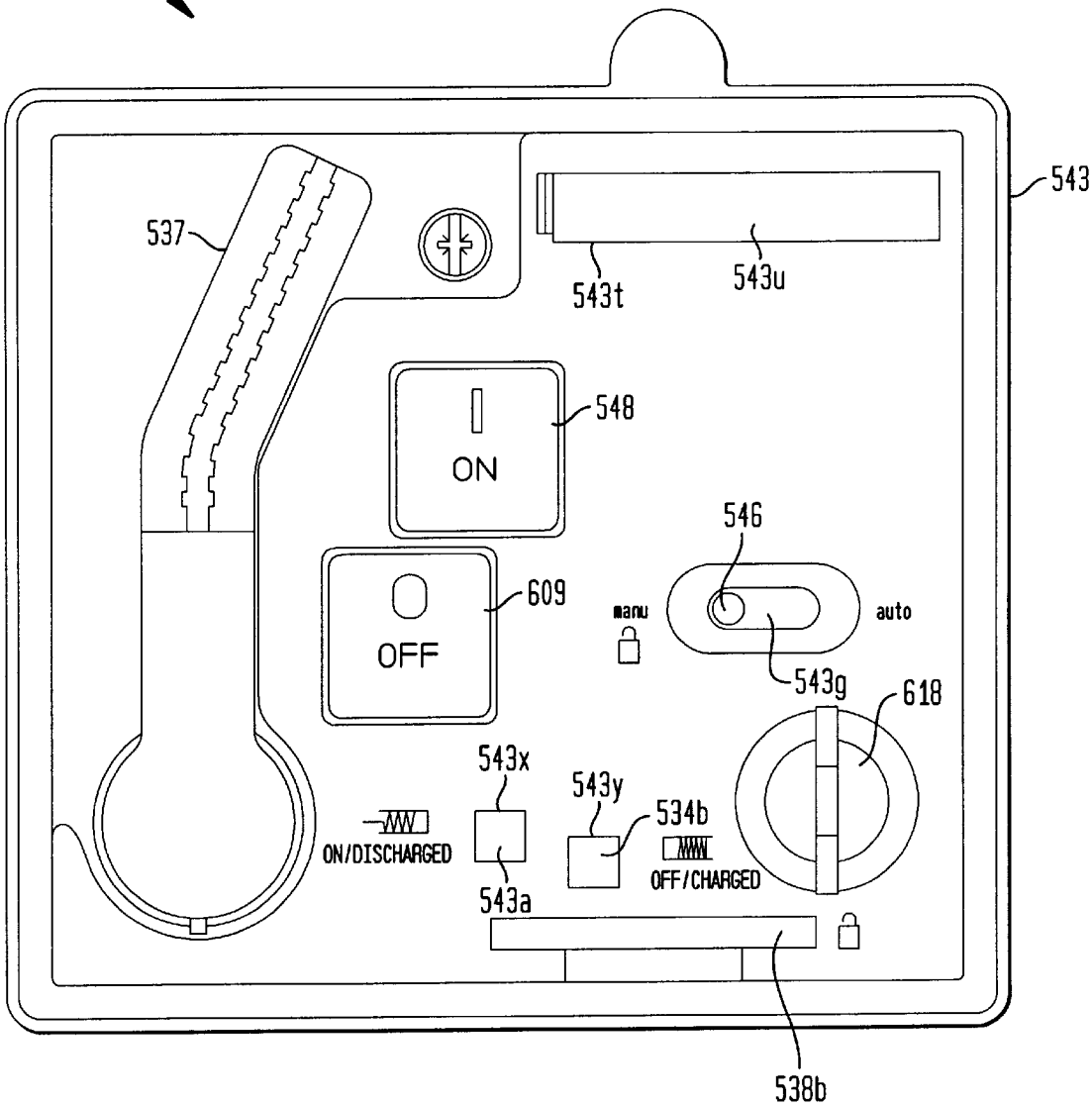
FIG. 4 is an embodiment of the front panel of the motor operated stored energy assembly for a 125 or 250 Ampere rated circuit breaker assembly.

Referring to FIGS. 1, 2 and 3, the motor operated stored energy circuit breaker system 1 comprises a circuit breaker assembly 100, which may for example be rated for 630 Amperes as shown, and a motor operated stored energy circuit breaker assembly 200. Of course, the circuit breaker assembly 100 may also be rated for 125 Amperes or 250 Amperes, as shown in FIG. 4, or any other suitably appropriate current rating. The motor operated stored energy circuit breaker assembly 200 has a molded thermoplastic external housing 543, although any other suitably appropriate material may be used.

Figure 8A:
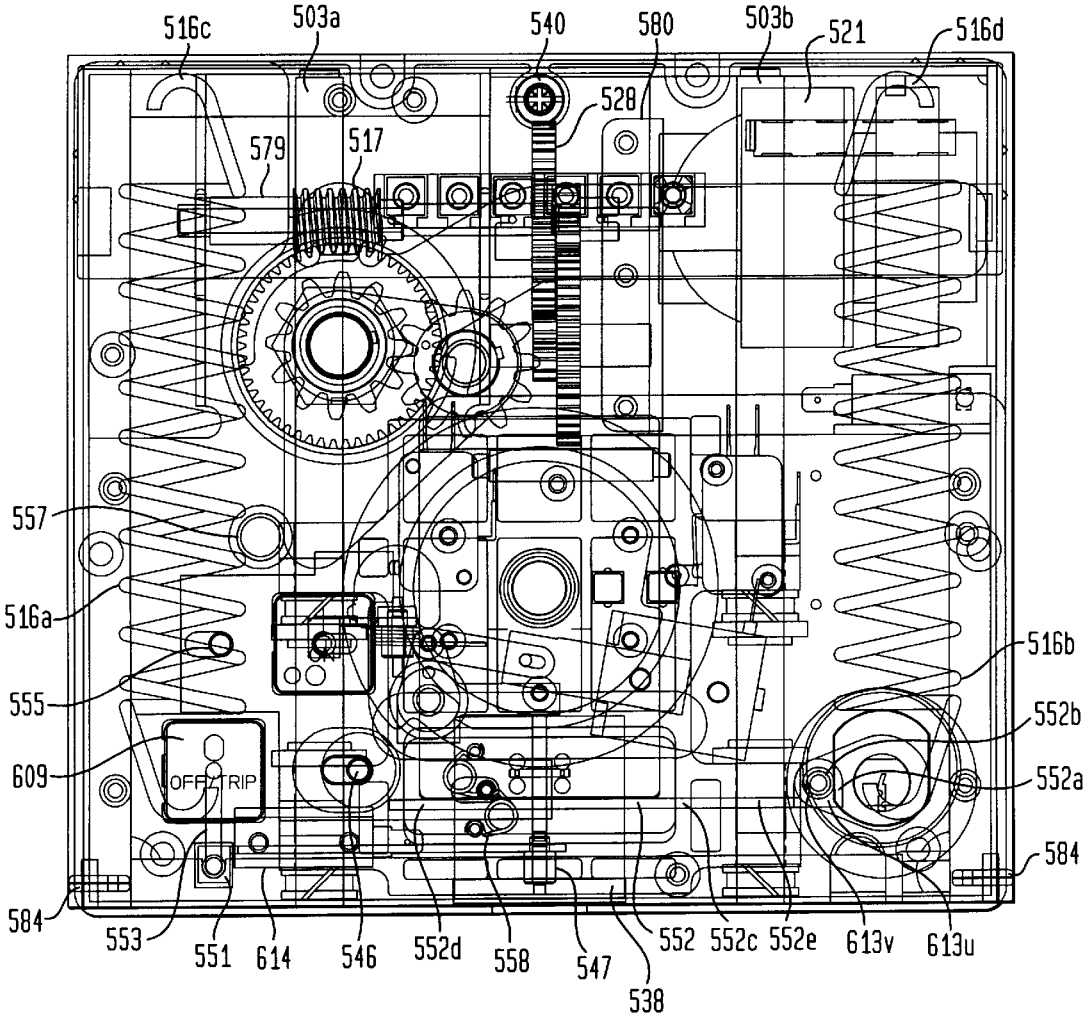
FIG. 8A is a full component front view of the apparatus showing the charging springs in a charged position.
Figure 8B:
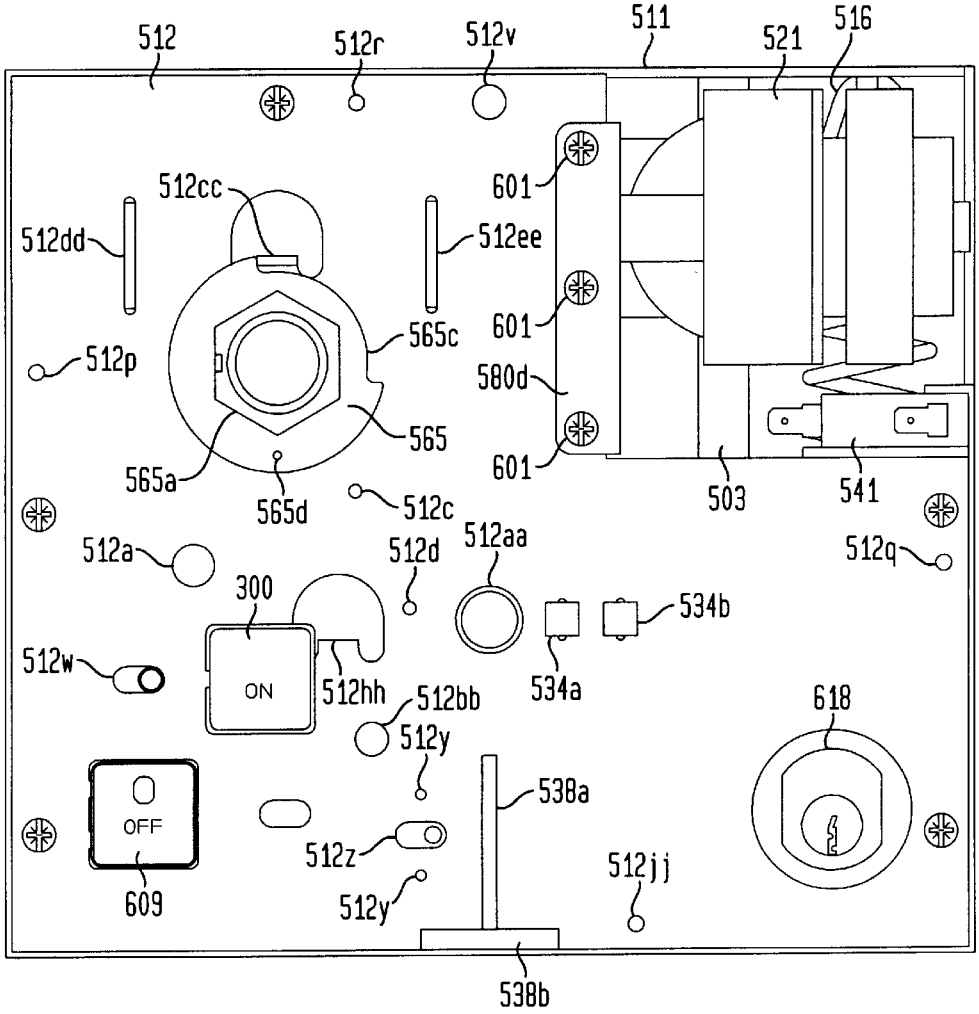
FIG. 8B is a partial component front view of the apparatus showing the charging springs in a charged position.
Figure 9A:
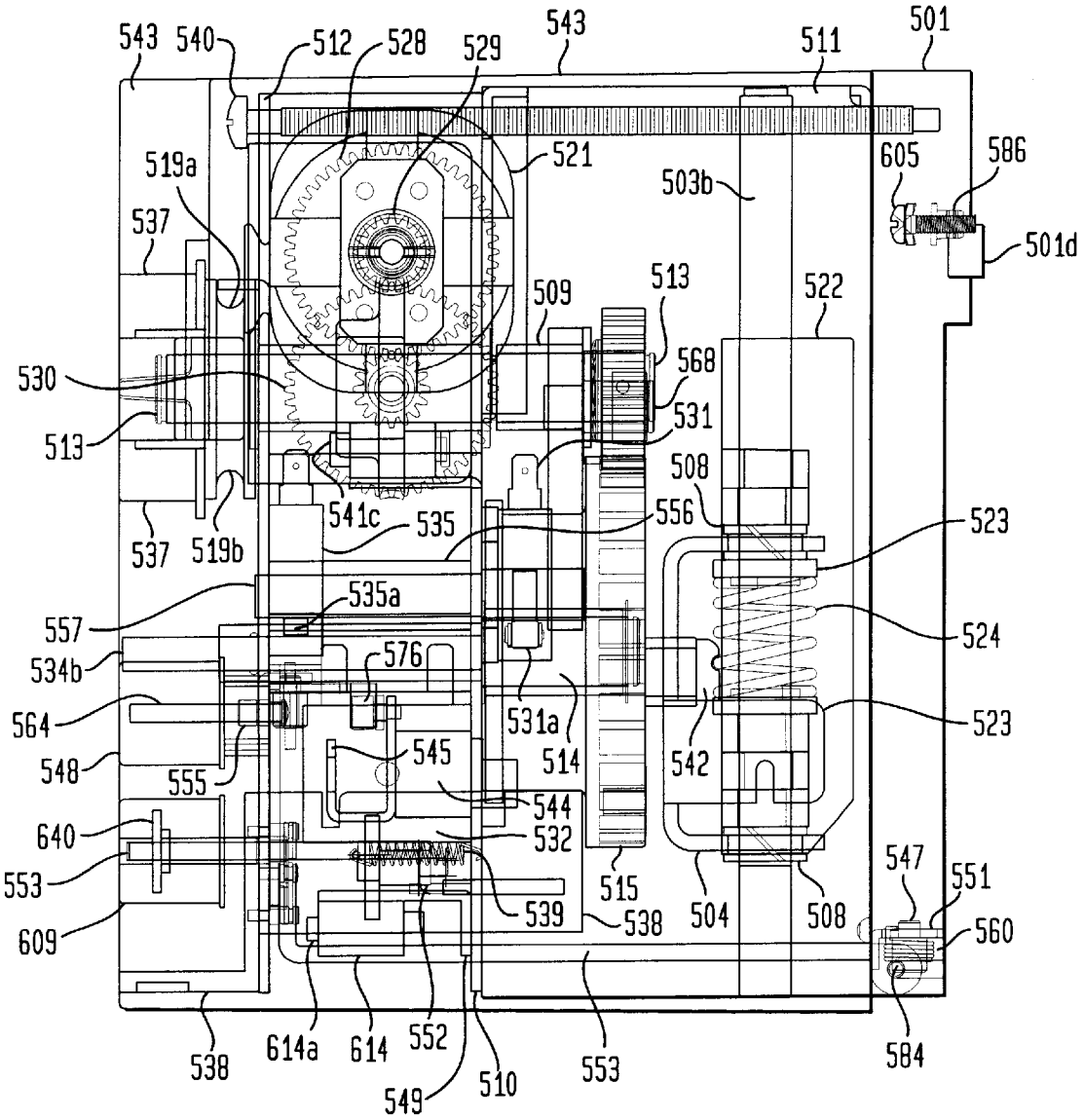
FIG. 9A is a partial component side through view of the apparatus.
Figure 9B:
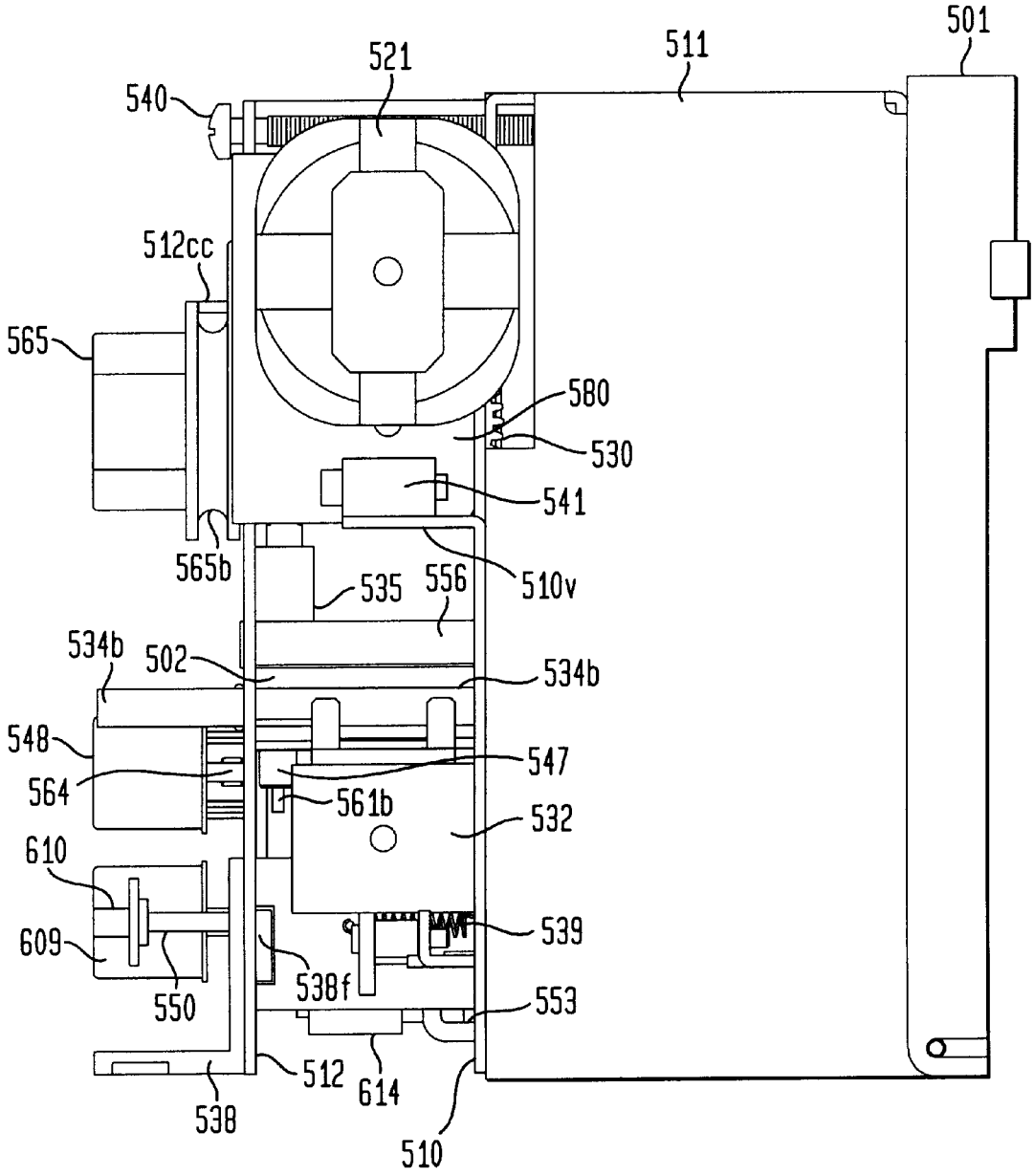
FIG. 9B is a partial component side view of the apparatus.
Figure 14:
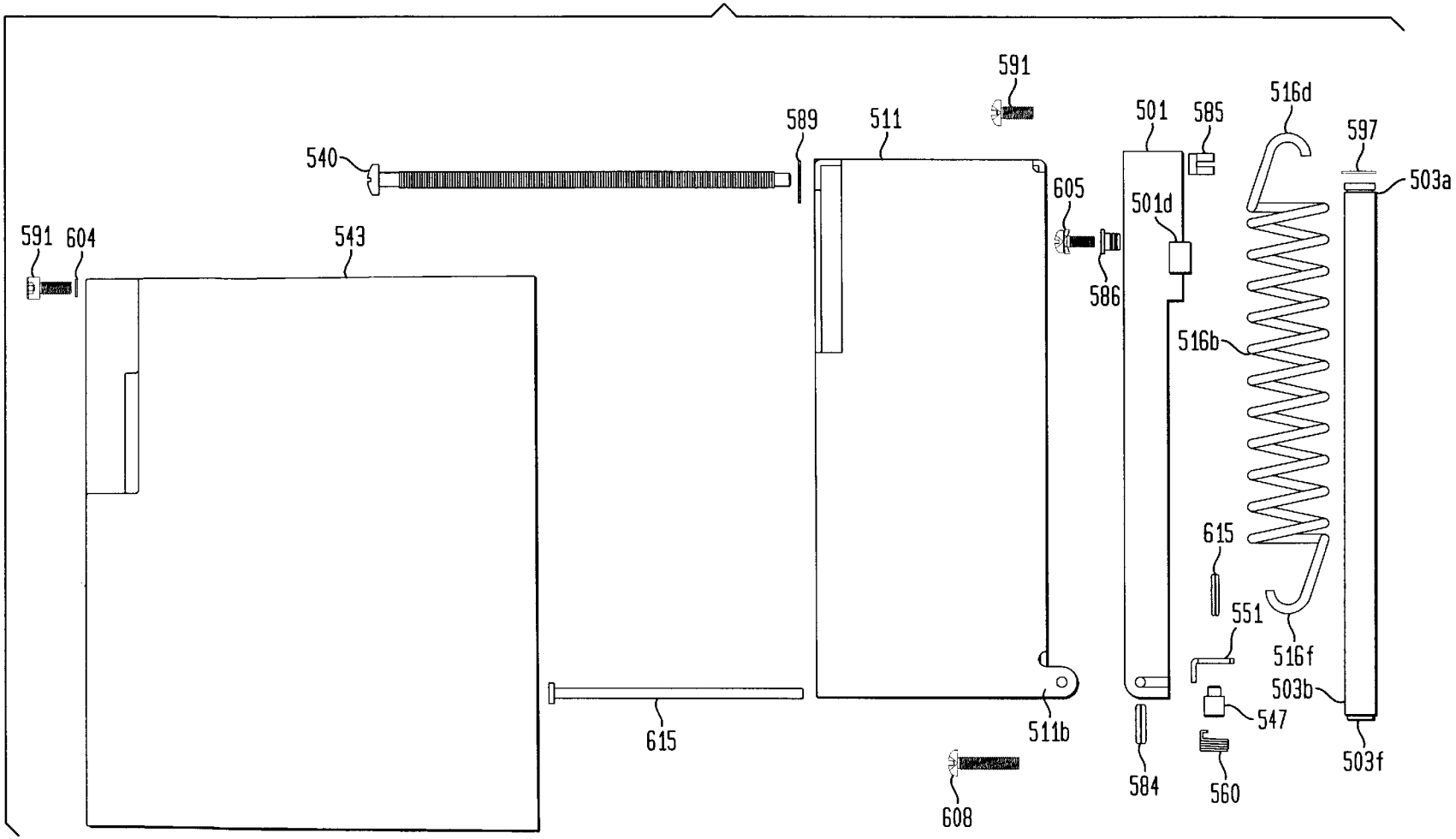
FIG. 14 is another side view of the external housing, the main internal housing and adapter base, as well as the main charging springs of the motor operated stored energy assembly, including the operator gearing and the operator handle.

As will be discussed in further detail later, the assembly operates as follows: as shown in FIGS. 8 and 14, for example, a manual reset/charging operator handle 537 is used to reset and charge charging springs 516*a* and 516*b* of the motor operated stored energy circuit breaker assembly 200. Using the manual reset/charging operator handle 537 to reset the motor operated stored energy circuit breaker assembly 200 causes the circuit breaker assembly 100 to go to its OFF position and the charging springs 516 are charged. When the manual reset/charging operator handle 537 is repeatedly and ratchetedly rotated or turned about ninety (90) degrees counter-clockwise and then back to its initial starting position, it causes a one-way or uni-directional clutch 519 to slip so that a worm gear 507 (see FIG. 16) does not rotate or otherwise move. Also, the described initial counter-clockwise movement of operator handle 537 causes handle clutch 519*b* to slip so that operator handle shaft 513 does not move, while the return clockwise movement of operator handle 537 grabs or locks operator handle shaft 513 and causes pinion gear clutch 519*a* (see FIG. 16) to slip with respect to the operator handle shaft 513 so that the worm 517 and worm gear 507 do not move. A manual/automatic lockout slide handle 546 allows local control of the motor operated stored energy circuit breaker assembly 200 when its manual/automatic lockout slide 550 is in the unlocked manual position and also allows some local control when the manual/automatic switch 550 is in the automatic position. In particular, an operator can actuate the ON and OFF buttons 548 and 609, respectively. The ON switch 548 is used to release the charged springs 516*a* and 516*b* so as to force a toggle handle 103 of the circuit breaker assembly 100 to its ON position. In particular, the ON switch 548 causes actuation of a latch bell crank 561 so as to rotate D-shaft latch 544, which releases main operator gear 515 allowing it to rotate so as to cause the circuit breaker toggle handle 103 to move to its ON position.

The circuit breaker assembly 100 may comprise a circuit breaker subassembly and a circuit breaker plug-in unit (not shown). The circuit breaker subassembly comprises a toggle handle 103, circuit breaker lug openings or apertures and circuit breaker mounting openings or apertures. Although not shown, threaded copper studs may be passed through circuit breaker mounting openings or apertures and are received by tulip contacts in the plug-in unit so as to connect or mount the circuit breaker unit to the circuit breaker plug-in unit. In this way, a current path may be provided through the plug-in unit to the circuit breaker assembly. Further, and although not shown, the circuit breaker subassembly may further include a push-to-trip button, a trip current rating adjustment or setting (Ir) and a magnetic current adjustment or setting (Im) for a mag-latch in the circuit breaker subassembly.

Figure 5:
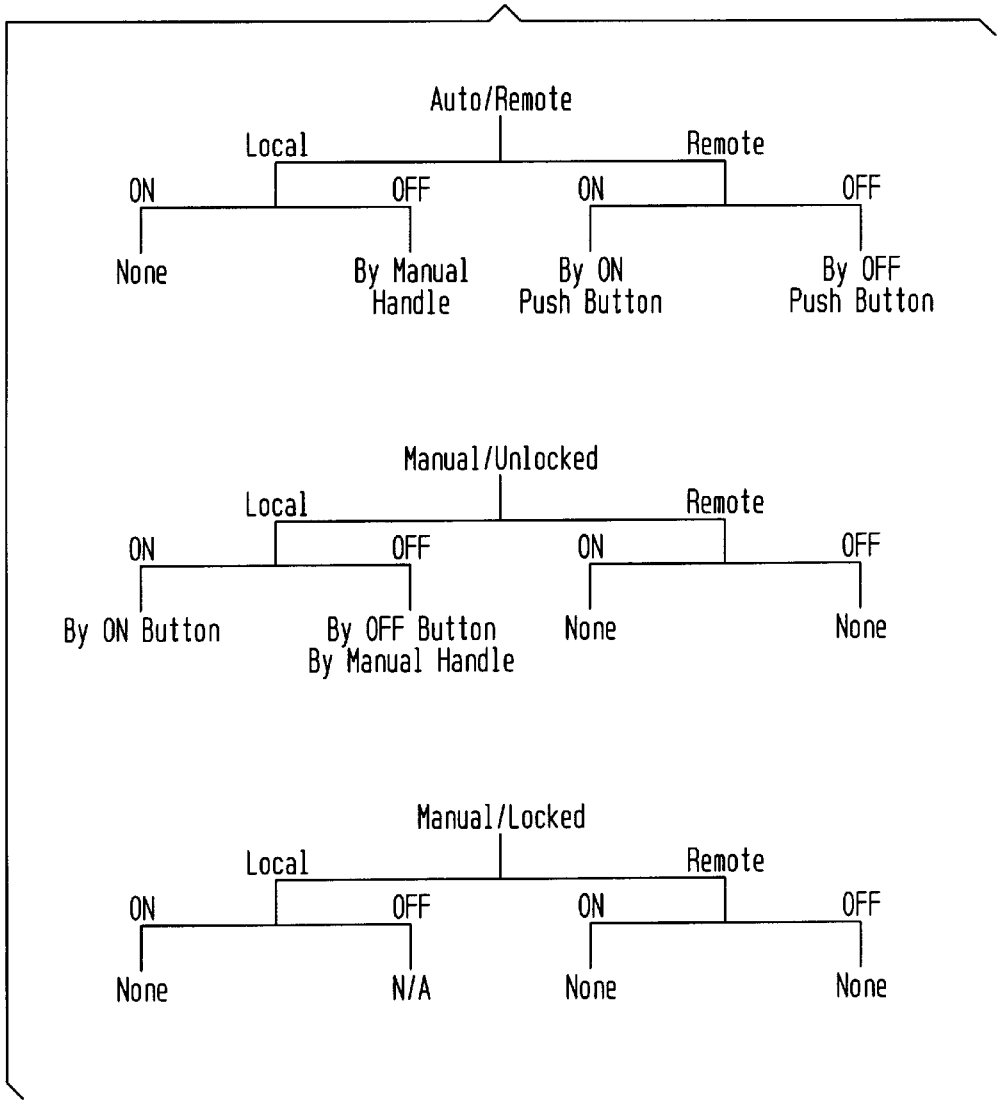
FIG. 5 illustrates the stored energy operator positions, including the automatic/remote, manual/unlocked and manual/locked positions.

As shown in FIGS. 1 to 4, and as is detailed in FIG. 5, the motor operated stored energy circuit breaker may have the following operating features:

If the selector bar or automatic/manual switch 550*s* is set to its manual position and the circuit breaker assembly 100 is OFF, then the charging springs 516*a* and 516*b* of the motor operated stored energy circuit breaker assembly 200 may be charged, the contacts of the circuit breaker assembly 100 are open, remote ON switch 548*r* and remote OFF/TRIP switch 609*r* are blocked, the local OFF/TRIP switch 609 does not trip the circuit breaker assembly 100 (which stays in its reset or OFF position), status indicator light pipe 534*b* indicates OFF/CHARGED and the motor operated stored energy circuit breaker assembly 200 can be locked electrically using automatic/manual switch 550*s* and/or mechanically using cylinder lock 618. In its locked position, the unit cannot be operated either locally or remotely. In its unlocked position, the unit may be operated by pressing ON switch 548, which closes the circuit breaker assembly 100 in less than on the order of about 100 milliseconds.

If the selector bar or automatic/manual switch 550*s* is set to its manual position and the circuit breaker assembly 100 is ON, then the charging springs 516*a* and 516*b* of the motor operated stored energy circuit breaker assembly 200 are discharged, the contacts of the circuit breaker assembly 100 are in their closed position, the remote ON and OFF/TRIP switches 548*r* and 609, respectively, are blocked, the motor operated stored energy circuit breaker assembly 200 cannot be locked and the status indicator light pipe 534*a* indicates ON/DISCHARGED. In this state, the circuit breaker assembly 100 may be turned OFF by pushing local OFF/TRIP switch 609, which may optionally actuate a bell alarm (not shown), on the circuit breaker assembly 100. If there is control power, the OFF/TRIP switch 609 trips the circuit breaker assembly 100 and causes it to go to its OFF position. If there is no control power, the circuit breaker assembly 100 will trip but the status indicator light pipe 534*a* indicates ON/Discharged. If the stored energy assembly is wired through the optional bell alarm (not shown), when control power is restored, the motor operated stored energy assembly 200 is reset causing the circuit breaker assembly 100 to return to its OFF position. The operator charging/reset handle 537 may also be used to turn OFF the circuit breaker assembly 100 without actuating its bell alarm. If there is control power, the motor operated stored energy assembly 200 is set to its charged condition so that the circuit breaker assembly 100 is in its OFF position after a few strokes of the operator charging/reset handle 537. If there is no control power, then continued stroking or ratcheting of the operator charging/reset handle 537 sets the motor operated stored energy assembly 200 to its charged condition so that charging springs 516 are charged and causes the circuit breaker assembly 100 to go to its OFF position. At this point, the charging/reset handle 537 is disengaged.

Optionally, if the stored energy assembly is wired through the optional bell alarm, and if the bell alarm (not shown) of the circuit breaker assembly 100 is actuated after a short circuit trip or under-voltage trip, then the motor operated stored energy assembly 200 may go to its CHARGED/RESET position so that the circuit breaker assembly 100 is set to its OFF position. If the circuit breaker assembly 100 trips by shunt trip, under voltage release, overload or short circuit, the motor operated stored energy assembly 200 does not change its position and the status indicator light pipe 534*a* would indicate ON. Also, the bell alarm (not shown) could be wired so as to actuate the OFF/TRIP switch 609 and charge the springs 516*a* and 516*b*.

If the selector bar or automatic/manual switch 550*s* is set to its automatic position, then when the circuit breaker assembly 100 is in its OFF position, the springs 516*a* and 516*b* are charged, the circuit breaker assembly 100 is closed, remote operation is not blocked, the unit cannot be locked, the status indicator light pipe 534*a* indicates ON/DISCHARGED and the charging/reset handle 537 is engaged. Since there is no local OFF control when automatic operation is enabled, the motor operated stored energy circuit breaker assembly 100 may be only be turned OFF by pushing the remote OFF switch 609*r* of FIG. 6.

Alternatively, of course, local control through the remote OFF switch 609*r* could be made available to the user if that was desired. If there is control power, the local OFF switch 609 of FIG. 6 may be used to trip the circuit breaker assembly 100 and cause the toggle handle 103 of the motor operated stored energy assembly 200 to go to its OFF position. If there is no control power and the stored energy assembly is wired into the optional bell alarm (not shown), then the motor operated stored energy assembly 200 only goes to its OFF (charged) position when control power is restored. If the remote OFF switch 609*r* is actuated, the motor operated stored energy assembly 200 goes to its OFF (charged) position in less than on the order of about one (1) to five (5) seconds. Unless the motor operated stored energy circuit breaker assembly 200 is connected to a bell alarm of the circuit breaker assembly 100, the motor operated stored energy assembly 200 remains in its ON (uncharged) position if the circuit breaker assembly 100 trips by shunt trip or short. Using the charging/reset handle 537 to turn OFF the circuit breaker assembly 100 does not trip it, but will cause the motor operated stored energy assembly 200 to go to its OFF/CHARGED position if there is control power. If there is no control power, then the reset/charging handle 537 must be used to fully recharge the motor operated stored energy assembly 200, thereby completing the charge cycle and causing the status indicator light pipe 534*b* to indicate OFF.

In the manual position, holding the ON and OFF/TRIP switches 548 and 609, respectively, essentially simultaneously or at about the same time, causes the motor operated stored energy circuit breaker assembly 200 to cycle OFF and ON. To lock the motor operated stored energy assembly 200 using pad locks or key locks, the selector bar or automatic/manual switch 550*s* must be in its MANUAL position so as to lock out both electrical and mechanical operations of the motor operated stored energy circuit breaker assembly 200 using hasp 538 and a locking apparatus, such as a wire and seal or a locking cable (not shown). In the automatic (remote) position, as can be seen from FIG. 7, nothing will happen since the motor operated stored energy assembly 200 is only OFF or ON but cannot be both OFF and ON at essentially the same time.

Figure 6:
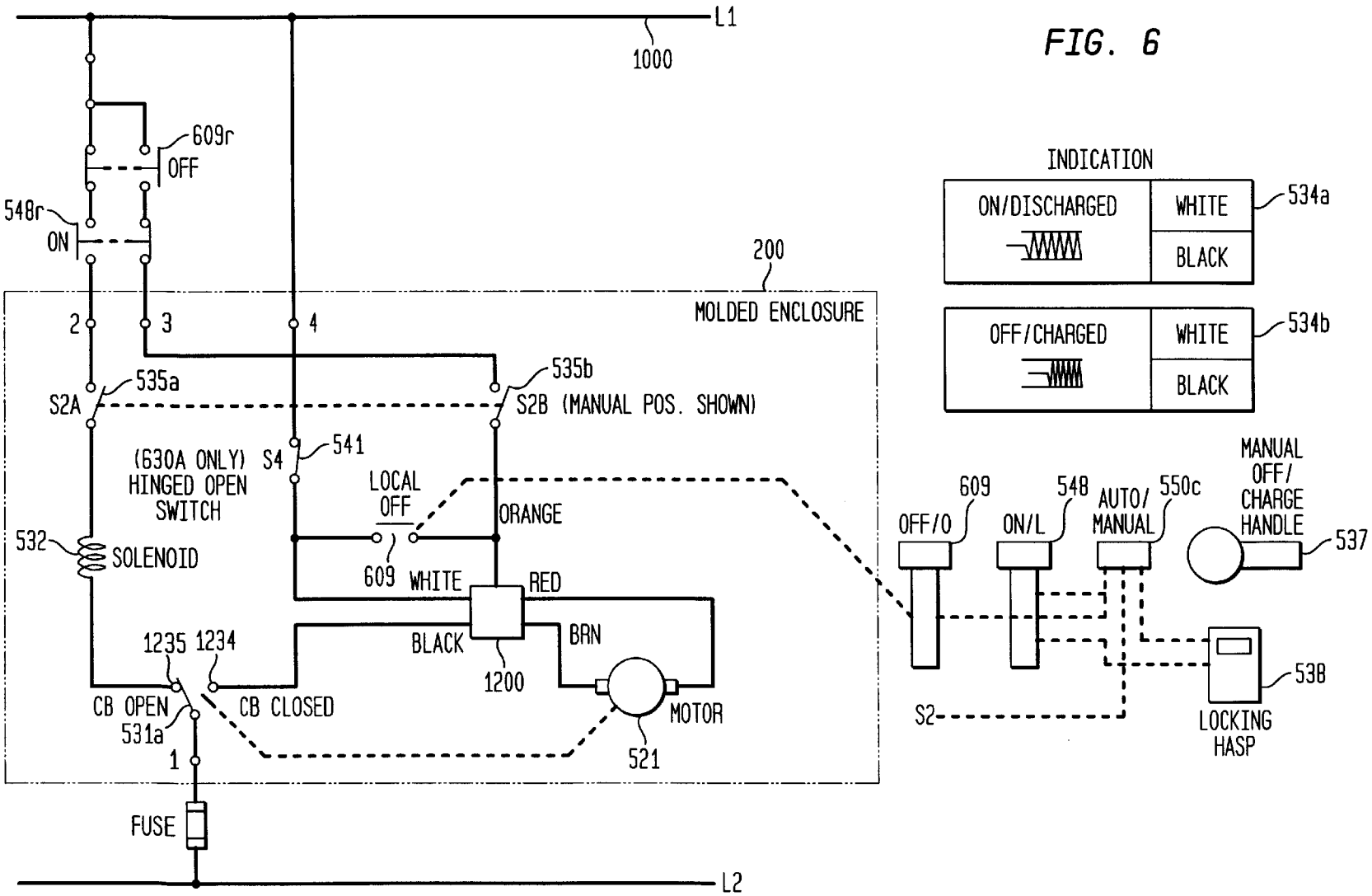
FIG. 6 is a schematic view of the circuitry of the motor operated stored energy assembly with a control module.
Figure 7:
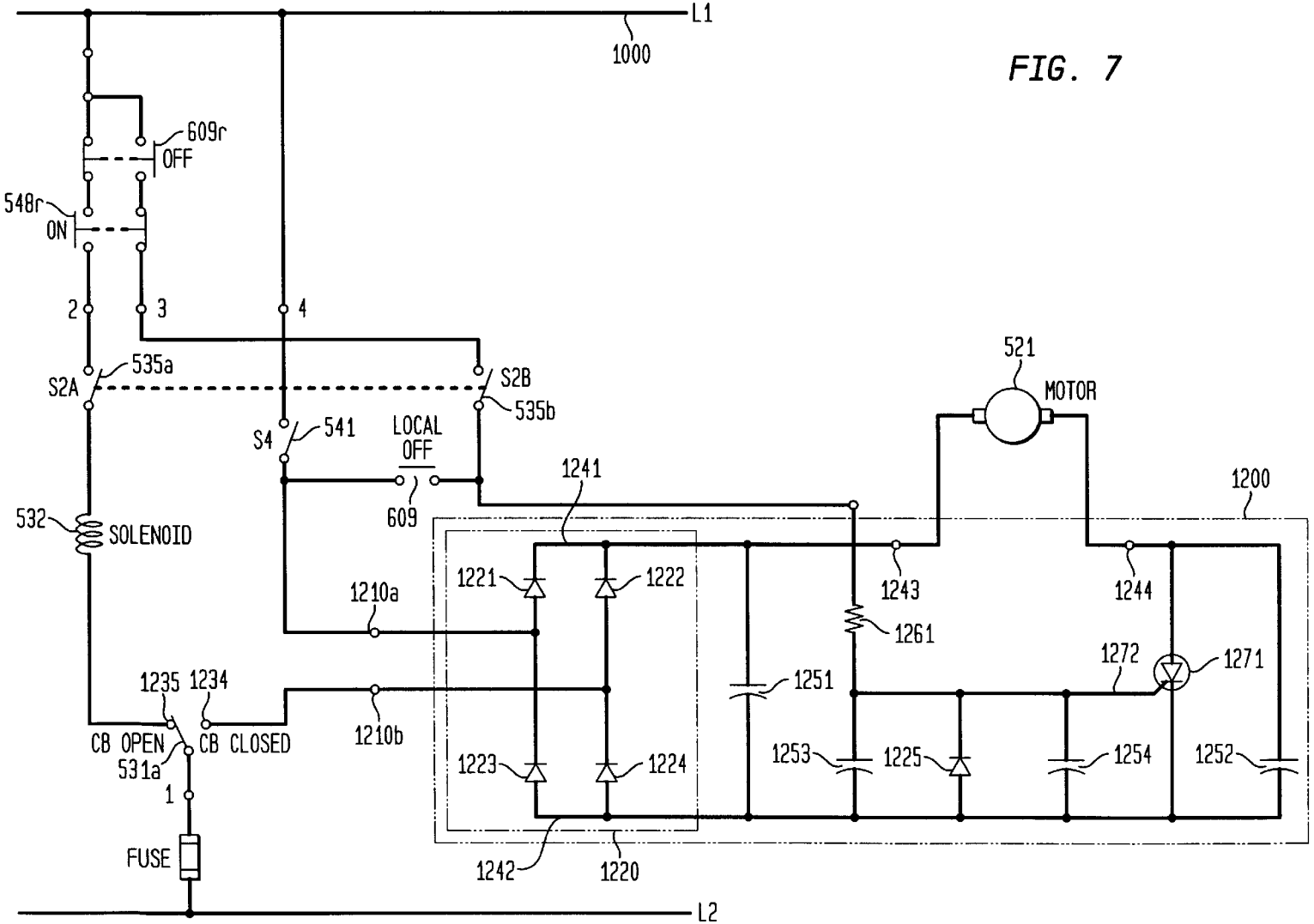
FIG. 7 is a schematic view of the motor control circuit of the motor control module.

FIG. 6 is a schematic view of the circuitry 1000 of the motor operated stored energy circuit breaker assembly 200 with a control module 1200, while FIG. 7 is a schematic view of the circuitry of the control module 1200. As regards the above and as is shown in FIG. 7, a cam operated limit switch 531*a* having circuit breaker open position 1235 and circuit breaker closed position 1234 which operates the electric motor 521 when the circuit breaker assembly 100 is open and interrupts operation, is controlled by the release solenoid 532, that is controlled by the relative position of the operator gear cam 515*c* of FIG. 15. The automatic/manual switch 550*s* controls the operation of switches 535*a* and 535*b* (switches S2A and S2B). As shown, the locking hasp 538 may be used to inhibit operation of the OFF Switch 548 and automatic/manual switch 550*s*. Optionally, automatic recharging of the charging springs 516*a* and 516*b* after the circuit breaker assembly 100 trips may also be provided.

More specifically, FIGS. 6 and 7 show an electronic circuit 1200 for causing the electric motor 521 on a motor operated stored energy circuit breaker assembly 200 to start and continue to run when a short duration signal of at least on the order of about ten milliseconds is applied. As discussed, the motor operated stored energy circuit breaker assembly 200 may have relatively fast circuit breaker closing times (for example, less than on the order of about 100 milliseconds) and a relatively slow opening cycle (for example, less than on the order of about one (1) to five (5) seconds). Also as discussed, the closing cycle is powered by the charging springs 516*a* and 516*b*, which are charged during the opening cycle by operating the electric motor 521. Because the motor running time is relatively long and the motor starting signal is relatively short, it is believed that it may be desirable or even necessary, depending on the application, to have some way of supplying the current to the electric motor 521 after the motor starting signal is momentarily applied by solenoid 532. While this may be done using an additional cam and limit switch in an alternative embodiment, it is believed to be preferable to use the electronic control module 1200 as described herein.

It is believed that the electronic control module 1200 may provide the following advantages: the electric motor 521 continues to run even if only a relatively short duration motor starting signal is applied; an extra cam and limit switch are not needed; there may be improved reliability and reduced cost; either a universal AC or a DC motor may be used; there should be reduced space requirements in the motor operated stored energy circuit breaker assembly 200; it should be more difficult and more unlikely for a user to connect the wrong polarity wire when connecting power to the motor operated stored energy circuit breaker assembly 200.

FIGS. 6 and 7 illustrate the electronic circuit assembly 1200 in which either AC or DC power may be supplied between terminals 1210*a* and 1210*b*. The current may be of either positive or negative polarity. As designed, it is intended that the electronic control module 1200 essentially keep electric current flowing through the motor when a set of electrical contacts between points 609*r* or 609 are momentarily closed.

In particular, when the motor operated stored energy circuit breaker assembly 200 is in its uncharged state so that the circuit breaker assembly 100 is closed to its ON position, cam operated limit switch 531 is in its closed circuit breaker position and contacts terminal 1234. The position shown in FIG. 7 is the open circuit breaker position. In this way, cam operated limit switch 531 allows current flow through the electric motor 521. If there is an AC voltage between terminals 1210*a* and 1210*b*, it is converted to a full wave rectified DC signal by a bridge rectifier 1220 formed by diodes 1221, 1222, 1223 and 1224. When either local OFF switch 609 or remote OFF switch 609*r* is momentarily closed, depending on the position of mechanical automatic/manual switch 550*s* and corresponding electrical switches 1260*a* and 1260*b*, current flows through a gate 1272 of SCR 1271 thereby turning it on. Current continues to flow through SCR 1271 until the electric motor 521 causes the circuit breaker assembly 100 to move to its OFF or open position. At this time, cam operated limit switch 531 moves from a first position 1234, corresponding to a closed circuit breaker position, to a second position 1235, corresponding to an open circuit breaker position, in series with solenoid 532 thereby stopping current flow through SCR 1271 and the electric motor 521. Capacitor 1251 is intended to prevent the voltage across the SCR 1271 from going to or significantly approaching zero so as to turn off the SCR 1271. Capacitor 1251 is selected such that the control module circuit 1200 works throughout an appropriate specified range, such as about 24 to 250 volts AC or DC, for certain class circuit breakers assemblies. Of course, the appropriate and specified range may be different for other class circuit breakers. As designed, it is believed that the control module circuit 1200 should operate correctly regardless of whether the input voltage is AC or DC and regardless of the voltage polarity.

More specifically, as shown in FIG. 7, the bridge rectifier 1220 comprising diodes 1221, 1222, 1223 and 1224 is parallel to capacitor 1251. The bridge rectifier 1220 and capacitor 1251 are electrically connected to electric motor 521. A first sub-circuit comprising resistor 1261, capacitors 1253 and 1254, and zener diode 1225 provides the input signal to trigger the SCR gate 1272. In particular, resistor 1261 is in series with the parallel combination of capacitors 1253 and 1254 and zener diode 1225. The electric motor 521 is connected between points 1243 and 1244. Points 1241 and 1243 are common nodes for bridge rectifier diodes 1221 and 1222 and capacitor 1251. A second subcircuit comprises capacitor 1252 in parallel with SCR 1271, which has capacitor 1254 tied between its SCR gate 1272 and relative ground point 1242. Terminal 1210*a* connects between bridge rectifier diodes 1221 and 1223, while terminal 1210*b* connects between bridge rectifier diodes 1222 and 1224. Finally, cam operated limit switch 531 may comprise an SPDT switch, where an inductor or solenoid 532 is connected between a second terminal 1235 of switch 531 (while terminal 1210*b* is connected to a first terminal of 1234 of switch 531).

The component values of the specific embodiment are as follows:

| Number | Component | Designation |
|---|---|---|
| 1221–1224 | 4 diodes | 5400 |
| 1225 | zener diode | BZX55C4V3 (National Semiconductor) |
| 1251 | capacitor | 100 uF |
| 1252 | capacitor | 0.015 uF |
| 1253 | capacitor | 1 uF |
| 1254 | capacitor | 0.1 uF |
| 1261 | resistor | 5K ohms |
| 1271 | Silicon COntrolled Rectifier | S6008L (Teccor) |

As is generally shown in FIGS. 1, 2, 3 and 10, the motor operated stored energy circuit breaker assembly 200 comprises a motor operated stored energy housing 543, a main operator subassembly 400 and a circuit breaker adapter base or mounting plate assembly 501. More particularly, the motor operated stored energy circuit breaker assembly 200 is adapted, attached, mounted or otherwise secured on the face or front of the circuit breaker assembly 100 using the circuit breaker adapter base or mounting plate assembly 501 that is adapted, attached, mounted or otherwise associated, to the circuit breaker assembly 100, and to which the motor operated stored energy circuit breaker assembly 200 is attached, mounted or otherwise associated.

In particular, and as is shown in FIGS. 8 to 18, 35A and 35B the circuit breaker adapter base or mounting plate assembly 501 comprises left and right vertical sides 501*a* and 501*b* and top and bottom horizontal sides 501*c* and 501*d*, respectively. The adapter base 501 further comprises a front surface 501*e* having a rectangular shaped recessed area 501*w* and a circuit breaker toggle aperture 501*t* for receiving circuit breaker toggle handle 103. Fastening apertures 501*g*, 501*h*, 501*k*, 501*l*, 501*m* and 501*n* receive six screws (not shown) or any other suitably appropriate fastening apparatus to securedly attach, mount or otherwise associate the adapter base 501 with respect to corresponding mounting apertures (not shown) on the face of the circuit breaker assembly 100.

Additionally, a terminal bus assembly 501*p* is integrally associated with a terminal bus surface 501*w* of the recessed rectangular are a 501*w*. Terminal screws 605*a* to 605*f* are received by terminal threaded inserts 586*a* to 586*f*, which are insertedly fitted into terminal bus assembly 501*p*. The terminal screws 605 are used to connect wires for controlling and operating the motor operated stored energy circuit breaker assembly 200 as shown in FIGS. 6 and 7.

Figure 35B:
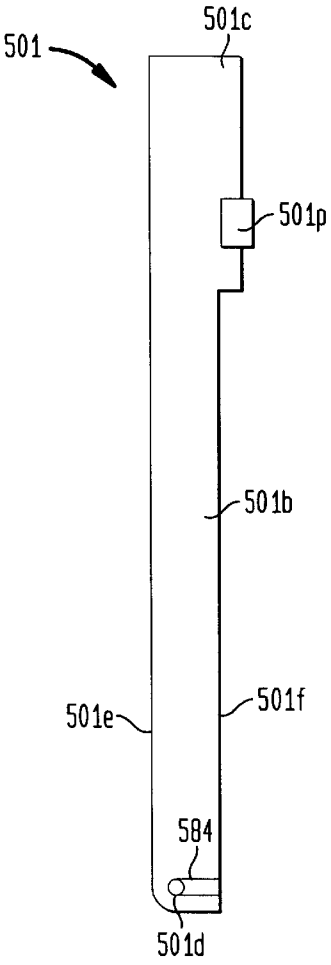
FIG. 35B is a solid side view of the movable adapter base for the motor operated stored energy assembly.
Figure 35A:
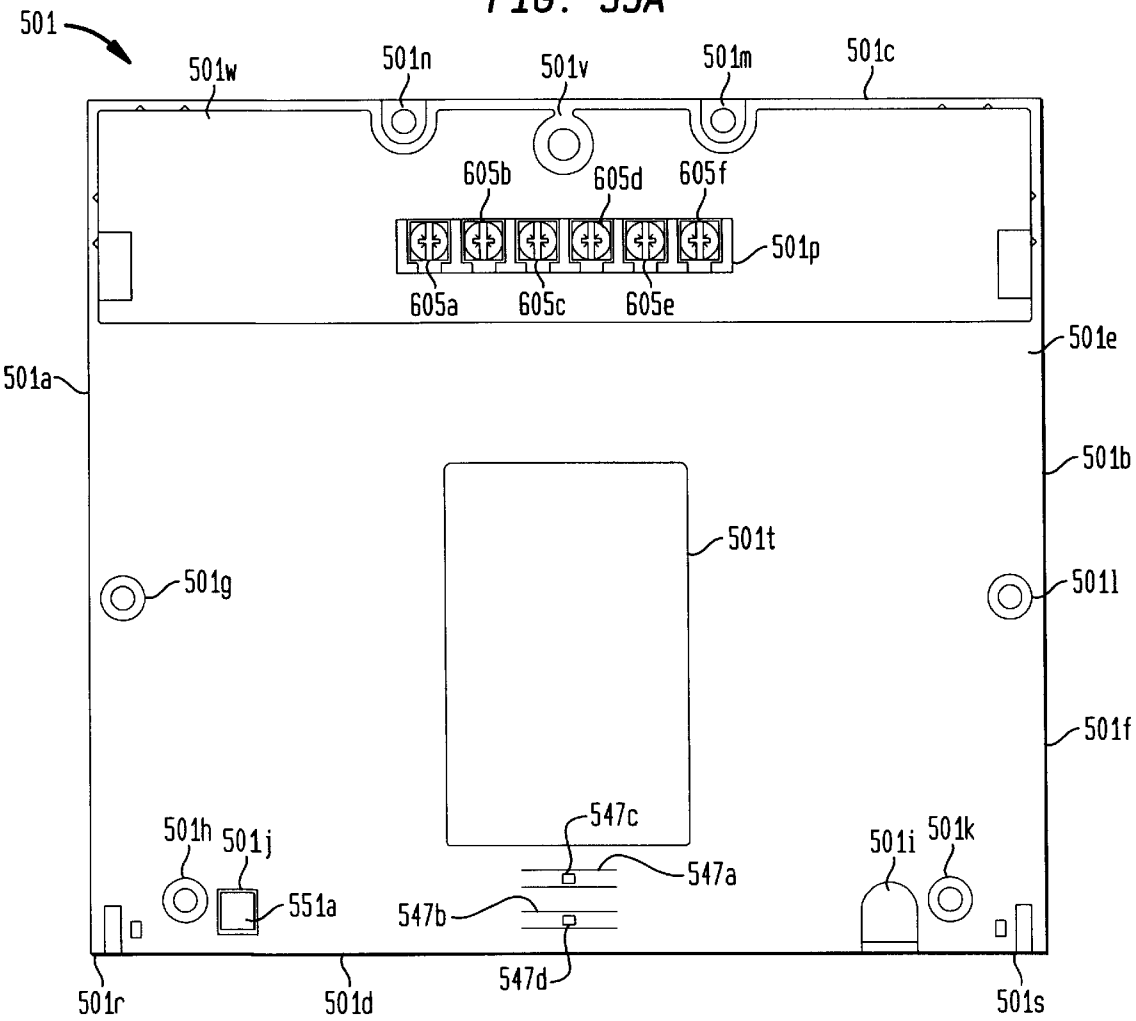
FIG. 35A is a solid front view of the movable adapter base for the motor operated stored energy assembly.
Figures 36A, 36B, 37A, 37B:
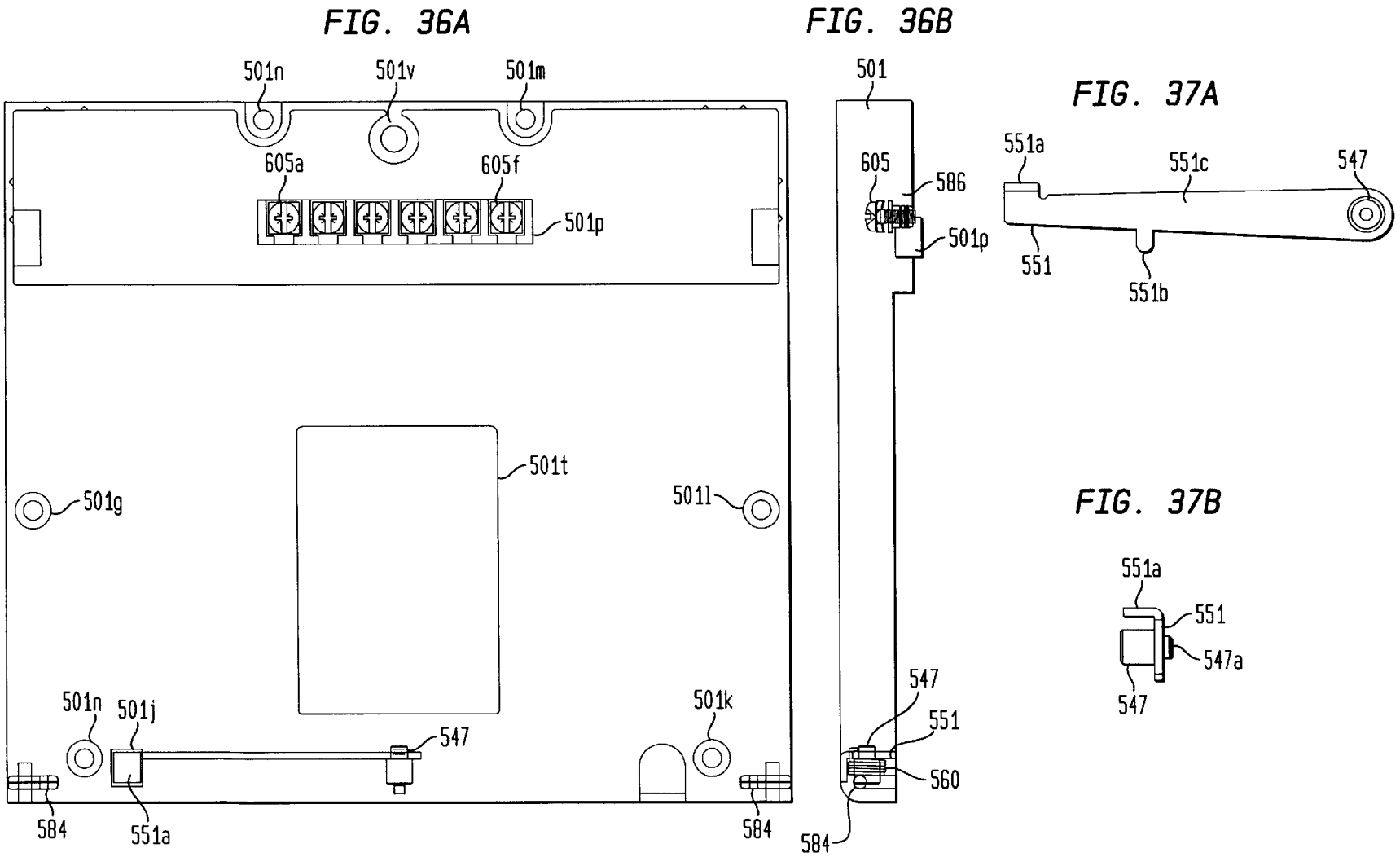
FIG. 36A is a front view of the movable adapter base for the motor operated stored energy assembly.
FIG. 36B is a side view of the movable adapter base for the motor operated stored energy assembly.
FIG. 37A is a top view of the trip arm assembly for the movable adapter base of the motor operated stored energy assembly.
FIG. 37B is a side view of the trip arm assembly for the movable adapter base of the motor operated stored energy assembly.
Figure 38B:
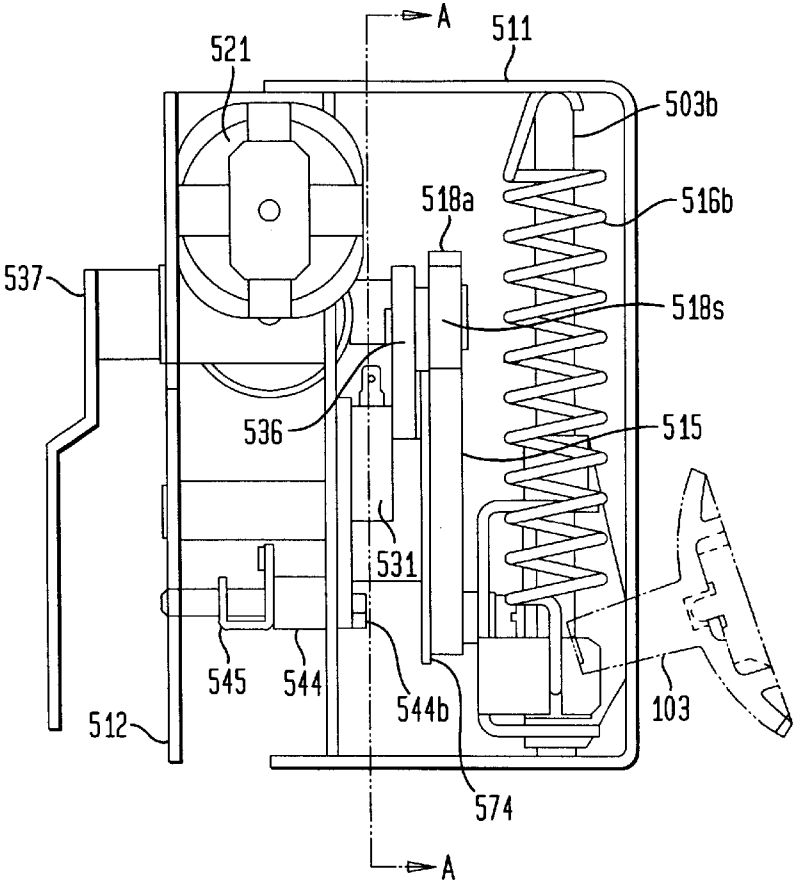
FIG. 38B is a simplified side view of the motor operated stored energy apparatus with the circuit breaker contacts open and the springs charged.
Figure 38A:
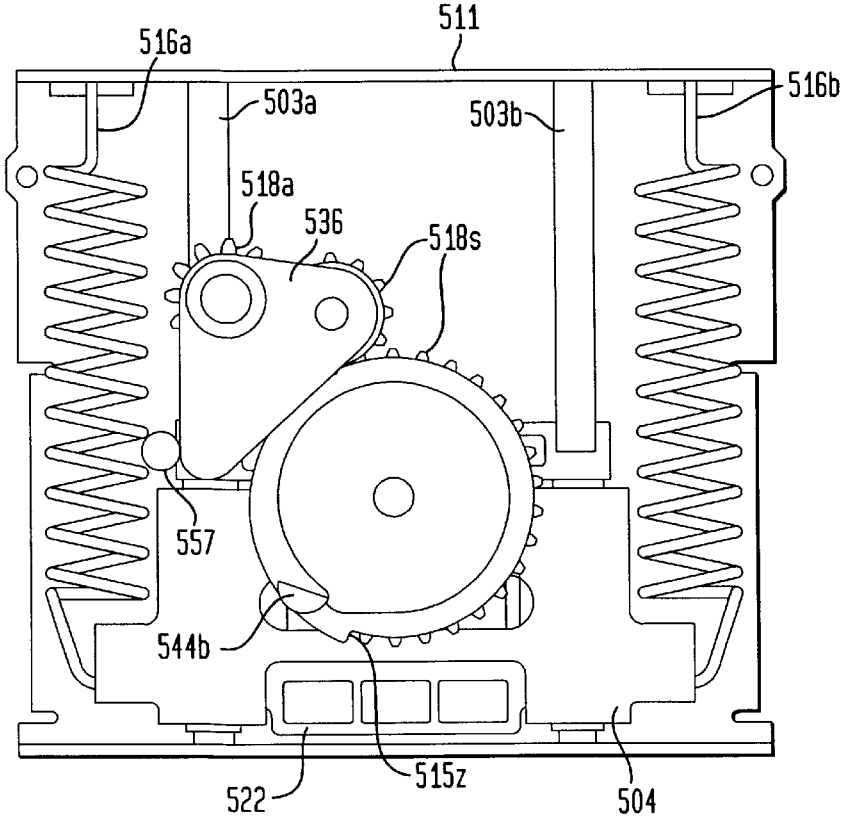
FIG. 38A is a simplified frontal view of the motor operated stored energy apparatus with the circuit breaker contacts open and the springs charged.
Figure 39B:
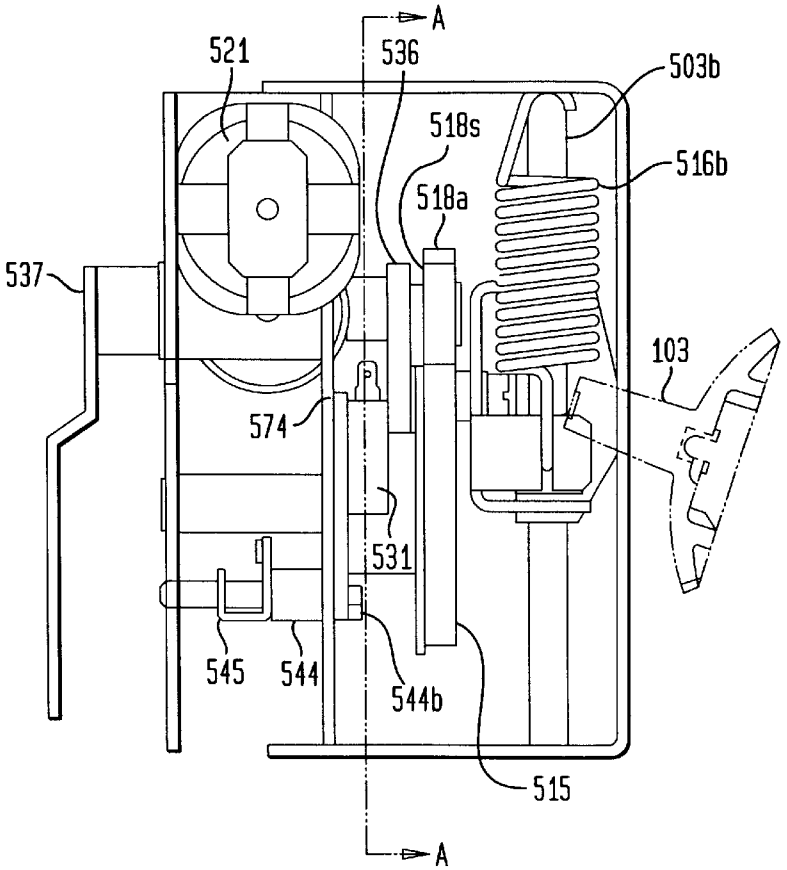
FIG. 39B is a simplified side view of the motor operated stored energy apparatus with the contacts closed and the springs discharged.
Figure 39A:
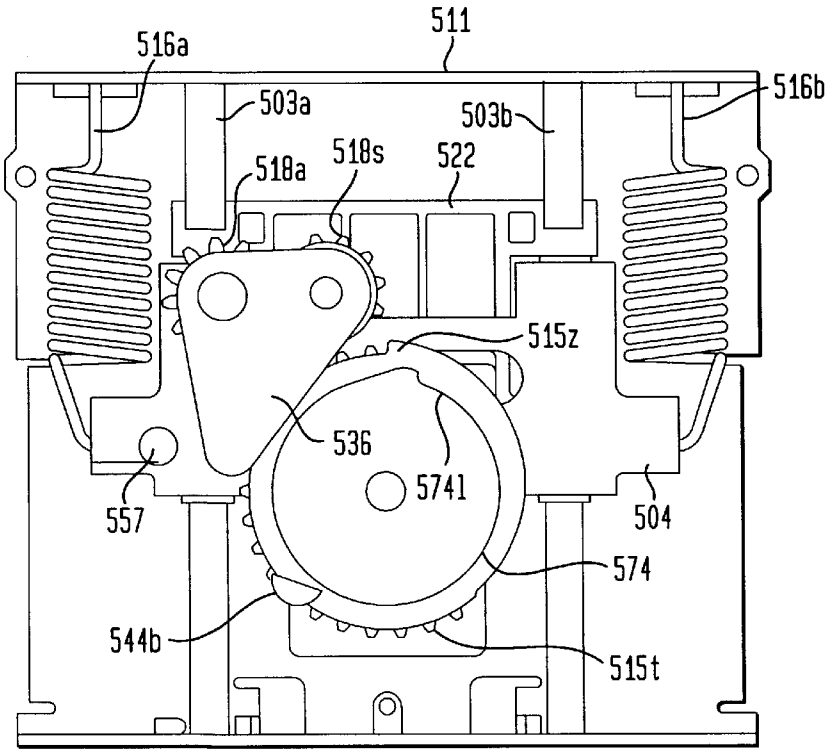
FIG. 39A is a simplified frontal view of the motor operated stored energy apparatus with the contacts closed and the springs discharged.
Figure 40B:
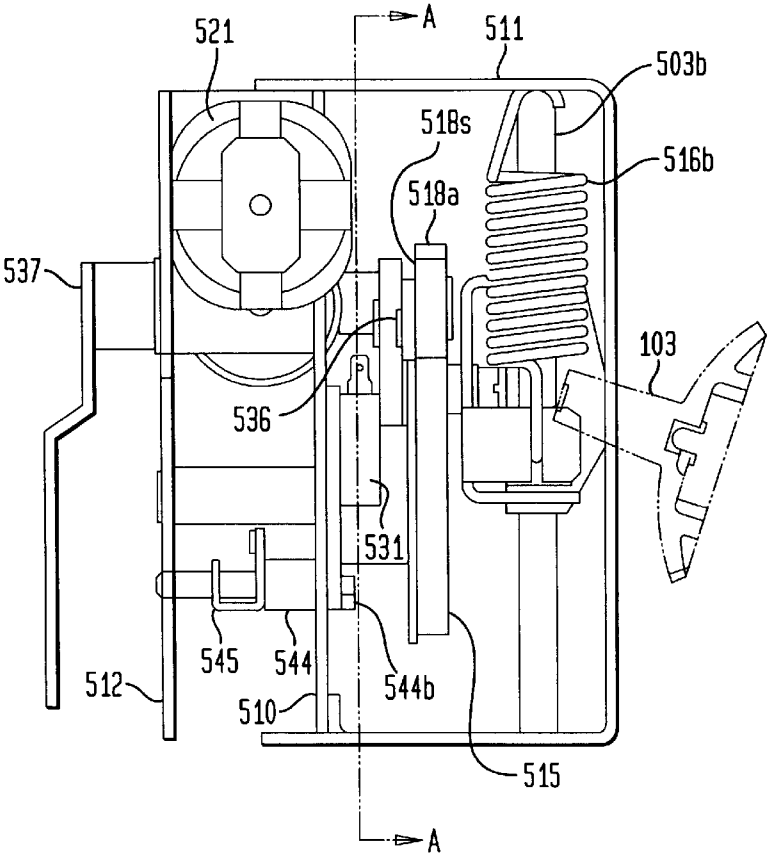
FIG. 40B is a simplified side view of the motor operated stored energy apparatus with the main operator gear engaged to charge the springs.
Figure 40A:
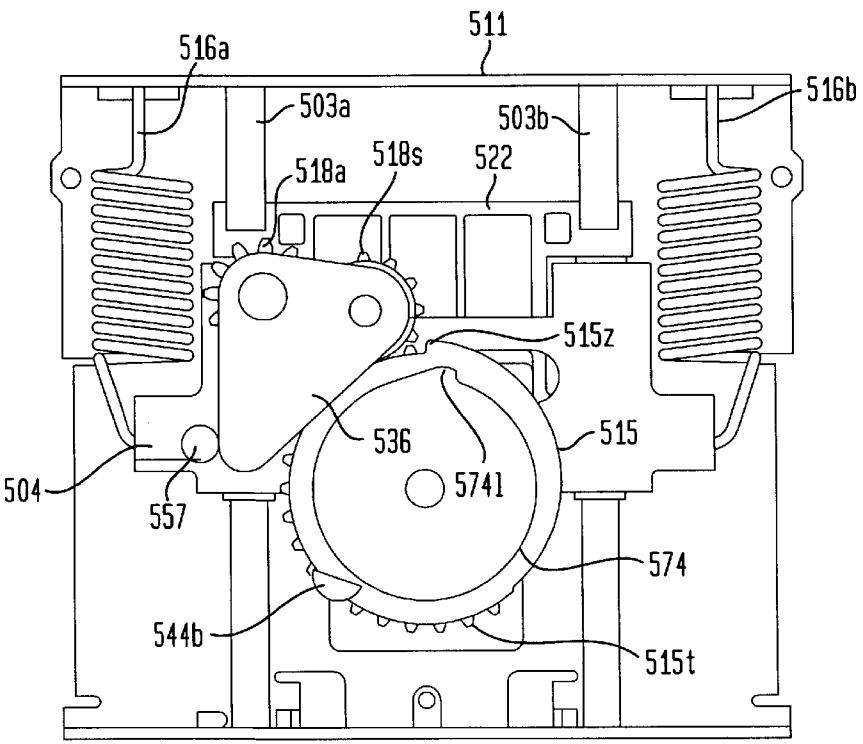
FIG. 40A is a simplified frontal view of the motor operated stored energy apparatus with the main operator gear engaged to charge the springs.

Also, as shown in FIGS. 35*b* 36 and 37, bottom side 501*d* and front surface 501*e* has a wire aperture 501*i*. The wires (not shown) are for operably connecting the motor operated stored energy circuit breaker assembly 200 and the circuit breaker assembly 100 using the terminal screws 605 of the terminal bus 511*p*. Also, circuit breaker trip aperture 501*j* receives a trip flange 551*a* of a trip arm 551, which further comprises a trip extension member 551*b*. The trip arm 551 is rotateably mounted using return spring 560, dowel pin 615 and pivot bushing 547, which is insertedly fitted between upper and lower ribbed extensions 547*a* and 547*b* of a rear surface 501*f* of adapter base 501. Finally, roll pins 584*a* and 584*b* are used to pivotally mount housing pivotal mounting members 511*a* and 511*b* of internal main housing 511 to the adapter base pivot al mounting members 501*r* and 501*s*.

As shown in FIGS. 1 and 2, the motor operated stored energy housing 543 comprises four sides 543*a*, 543*b*, 543*c*, 543*d* and a front face 543*e*. Front face or surface 543*e* further comprises a circular aperture or other opening 543*f* for receiving a manual reset/charging or operator handle 537, rectangular apertures or openings 548*f* and 609*f* for receiving ON and OFF TRIP switches 548 and 609, respectively, a horizontal slotted aperture 543*g* for receiving a manual/automatic lockout slide handle 546 and ON and OFF display apertures 543*x* and 543*y* for receiving the indicator light pipes 534*a* and 534*b*. The motor operated stored energy housing 543 is preferably configured as is shown in FIG. 3 for a 630A circuit breaker, which shows the front cover portion of the motor operated stored energy operator assembly 200 comprising the manual reset/charging handle 537, the ON switch 548, an OFF switch 609, the manual/automatic lockout slide handle 546, an ON/Discharged indicating light pipe aperture 543*x* and an OFF/Charged indicating light pipe aperture 543*y* as well as manual hasp locking assembly 538 and a cylinder key lock assembly 618. The operator handle 537 fits in recessed handle area 543*w* defined by recessed vertical housing surface 543*z* which is perpendicular to handle surfaces 543*m*, 543*n*, 543*o*, 543*aa* and 543*bb*. Which provides what is believed to be a more efficiently sized housing 543. An alternative layout for 125 Amp and 250 Amp rated circuit breaker assemblies is shown in FIG. 4.

As is also shown in FIG. 2, the main subassembly 400 comprises a first or front motor mount subassembly plate or upper gear housing 512, a second or middle subassembly plate or lower gear housing 510 and a third or main subassembly mounting plate or internal housing 511. Each of the subassembly housing plates 510, 511, and 512 may be formed from steel or any other suitably appropriate material.

Frontal and side views of the main subassembly 400 are shown in FIGS. 8 to 11, 14 to 20, 23, 24 and 27 to 33.

Figure 10:
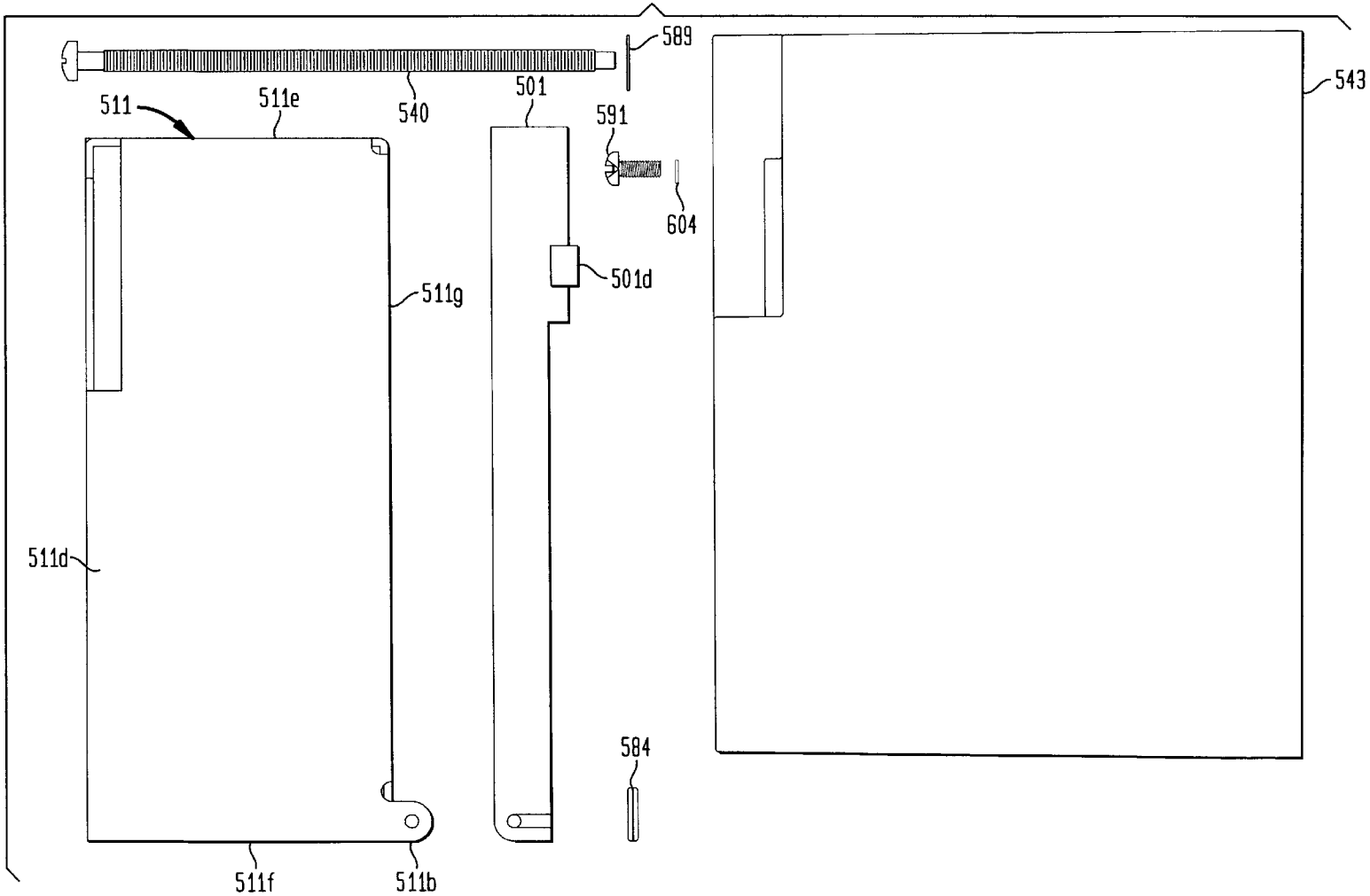
FIG. 10 is a side view of the motor operated stored energy assembly external casing or housing and its main internal housing.

In particular, FIGS. 2, 10 and 14 show various views of the components of the third or main interior housing 511. The main interior housing 511 comprises first and second vertical sides 511*c* and 511*d*, top and bottom sides 511*e* and 511*f* and a toggle handle rectangular aperture or opening 511*t* in mounting or back side 511*g*. Left vertical housing side 511*c* has a perpendicular mounting flange 511*o*, right vertical housing side 511*d* has a shorter perpendicular mounting flange 511*q*, bottom horizontal housing side 511*f* has a perpendicular mounting flange 511*p* and top horizontal housing side 511*e* has a shorter perpendicular mounting flange 511*n*. OFF/TRIP bottom 609 is used to actuate trip rod member 553 so as to trip the trip button (not shown) of the circuit breaker assembly 100. Main screw 540 is used through upper securing aperture 501*v* and 511*v* to mount or otherwise partially secure the main internal housing 511 to adapter base 501. Main housing mounting flanges have main internal housing mounting apertures 511*h*, 511*i*, 511*j*, 511*k* and 511*ii* corresponding to lower gear housing mounting apertures 510*h*, 510*i*, 510*j*, 510*k* and 510*ii* using five screws 591 and lockwashers 596. Top side 511*e* has first and second guide rod bosses (not shown) for receiving top ends 503*c* and 503*d* of guide rods 503*a* and 503*b*, and retainers 599*a* and 599*b*, and bottom flange rivet apertures (not shown) for receiving guide rod rivets (not shown) or any other suitably appropriate fastening apparatus for securing the bottom ends 503*e* and 503*f* of the guide rods 503*a* and 503*b*, respectively, to the bottom side 511*d* of the main interior housing 511. Extension springs 516*a* and 516*b* each have top and bottom hooked ends 516*c*, 516*d* and 516*e*, 516*f*, respectively. Bottom or lower extension spring hooked ends 516*e*, 516*f* fit into slotted spring apertures 504*a* and 504*b*, respectively, of first and second vertical side flanges 504*c* and 504*d* of drive connector 504, respectively. Upper extension spring hooked ends 516*c* and 516*d* fit into first and second notchback dips 511*aa* and 511*bb*, respectively.

Figure 30A:
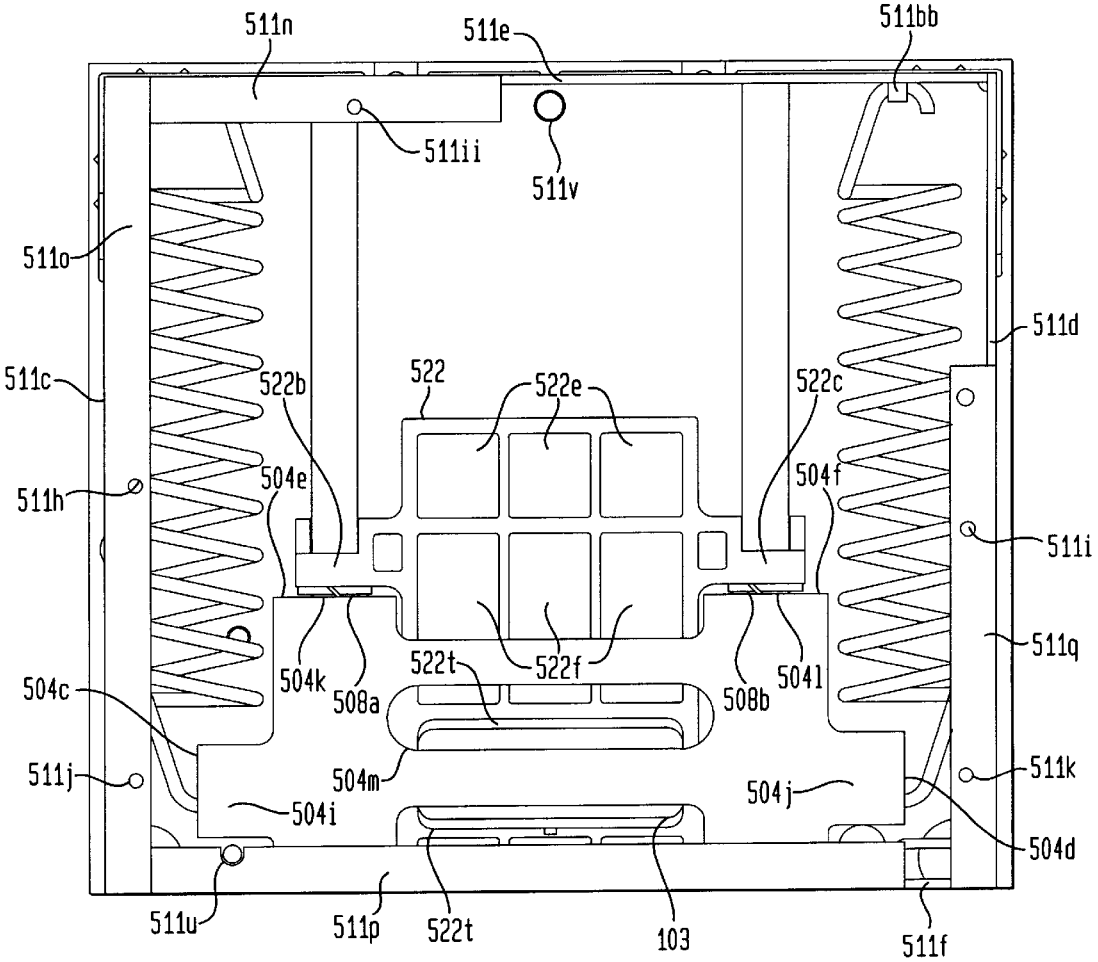
FIG. 30A is a solid front view of the main internal housing of the motor operated stored energy assembly, including the drive connector plate, toggle slide plate and charging springs.
Figure 30B:
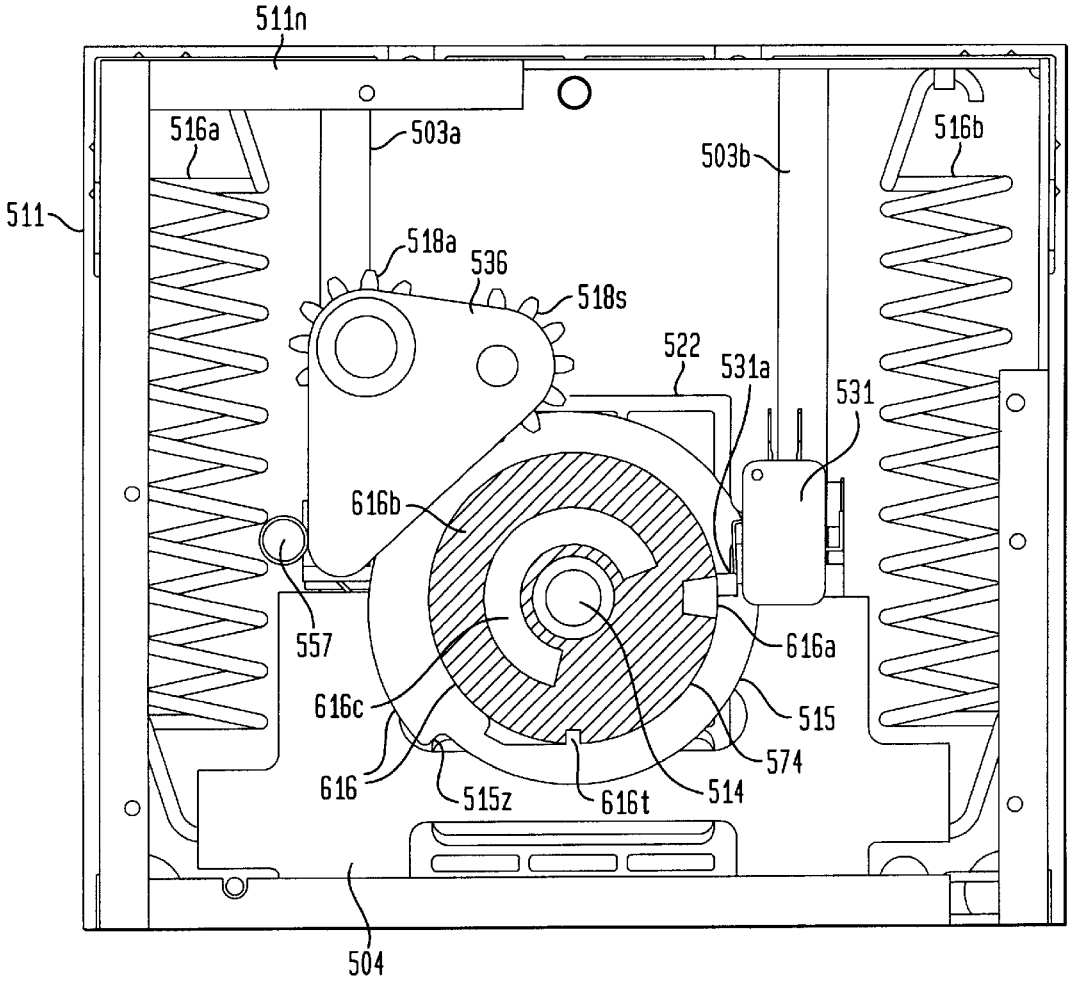
FIG. 30B is a solid front view of the main internal housing of the motor operated stored energy assembly, including the drive connector plate, toggle slide plate and charging springs, including some additional detail.
Figure 31:
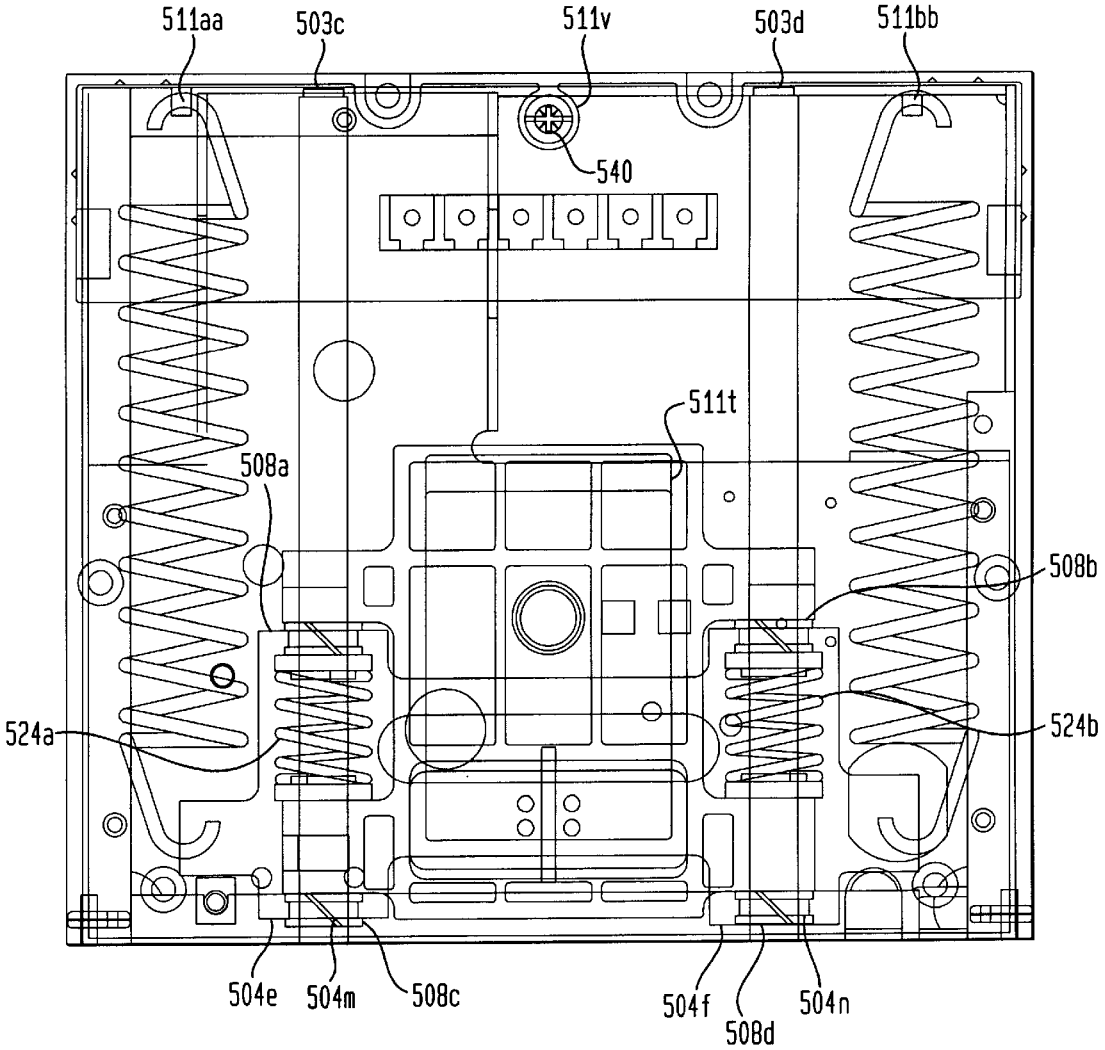
FIG. 31 is a front view of the main internal housing of the motor operated stored energy assembly, including the drive connector plate, toggle slide plate and charging springs.
Figure 32:
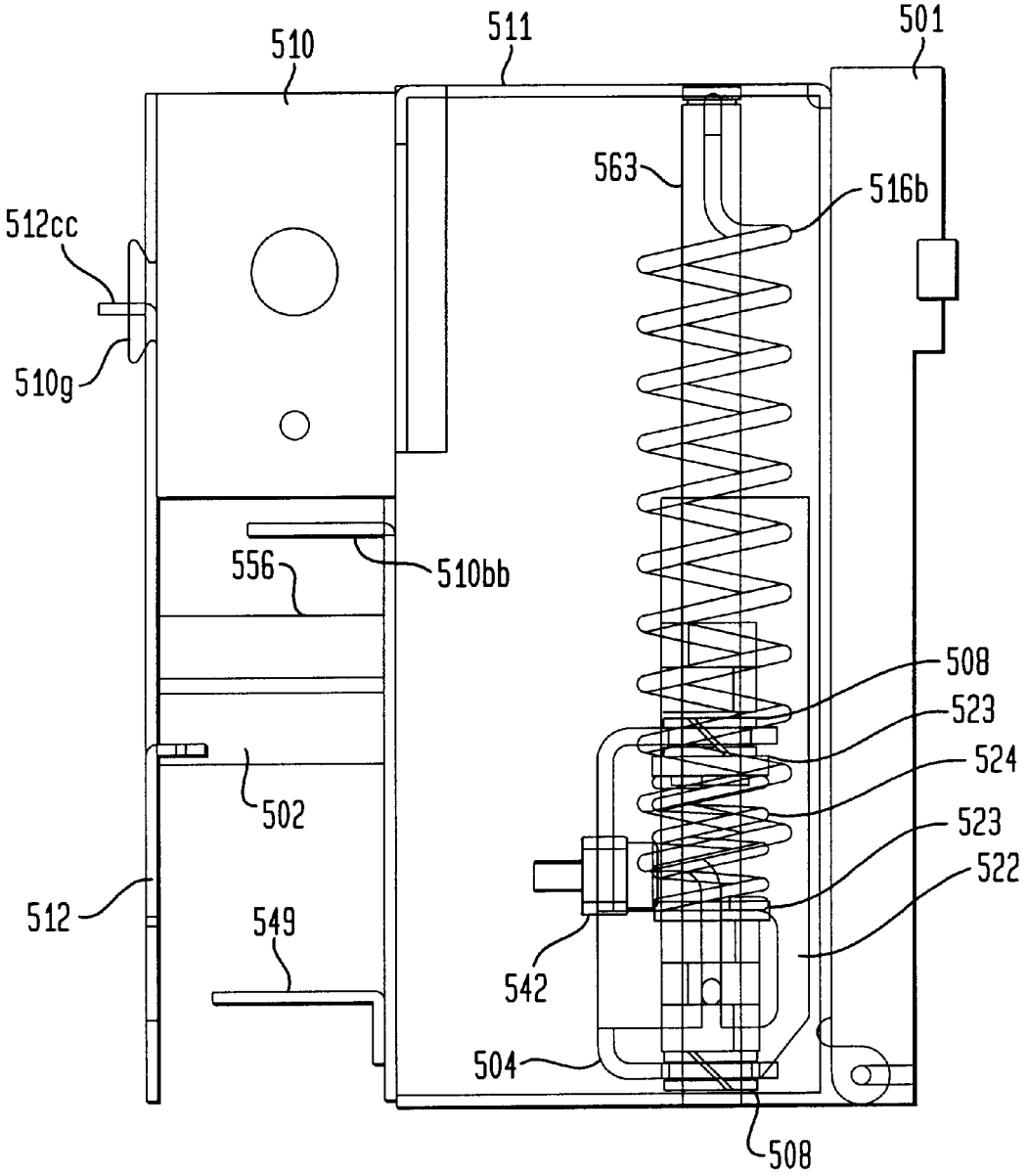
FIG. 32 is a side view of the main internal housing of the motor operated stored energy assembly, including the drive connector plate, toggle slide plate and charging springs.
Figure 33:
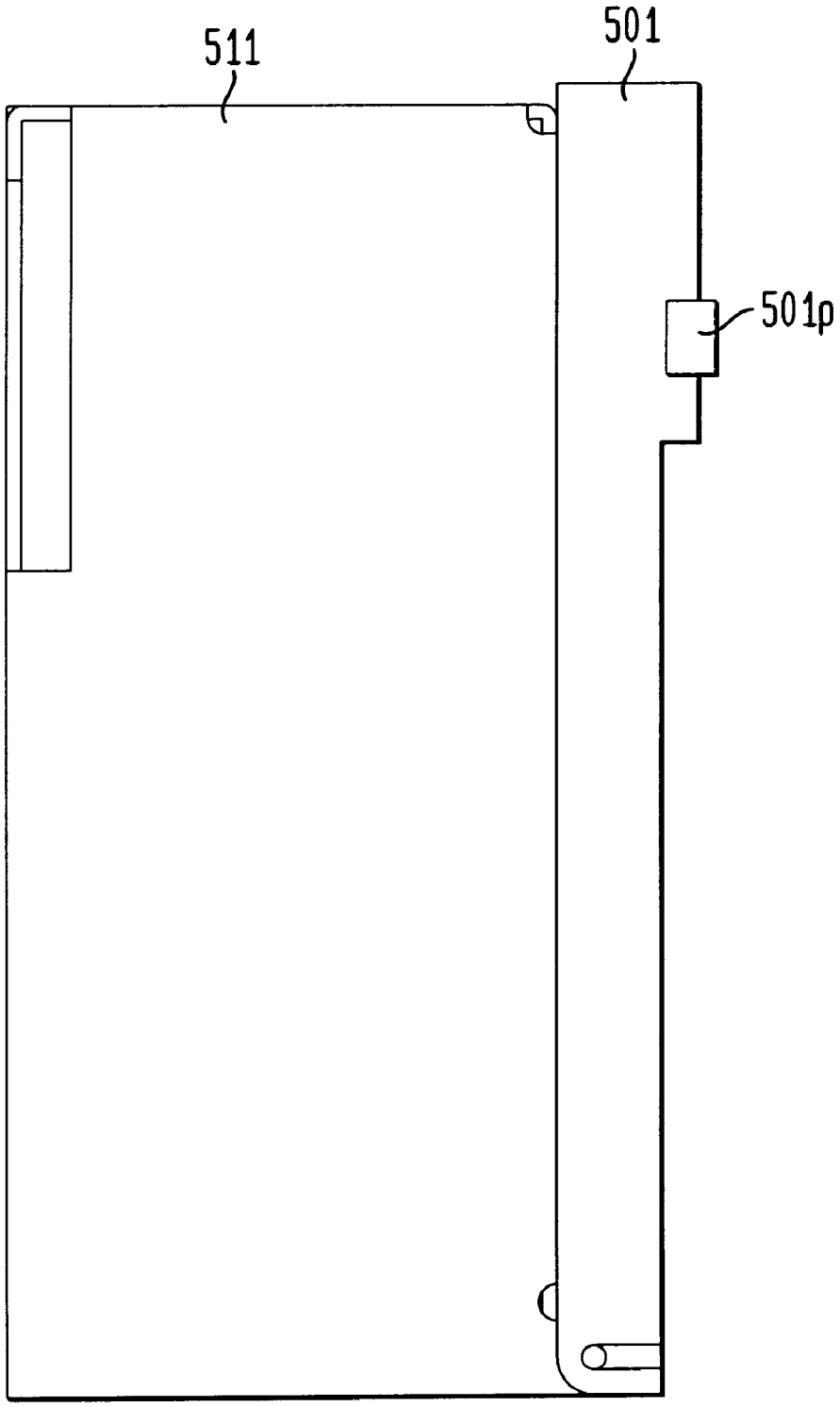
FIG. 33 is a solid side view of the main internal housing and movable adapter base of the motor operated stored energy assembly.

As shown in FIGS. 30 and 31, the drive connector 504, which is preferably made of steel but which may be made of any suitably appropriate material, comprises first and second upper and lower drive connector flanges 504*e*, 504*g* and 504*f*, 504*h*, respectively, as well as first and second side drive connector flanges 504*i*, 504*j*, which further have corresponding first and second side vertical side flanges 504*c*, 504*d* having slotted spring apertures 504*a*, 504*b*. Upper and lower flanges 504*e*, 504*f* and 504*g*, 504*h* have upper and lower guide rod apertures 504*k*, 504*l* and 504*m*, 504*n* respectively, which receive nylon bushings 508*a*, 508*b* and 508*e*, 508*d*. Toggle slide plate 522 comprises toggle operator handle slide aperture 522*t*, first and second upper and lower guide rod members 522*b*, 522*d* and 522*c*, 522*f*, respectively, and first and second overtoggle springs 524*a*, 524*b*, fit between the first and second upper and lower guide members, respectively. Spring centering washers 523*a*, 523*b*, 523*c* and 523*d* fit between the left and right overtoggle springs 524*a*, 524*b* and the plastic/nylon slide bushings 508*a*, 508*b*, 508*c* and 508*d*, which fit in the first and second upper flange apertures 504*e* and 504*f* and the first and second lower flange apertures 504*g* and 504*h*, respectively, in first and second lower flanges 504*e* and 504*f*. The first and second overtoggle springs 524*a* and 524*b* are believed to limit at least to some extent the force that the toggle slide plate 522 and drive connector 504 exert against the circuit breaker toggle handle 103.

Figure 34A:
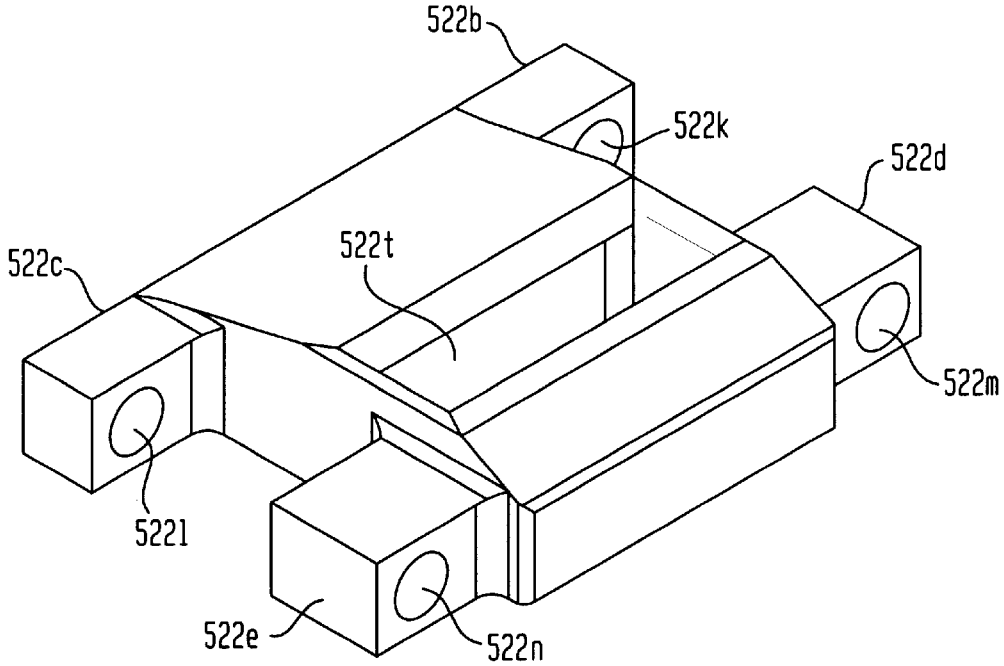
FIG. 34A is a simplified front perspective view of the toggle slide.
Figure 34B:
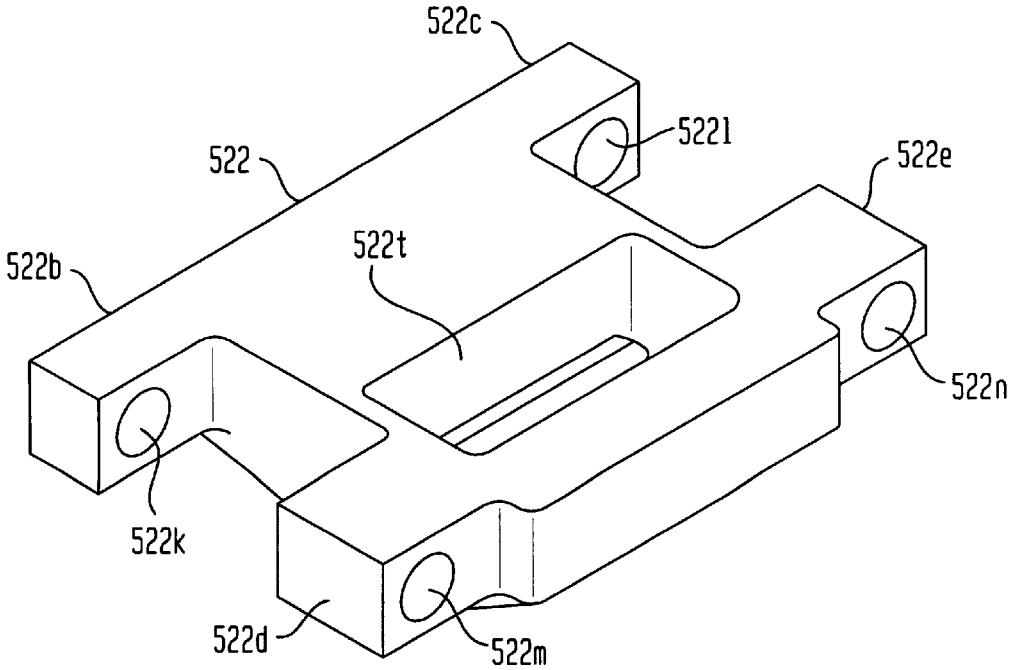
FIG. 34B is a simplified rear perspective view of the toggle slide.

A simplified perspective view of toggle slide plate 522 is also shown in FIGS. 34A and 34B. As discussed, the circuit breaker handle 103 of circuit breaker assembly 100 fits through toggle aperture 501*t* of adapter base 501 and into drive plate toggle aperture 522*t* of toggle drive plate 522. As shown in FIGS. 34A and 34B, toggle slide plate 522, which is molded from plastic, has left and right upper guide rod members 522*b* and 522 having guide rod apertures 522*k*, 522*l*, respectively, and further has left and right lower guide rod members 522*d* and 522*e* having guide rod apertures 522*m*, 522*n*, respectively. As can be seen, upper and lower left guide rod members 522*b* and 522*d* slide along left slide shaft 503*a*, while upper and lower guide rod members 522*c* and 522*e* slide along right slide shaft 503*b* so as to vertically move toggle handle 103 of the circuit breaker assembly 100 to its ON or OFF position.

Side views of the main subassembly 400 are shown in FIGS. 9 to 18. In particular, FIGS. 9 to 18 show the 44 first or front motor mount subassembly plate or upper gear housing 512 and the second or middle subassembly plate or 510 lower gear housing of the main subassembly 400. FIG. 14 shows the main internal housing or third subassembly mounting plate 511 of the main subassembly 400. As discussed, second or middle subassembly plate or lower gear housing 510 is attached, secured to or otherwise appropriately fastened to third or main subassembly mounting plate or upper gear housing 511 using five screws 591 and five lockwashers 596, which are inserted through middle plate subassembly fastening apertures 510*h*, 510*i*, 510*j*, 510*k* and 510*ii* and third or main plate subassembly fastening apertures 511*h*, 511*i*, 511*j*, 511*k* and 511*ii*.

Figure 11:
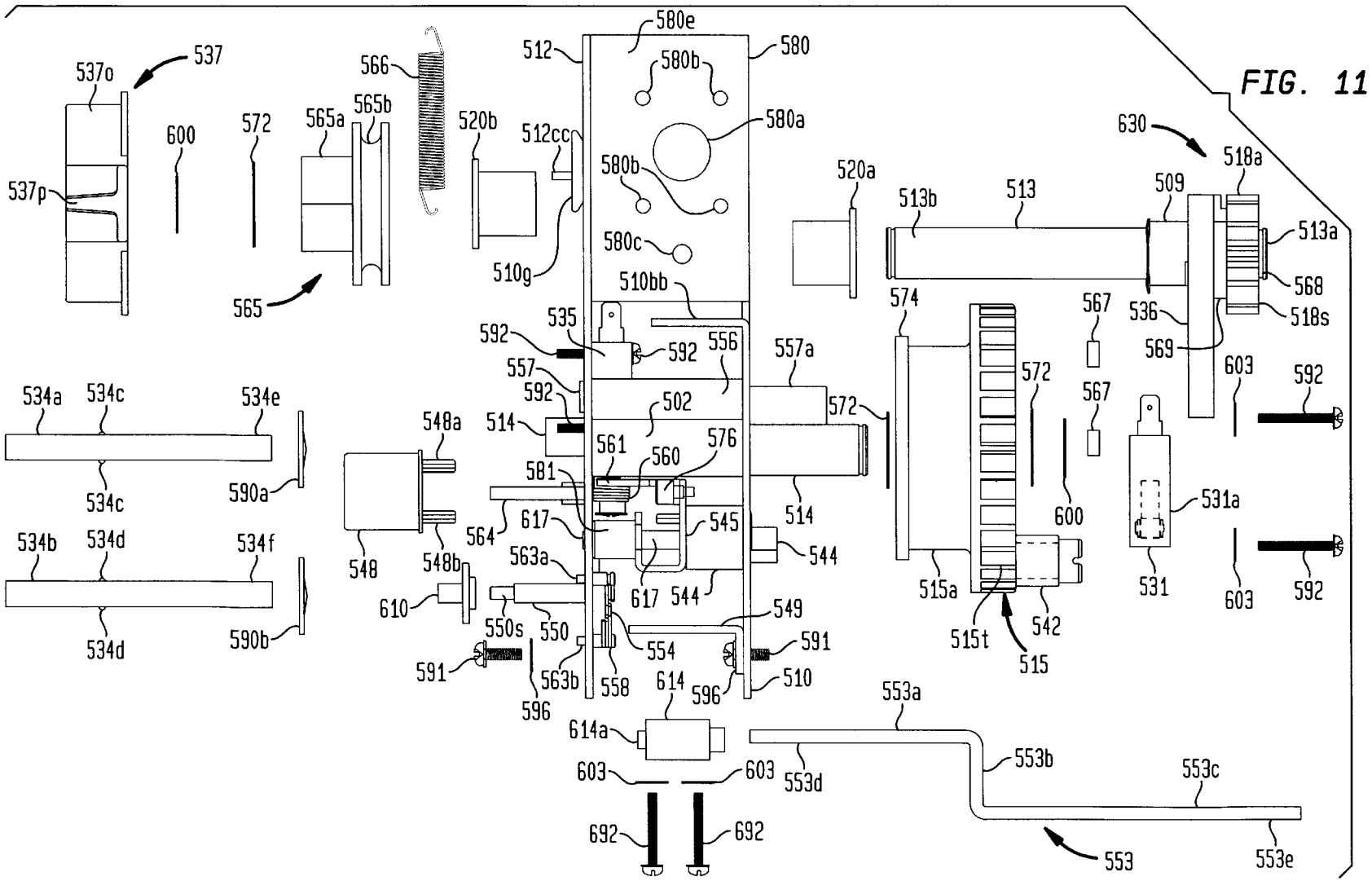
FIG. 11 is a side view of same components associated with the lower and upper gear housings of the motor operated stored energy assembly.
Figure 12:
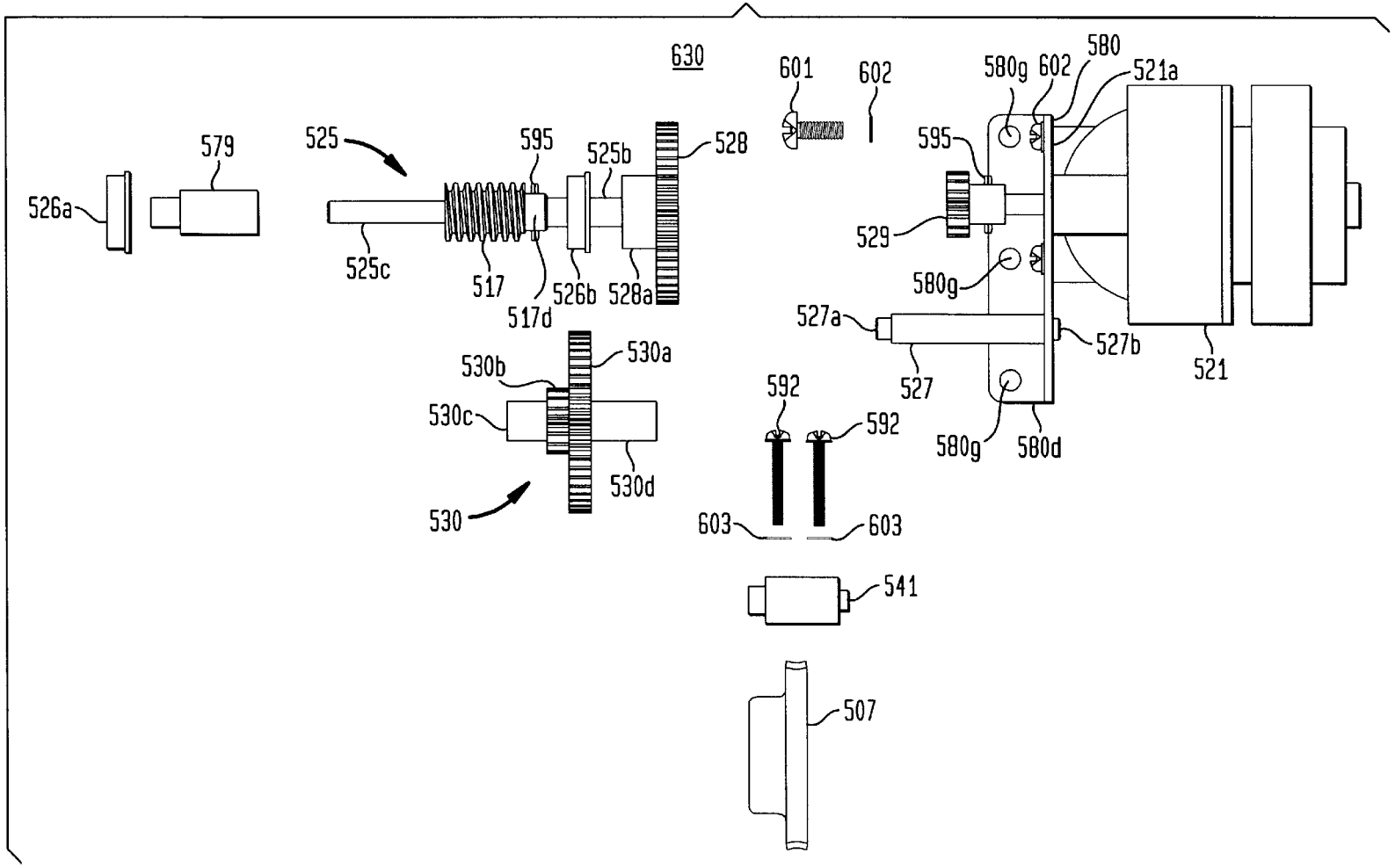
FIG. 12 is a side view of the motor assembly and related gearing assemblies of the motor operated stored energy assembly.
Figure 16:
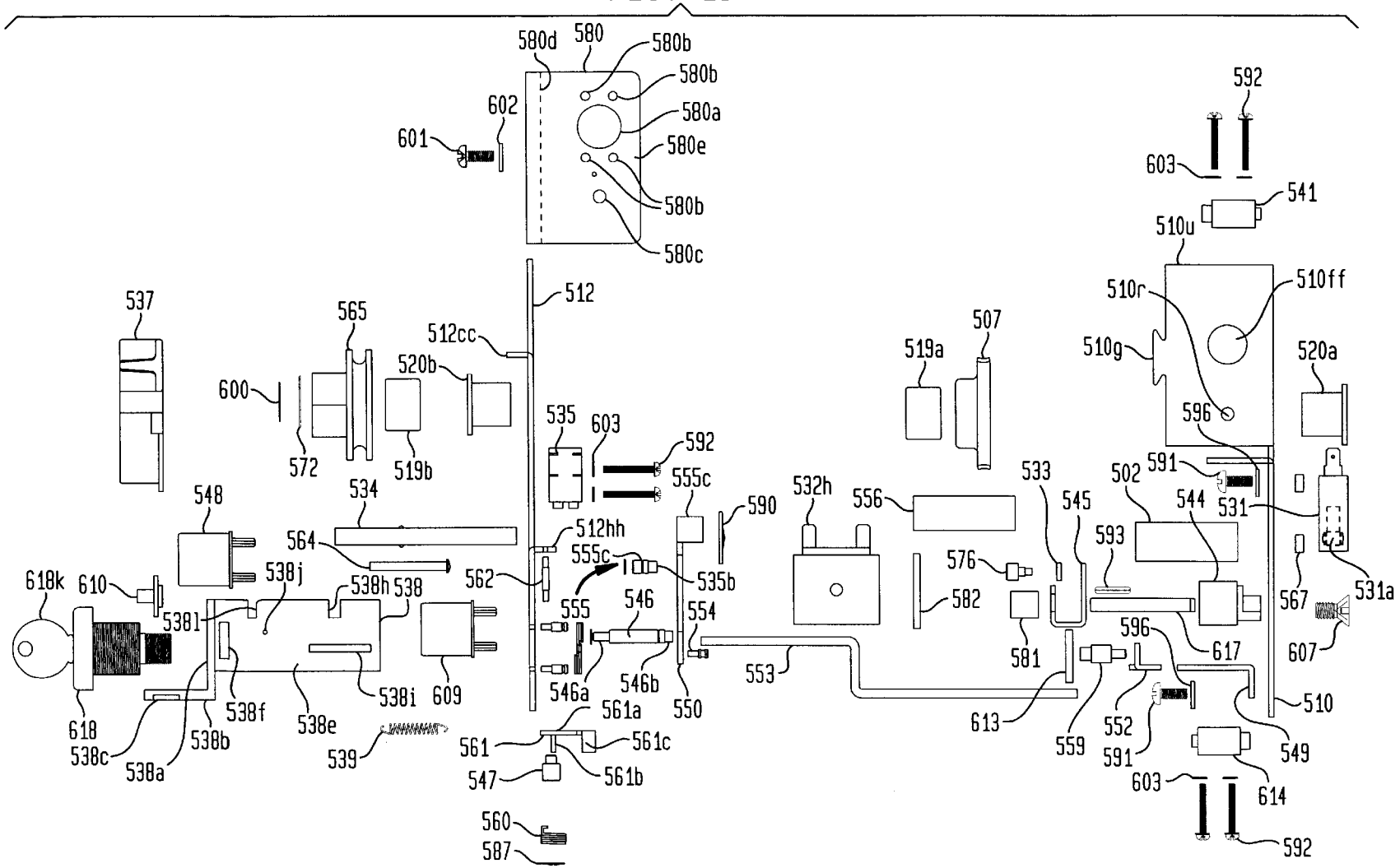
FIG. 16 is a side view of the upper and lower gear housings of the motor operated stored energy assembly, including the operator gearing and the operator handle and other associated components.
Figure 18:
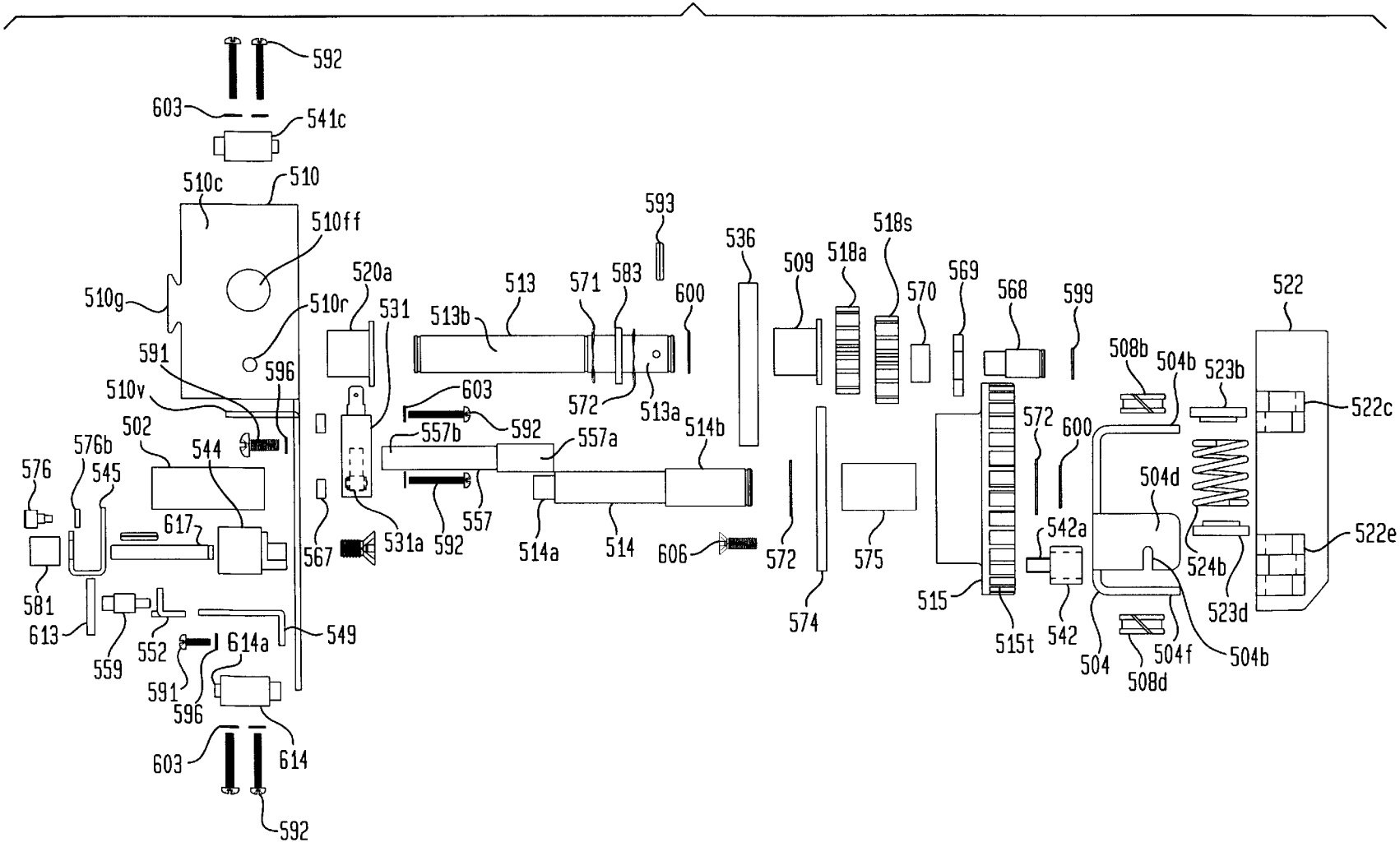
FIG. 18 is a side view of some components of the motor operated stored energy assembly, including the lower gear housing, main operator gear drive connector, slide plate and other associated components
Figure 19:
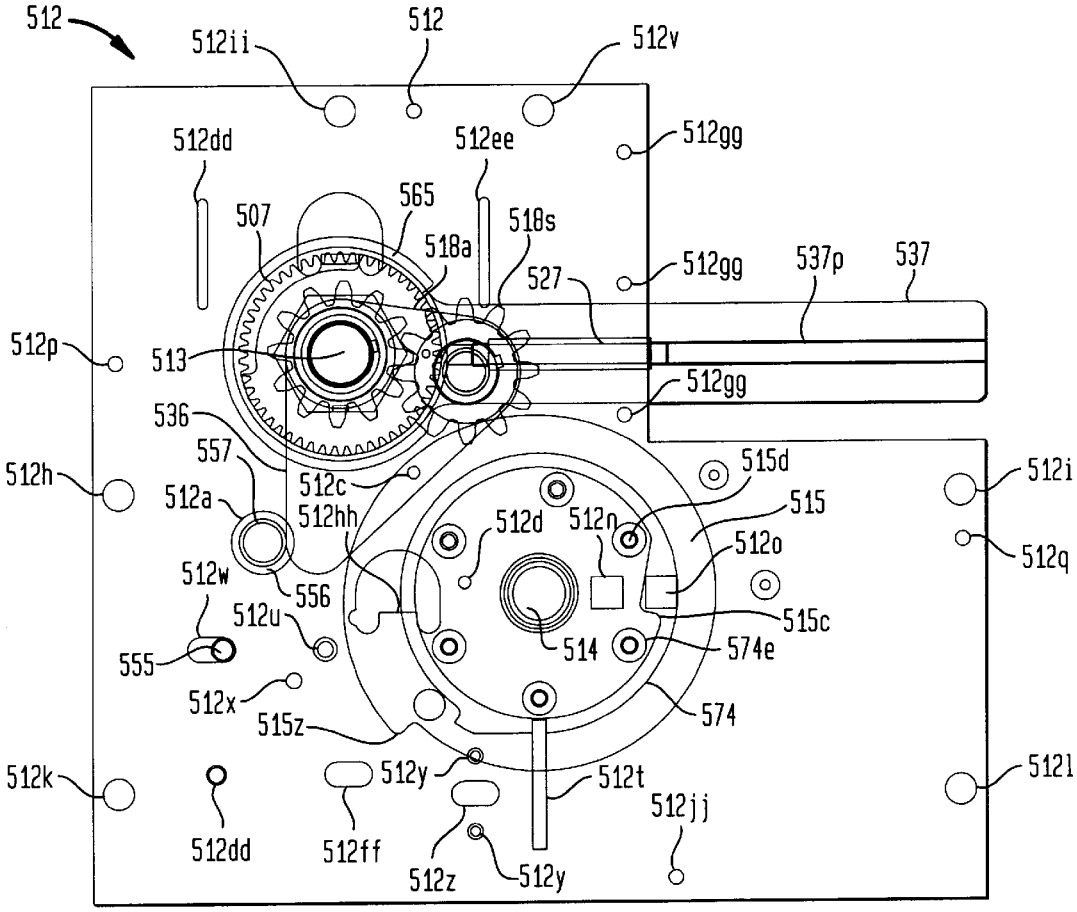
FIG. 19 is a front view of some components of the motor operated stored energy assembly, including the upper gear housing, main operator gear, gear carrier and operator handle.
Figure 20:
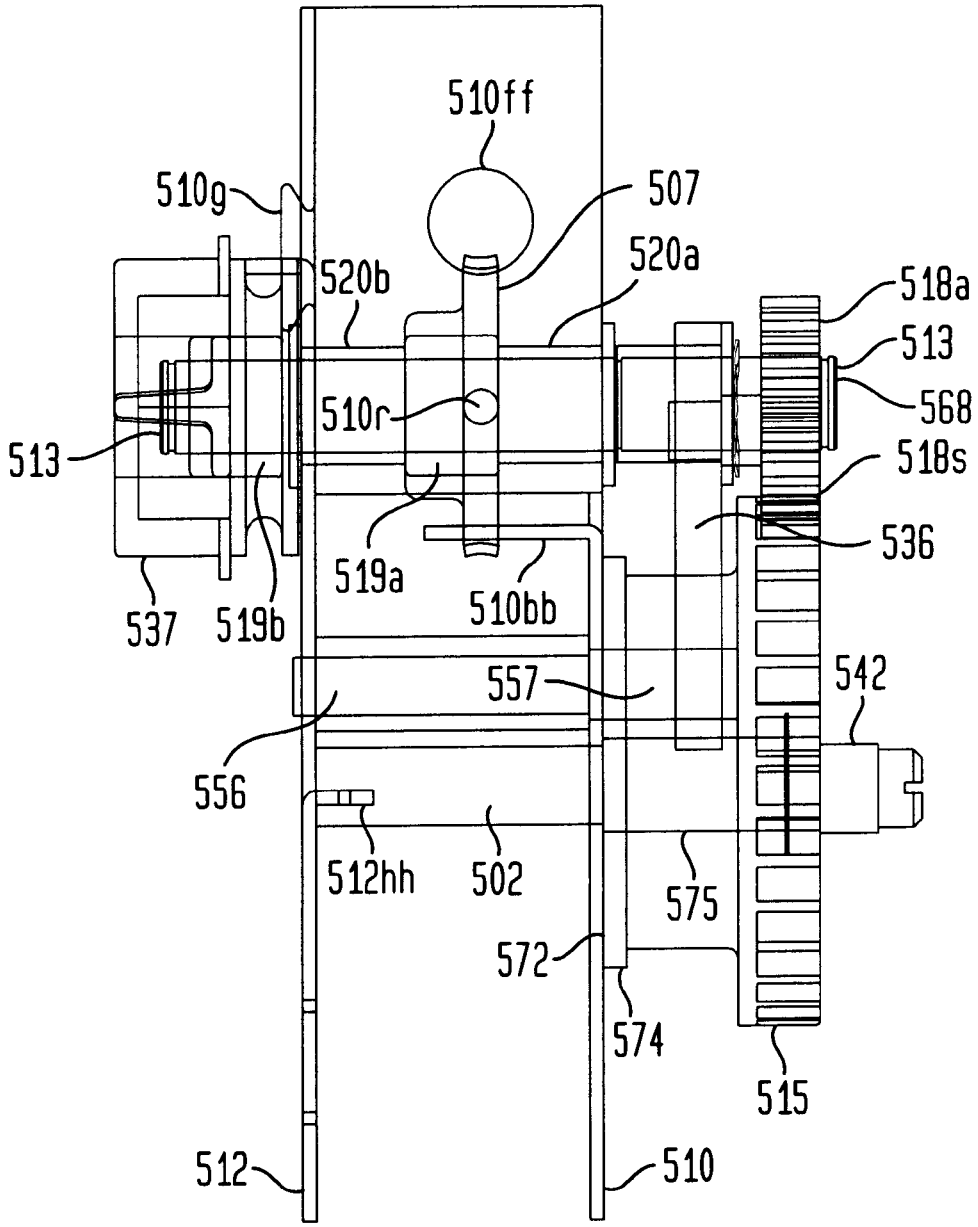
FIG. 20 is a side view of some components of the motor operated stored energy assembly, including the upper gear housing, main operator gear, gear carrier and operator handle.
Figure 21:
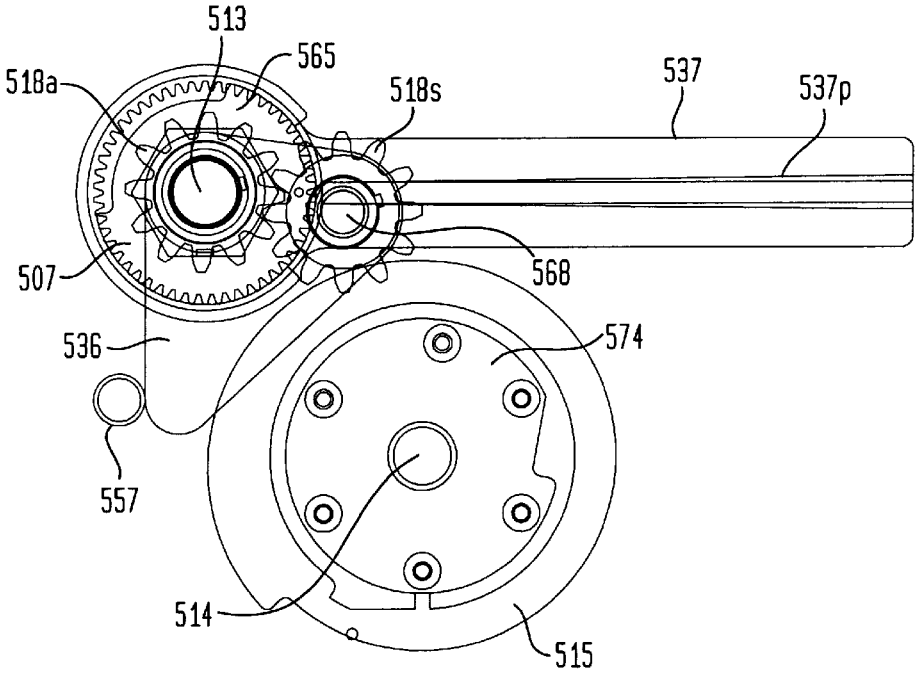
FIG. 21 is a front view of some components of the motor operated stored energy assembly, including the operator handle components and the main operator gear.
Figure 22A:
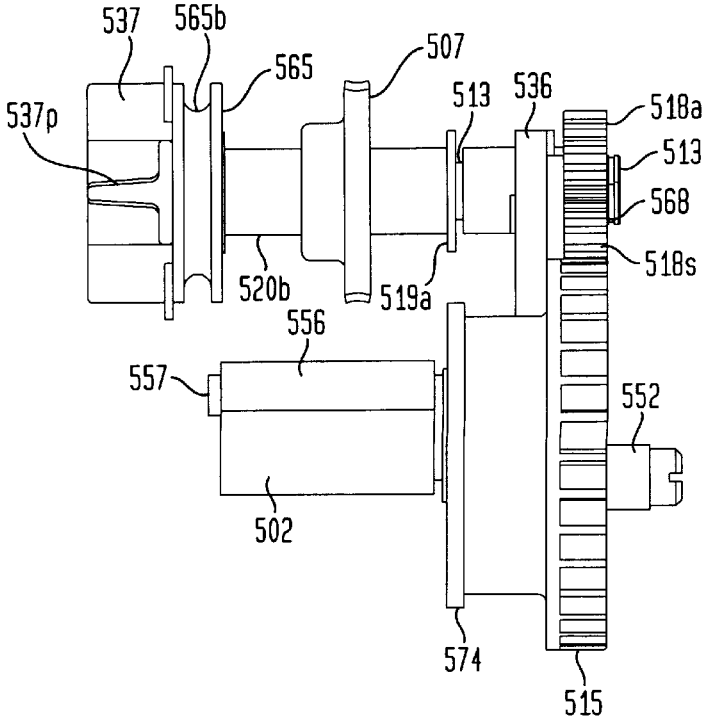
FIG. 22A is a solid side view of some components of the motor operated stored energy assembly, including the operator handle components and the main operator gear.
Figure 22B:
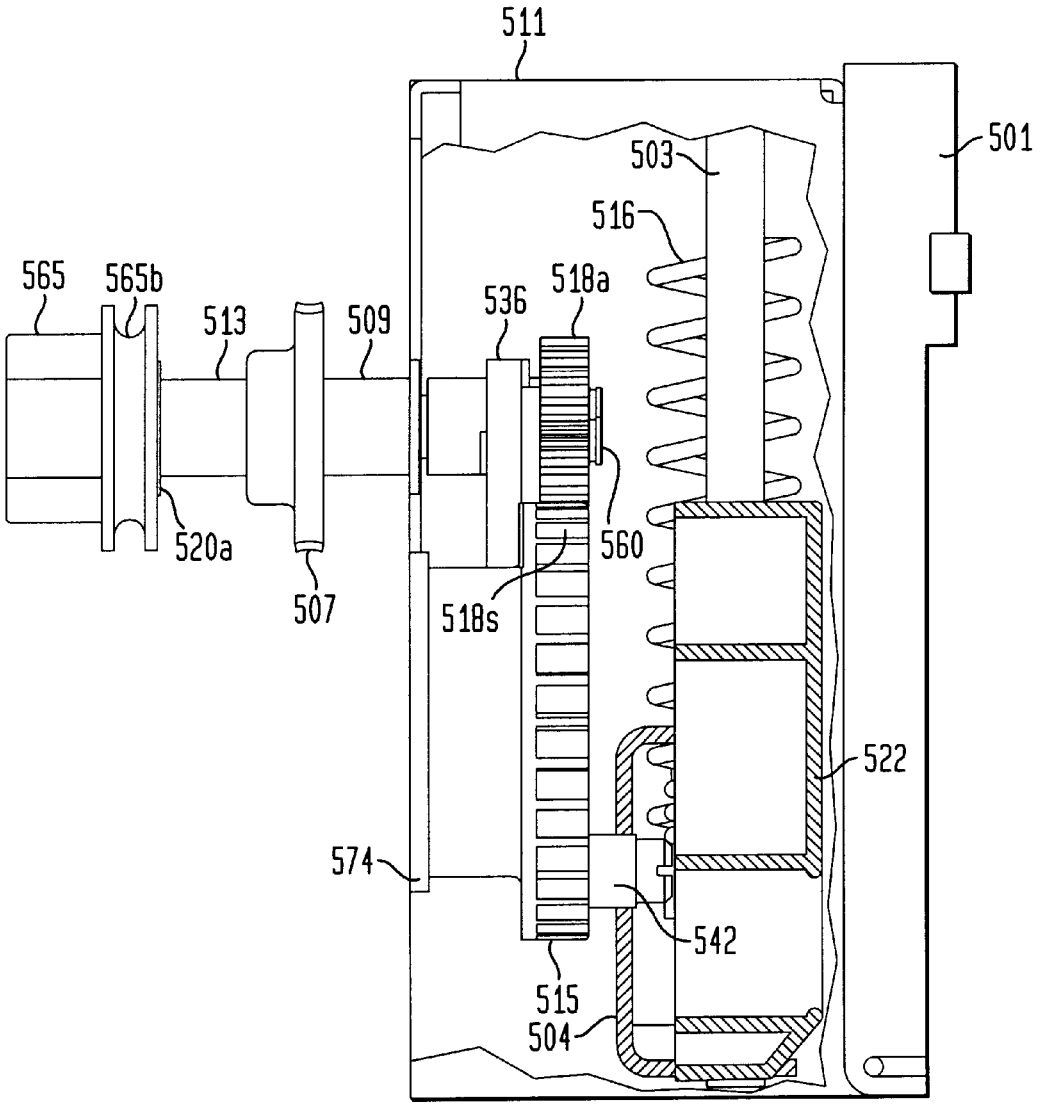
FIG. 22B is a solid side view of some components of the motor operated stored energy assembly, including the operator handle components and the main operator gear, as well as the main internal housing and the adapter plate.
Figure 23A:
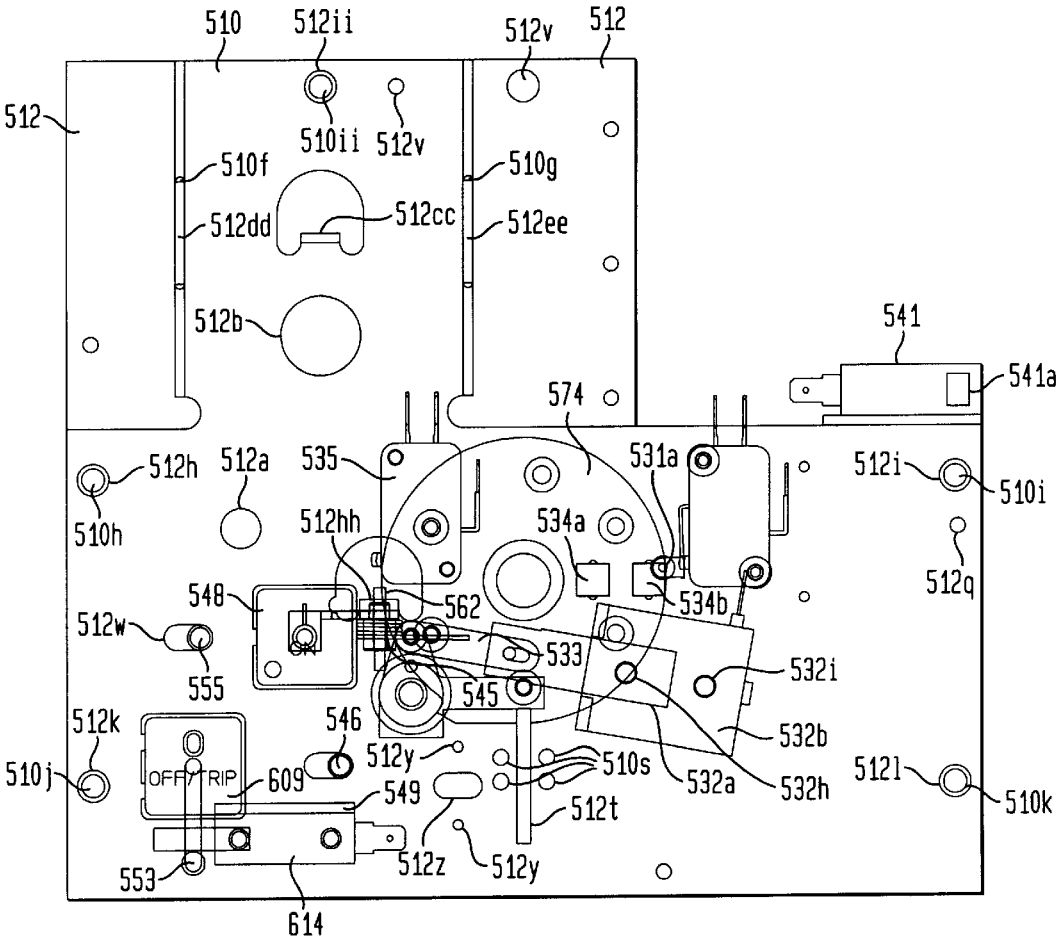
FIG. 23A is a front through view of some components of the motor operated stored energy assembly, including the upper and lower gear housings, latch plate, D-latch assembly, solenoid assembly and the OFF and ON switch buttons.
Figure 23B:
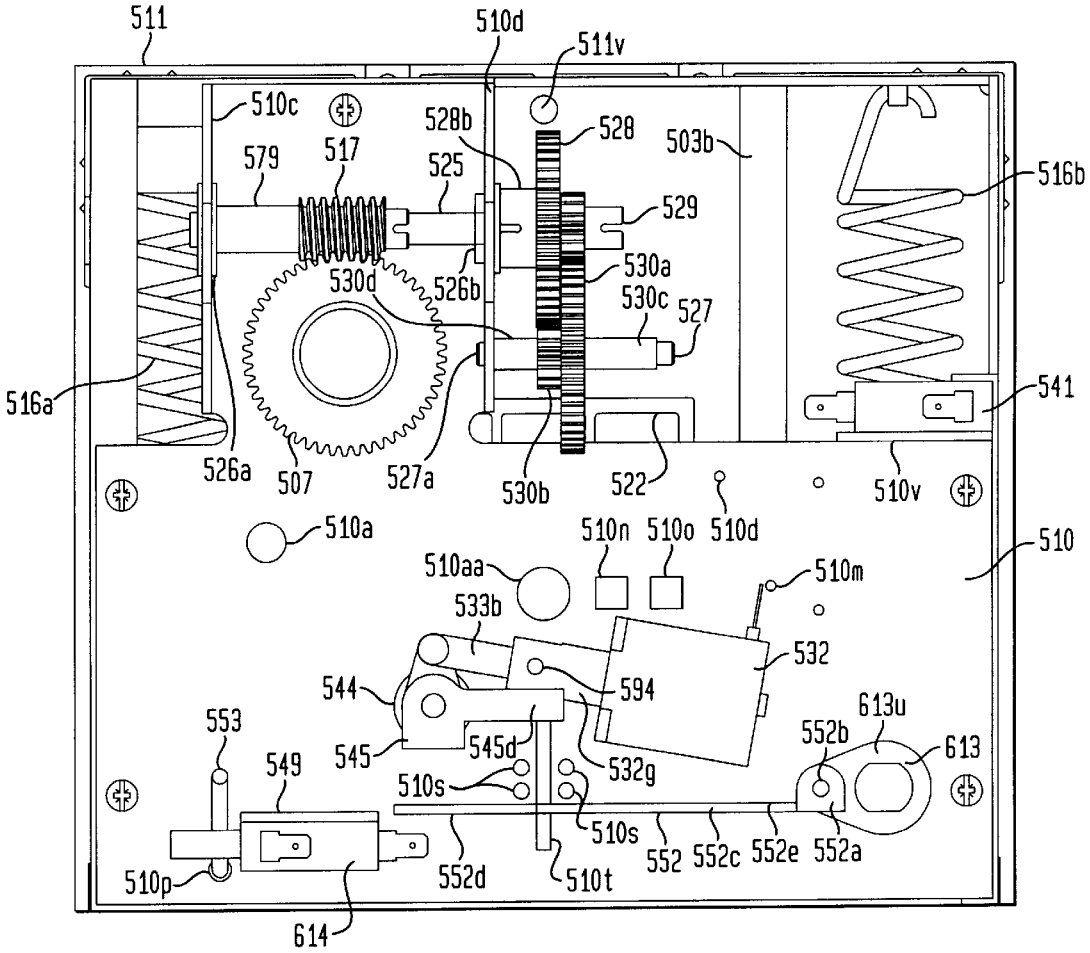
FIG. 23B is a front solid view of some components of the motor operated stored energy assembly, including the upper and lower gear housings, latch plate, D-latch assembly, solenoid assembly and the OFF and ON switch buttons.
Figure 23C:
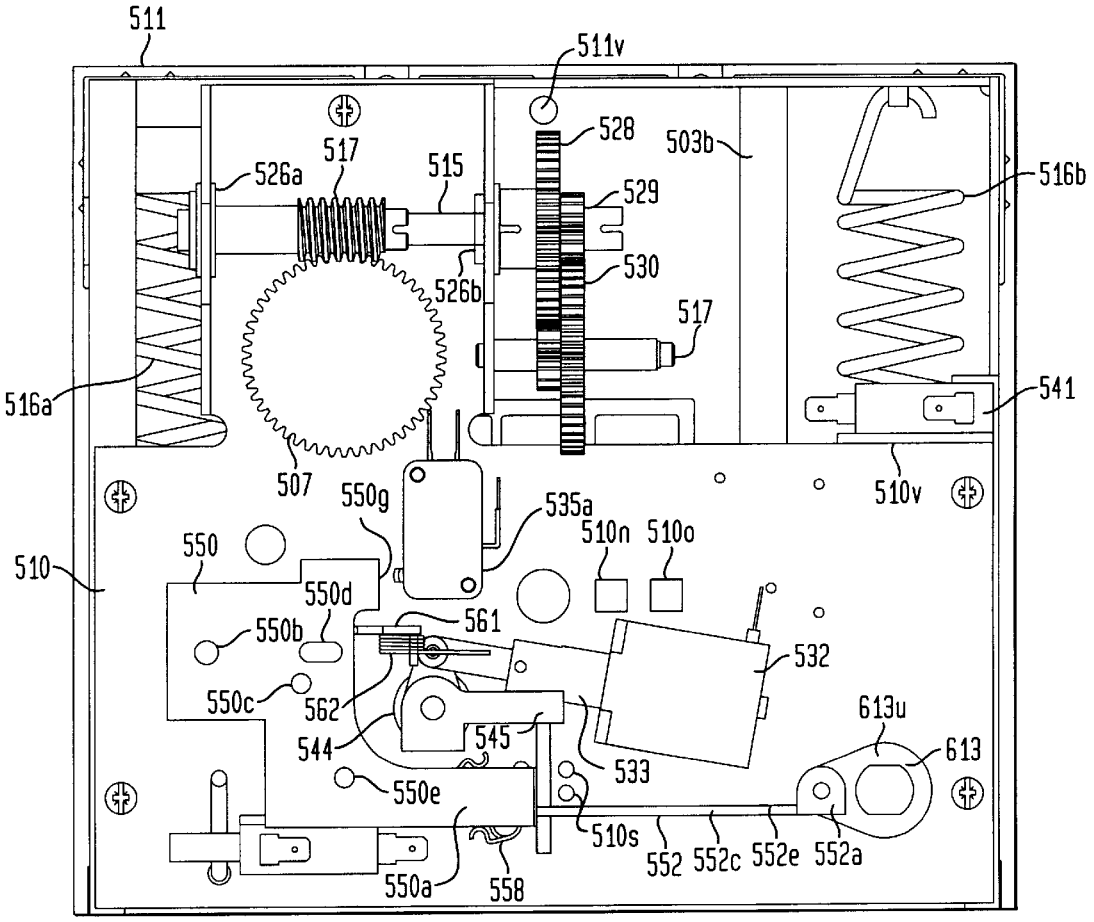
FIG. 23C is a front solid view of some components of the motor operated stored energy assembly, including the upper and lower gear housings, latch plate, D-latch assembly, solenoid assembly and the OFF and ON switch buttons, as well as the automated manual slide plate.
Figure 24:
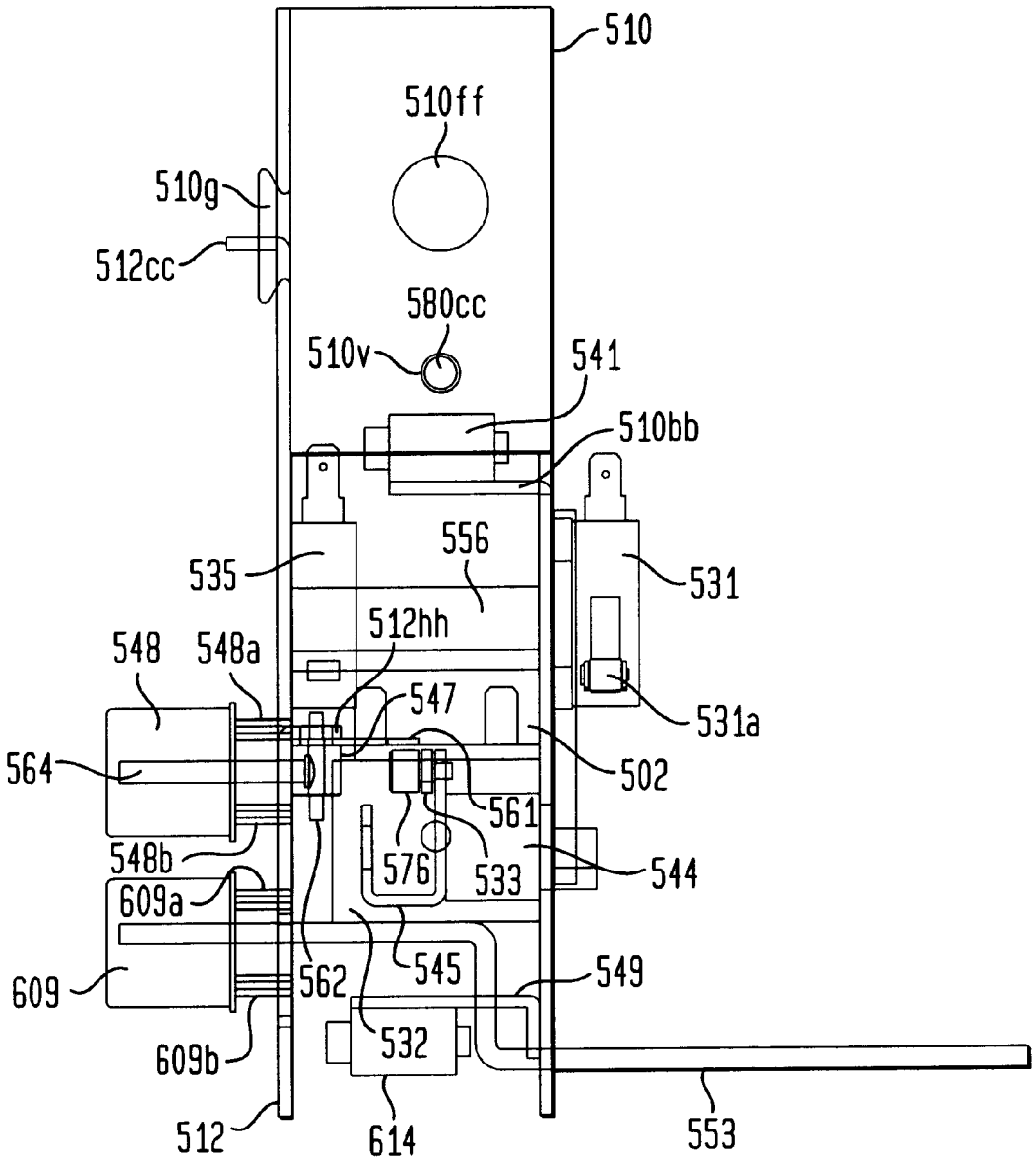
FIG. 24 is a side view of some components of the motor operated stored energy assembly, including the upper and lower gear housings, latch plate, D-latch assembly, solenoid assembly and the OFF and ON switch buttons.

Also shown in FIGS. 11, 16 and 18 is a side view of a charging handle/gear block pinion shaft 513, one end 513*b* of which fits a pinion shaft bearing 520*a* and which also has three grooves (not shown) to receive wave and circumferential backup washers 571 and 572 and backup washer 583. Another end 513*a* also fits pinion shaft bearing 520*c*. The washers 571, 572 and 583 are made of steel, but may also be made of any other suitably appropriate material. A pinion gear carrier 536 is retained between the pinion shaft bearing 520*c* positioned at one end portion 513*a* of the pinion shaft 513 and the washers 571, 572 and 583 and gear carrier retainer ring 600. Triangular shaped gear carrier block 536 has a pinion shaft aperture 536*a* so that it may fit onto or over the one end 513*a* of charging handle/pinion gear shaft 513, together with wave washer 571, backup washer 572, which also receives driver pinion gear 518*a*, fiber washer 583 and pinion shaft bearing 520*c*. As shown, charge carrier gear block 536 has an idler pinion gear aperture 536*s* for receiving idler pinion gear 518*s*, using idler gear bearing 570, idler gear roller 569 and idler gear shaft 568.

A gear carrier stop 557 having a larger diameter stop end 557*a* and a smaller diameter end 557*b* uses larger diameter stop end 557*a* to stop movement of tapered or triangular end 536*c* of gear carrier 536. The larger end 537*a* fits through gear carrier stop aperture 512*a* of upper gear housing 512 and gear carrier stop aperture 510*a* so that larger diameter stop end 557*b* extends towards the interior of main internal housing 511 so as to interfere with movement of the pinion gear carrier 536. In this way, it may stop or limit movement of the triangular end 536*c* of gear carrier 536.

Figure 17:
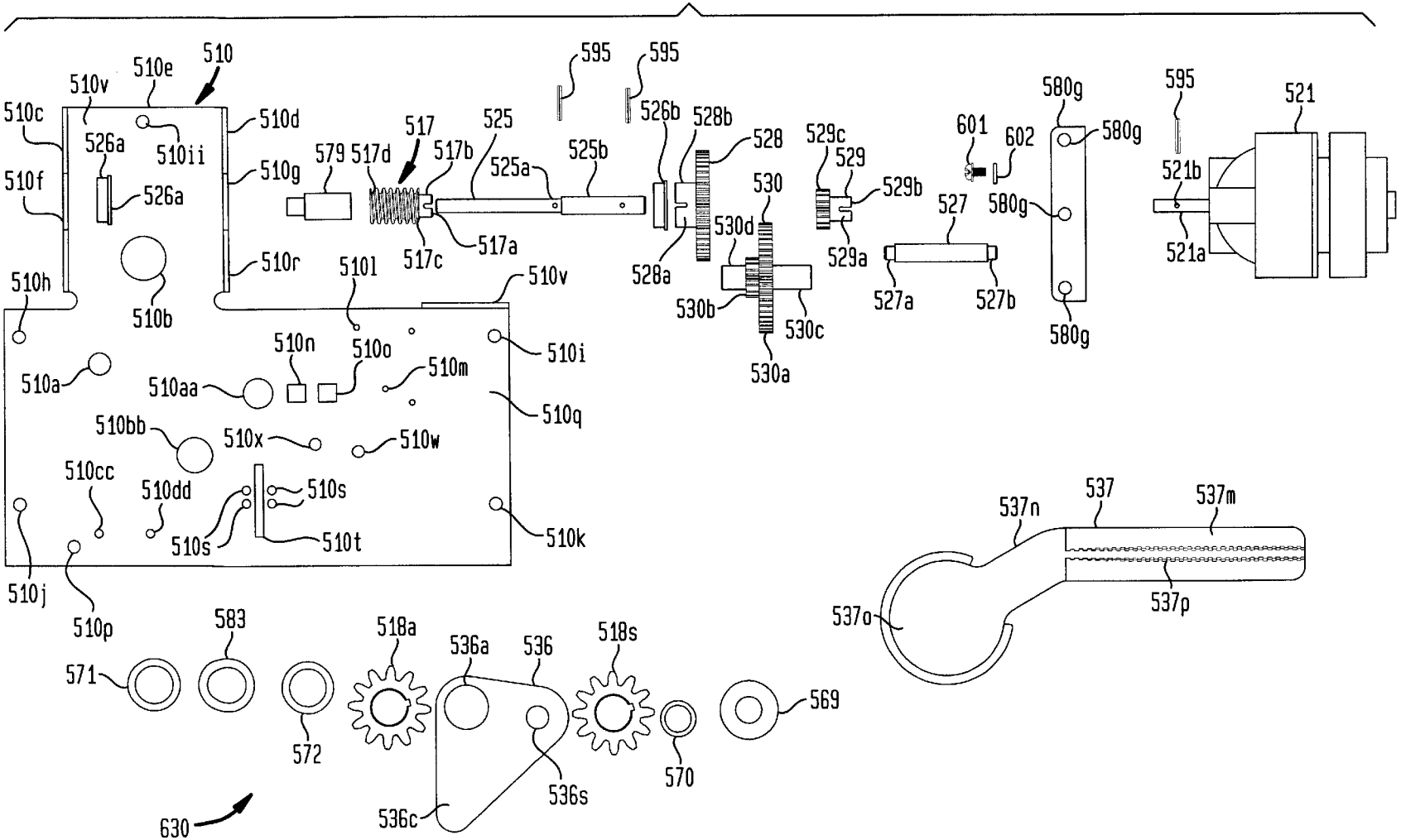
FIG. 17 is a front and side view of the motor operated stored energy assembly's electric motor and associated gearing, the gearing and operator handle and the lower gear housing.

As shown in FIGS. 16, 17 and 18, the pinion shaft 513, which is part of pinion gear assembly 630, which comprises pinion gear carrier 536 and pinion gears 518, fits into pinion shaft bearing 520*a*, which fits into pinion shaft aperture 510*b* of lower gear housing 510. The pinion shaft 513 also fits into worm gear 507 and unidirectional clutch 519*a*, both of which reside between the lower and upper gear housings 510 and 512. Additionally, pinion shaft 513 extends through pinion shaft aperture 512*b* of upper gear housing 512, as well as operator gear handle 537, retainer 600, backup washer 572, handle hub 565, unidirectional clutch 519*b* and pinion shaft bearing 520*b*, all of which at least partially sit outside the outer surface of upper gear housing 512. Handle hub 565 has a protruding hexagonal portion 565*a* on which operator handle 537 is easily mounted. Handle hub 565 also has a recessed portion 565*c* and a slotted portion 565*b*. The recessed portion 565*c* allows limited rotational movement with respect to upper gear housing flange 512*cc*.

With respect to the pinion shaft 513 and outer handle hub unidirectional clutch assembly 519*b* and inner gear carrier unidirectional clutch assembly 519*a*, if unidirectional clutch assembly 519*b* rotates, then unidirectional clutch 519*a* slips in one direction and the pinion gear assembly 507 does not rotate. Likewise, when electric motor 521 operates to rotate the worm gear 507 through worm 517, unidirectional clutch 519*b* slips in one direction so that operator handle 537 does not move or rotate, but the worm gear 507 rotates so as to rotate the pinion gear carrier assembly 630. Both unidirectional clutches 519*a* and 519*b* are oriented in the same way or direction so that they slip unidirectionally in the same direction.

As discussed, cam operated roller arm limit switch 531*a* operates as operator gear cam surface 515*c* rotates on operator gear shaft 514. In particular, when the roller arm switch 531*a* is up as it traverses upper roller arm surface 515*a*, the switch 531 is on, and when the roller switch 531*a* is down as it traverses the operator gear cam surface 515*c*, the switch 531 is off. The cam operated limit switch 531 is mounted on the inside surface of lower gear housing 510 in cam operated limit switch mounting apertures 511*l* and 510*m* using motor switch spacers 567, two flat screws 592 and two lockwashers 603.

Operator gear 515 receives operator gear bushing 575 for mounting on operator gear shaft 514. Additionally, latch plate 574 is mounted to the smaller diameter operator gear face 515*b* using back-up washer 572, retainer 600 and six flat screws 606 and six latch plate mounting apertures 515*d* and six latch plate apertures 574*d*. Also, cam follower 542 is mounted using mounting post 542*a* and washer 588 in a cam follower mounting aperture (not shown) on the inner face of operator gear 515. The cam follower 542 rotates with operator gear 515 and moves laterally through slotted cam follower aperture or guide 504*m* of drive connector 504 so as to move the drive connector 504 and the toggle slide 522 vertically so as to allow charging or discharging of the main springs 516.

As is shown in FIGS. 10, 14, 18 and 30, the main subassembly 400 comprises a third or main internal subassembly plate or housing 511, first and second charging springs 516*a* and 516*b*, respectively, toggle slide shafts 503*a* and 503*b*, toggle slide 522, drive connector plate 504 and overtoggle springs 523*a* and 523*b*. In particular, the main internal housing 511 comprises an upper support flange 51*e* having upper mounting flange 511, a lower support flange 511*f* having lower mounting flange 511*p* and first and second side support flanges 511*c* and 511*d*, each having side mounting flanges 511*o* and 511*q*, respectively, a lower center circuit breaker toggle handle aperture or opening 511*t*.

As shown in FIGS. 8, 9, 11, 16, 23 and 24, trip rod 553 has an OFF button end 553*d*, a trip end 553*e* and a step bend 553*b*. Referring to the referenced Figures, when OFF/TRIP button 609 is depressed it actuates trip rod 553 by contacting OFF button end 553*d* of short upper trip rod member 553, which is integrally associated with OFF/TRIP end 553*e* and corresponding long lower trip rod member 553*c* by integrally associated perpendicular connecting member 553*b*, which contacts or is otherwise associated with an OFF/TRIP actuation structure (not shown) on the circuit breaker assembly 100 so as to set the circuit breaker assembly 100 to its OFF or tripped position. In particular, button end 553*a* passes through aperture 512*d* of the upper gear housing 512, while trip end 553*b* passes through aperture 510*e* of the lever gear housing an aperture 511*t* of the housing 511.

As is further shown in FIGS. 1, 2, 8, 9, 11, 17, 19 and 20, the main subassembly 400 comprises the operator reset/charging handle 537, which may be manually rotated or ratcheted clockwise approximately 90 degrees from main external housing surface 534*p* to surface 543*m*, and is then returned by handle return spring 566, which sits in spring slot 565*b* of handle hub 565. Also, roll pin 595 fits in roll pin aperture 565*d* of handle hub 565 to provide an attachment point for handle return spring 566. The handle rotation action drives a pinion gear carrier block shaft 513 through associated overrunning unidirectional clutch 519*b* so as to rotate pinion gear carrier block 536 clockwise about pivot point or shaft aperture 536*a* until a tapered or triangular end 536*c* meets and is stopped by a pinion gear carrier block stop 557 mounted in lower and upper housing 510 and 512. If the stored energy main springs 516*a* and 516*b* are not fully charged, the gear carrier block 536 carries or moves driver/pinion gear 518*s* and idler/pinion gear 518*a* into contact with the main charging operator gear 515.

When actuated, the pinion gears 518 rotate the main charging operator gear 515 clockwise so as to move cyclically and clockwise the pin cam follower 542 within a pin or cam follower aperture 504*m* on the drive connector plate 504 so as to charge the springs 516.

Figure 15:
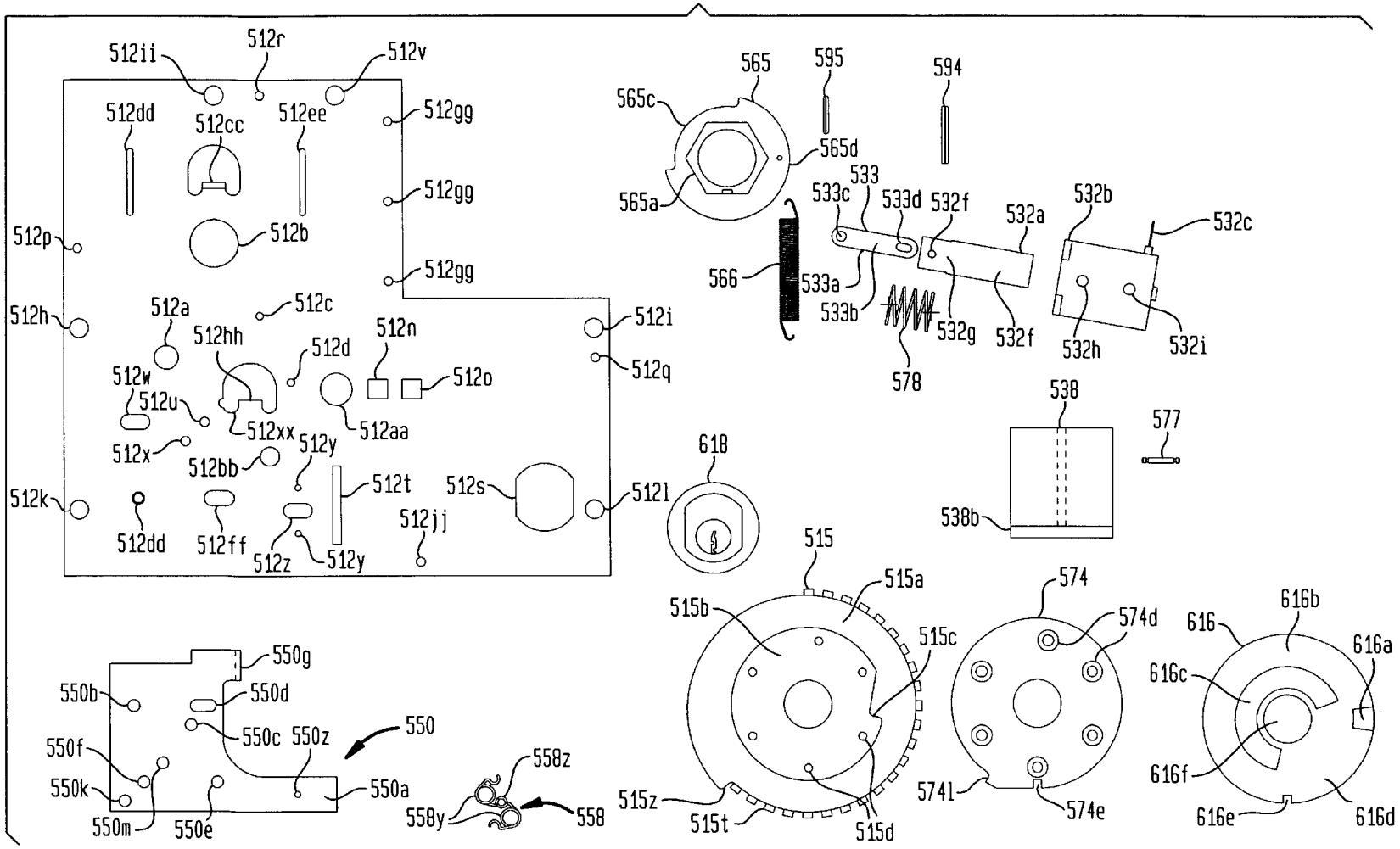
FIG. 15 is a front view of the main operator gear, the hasp and cylinder lock assemblies, the solenoid, the operator handle hub and the upper gear housing of the motor operated stored energy assembly.

As shown in FIG. 15, the main charging operator gear 515 only has missing gear teeth 515*t* through in the order of about more than one-half of its circumference so that the idler/pinion gear 518*a* cooperating with the driver/pinion gear 518*s* only drives, moves or rotates the pin or cam follower 542 on the order of about a few degrees past a position that is top dead center. In particular, teeth 515*t* on the main charging operator gear 515 only cover on the order of about one-half of the operator gear circumference. In the specific embodiment, the operator gear 515 comprises twenty adjacent or contiguous operator gear teeth that fit in a thirty-two gear tooth pattern. That is, twelve gear teeth are missing from the thirty-two gear tooth pattern so that on the order of about sixty-two and one-half percent (62.5%) of the operator gear 515 has operator gear teeth so that there is almost a thirty-two and one-half percent (32.5%) a gap. Also, further rotating the manual reset/charging handle 537 rotates the pinion gear carrier block 536 no more than the driver/pinion gear 518*s*. To indicate that the charging action is complete, the force required to operate the manual operator reset/charging handle 537 is noticeably reduced. When the main charging gear 515 has been driven as far as possible by the driver/pinion gear 518*s*, the force of the main charging springs 516*a* and 516*b* causes the main charging gear 515 to continue to rotate until its rotation is stopped by the D-shaped cylindrical latch assembly 640. By moving in pin cam follower aperture 504*m* on the drive connector plate 504, the cyclic motion of the pin cam follower 542 causes the drive connector plate 504 and the slide plate 522 to move linearly as guided by the guide or toggle slide shafts 503*a* and 503*b*. The linear motion of the drive connector plate 504 moves the circuit breaker toggle handle 103 so as to open the main contacts (not shown) of the circuit breaker assembly 100, thereby driving the motor operated stored energy circuit breaker assembly 200 into its reset and ready to close position. The linear motion of the drive connector plate 504 and the slide plate 522 also stretches or charges the operating springs 516*a* and 516*b* which are secured between the drive connector plate 504 and the main internal housing 511, as previously discussed. In this way, the energy stored in the operating springs 516*a* and 516*b* may later be used to quickly close the main contacts of the circuit breaker assembly 100.

As is shown in FIGS. 2, 8, 9, 11, 12 and 15 to 22, 28A and 28B, the second or middle subassembly or lower gear housing 510 has a worm gear shaft receiving section 510*u*, which further comprises first and second worm gear shaft flanges 510*c* and 510*d*. The first and second worm gear shaft flanges 510*c* and 510*d* respectively have worm gear shaft apertures 510*ee* and 510*ff* in their midsection. Also, the second or right worm gear shaft flange 510*d* also has a cluster gear mounting aperture 510*r* for receiving a first or left mounting end 527*a* of motor standoff shaft 527, which is used to support cluster gear 530 of a reduction gear assembly 630 which comprises final reduction gear 528, motor gear 529 and cluster gear 530. Similarly, motor mounting plate 580 has a cluster gear mounting aperture 580*c* (on motor mounting surface 580*e*) for receiving a second or right mounting end 527*b* of motor standoff shaft 527, which is also used to support cluster gear 530.

In particular, and as is shown in FIGS. 2, 6 to 12, 16 to 18 and 26 to 28, electric motor 521 drives motor shaft 521*a*, which receives and drives motor gear 529. Motor gear 529 drives first larger diameter cluster gear 530*a*, which further drives associated second cluster gear 530*b*, which drives first and second smaller diameter cluster gears 530*a* and 530*b*, both of which are mounted on cluster gear motor standoff shaft 527. A first or left end 527*a* of cluster gear motor standoff shaft 527 is movably or rotateably mounted in middle or second or lower gear housing 510 at cluster gear drive motor standoff shaft aperture 510*r* and a second or right end 527*b* of cluster gear motor standoff shaft 527 is movably or rotateably mounted in front or upper gear housing 512 at cluster gear motor standoff shaft aperture 580*c*. Smaller diameter cluster gear 530*b* drives final reduction gear 528 and corresponding worm gear drive shaft 525 and worm 517, which drives worm gear 507, using flange bearings 526, which are mounted at aperture 510*ee* and 510*ff* of worm gear shaft flanges 510*c* and 510*d*. Worm shaft 525 receives worm 517. Another or left worm end 517*a* of worm 517 is movably mounted using worm gear spacer 579 and flange bearing 526*a*.

In particular, worm gear shaft 525 has two securing apertures 525*a* and 525*b*, each of which receive securing roll pins 595 so that each end of each of the securing roll pins 595 protrudes outwardly from each end of the work shaft securing apertures 525*a* and 525*b* and fit into worm gear apertures 517*a* and 517*b* and final reduction gear apertures 528*a* and 528*b*, which is directly opposite final reduction gear aperture 528*a*, respectively. Similarly, motor shaft 521*a* has securing aperture 521*b*, which receives securing roll pin 595 so that each end of the securing roll pin 595 protrudes outwardly from each end of the motor shaft securing aperture 521*b* so as to fit in motor gear apertures 529*a* and 529*b*.

Button switch 541*c*, which is mounted in lower gear housing 510 as button switch mounting flange 510*bb* using two screws 592 and two lockwashers 603, is used to detect when the main housing 543 has been opened. Also, straight lever switch 614 is mounted on straight lever switch bracket 549 using two screws 592 and two lockwashers 603 is operated by trip rod 553 as shown in FIGS. 6 and 7. Switch bracket 549 is mounted on the lower front surface of lower gear housing 510 using two screws 591 and two lockwashers 596. Worm gear housing member 510*u* also has first or left flange 510*c* and second or right flange 510*d* each having fastening flanges 510*f* and 510*q*, respectively, which are insertedly fitted into fastening flange apertures 512*dd* and 512*ee*, respectively, of upper gear housing 512 so as to facilitate assembly of the lower gear housing 510 and the upper gear housing 512.

Additionally, the second or right side of lower housing 510 has two indicator light pipe rear apertures 510*n* and 510*o* and upper gear housing 512 has two indicator light 4 pipe front apertures 512*n* and 512*o*, where apertures 510*n* and 512*n* and apertures 510*o* and 512*o* are aligned with one another, respectively. The light pipe apertures are designed to receive and support two indicator light pipes 534*a* and 534*b*. The indicator light pipes 534*a* and 534*b* indicate OFF/CHARGED and ON/DISCHARGED, respectively.

An indicator plate or wheel 616, which is mountedly aligned with latch plate 574 and operator gear 515, is used to provide the indicator status of indicator light pipe 534*a* (ON/DISCHARGED) and 534*b* (OFF/CHARGED.

Also, latch plate hasp aperture 574*e* of latch plate 574 is aligned with indicator wheel hasp aperture 616*e* of indicator wheel 616. With respect to the indicator wheel structure, it comprises mounting aperture 616*f*, inner ON/DISCHARGED ring 616*c* (white) and 616*d* (black) and outer OFF/CHARGED ring 616*a* (white) and 616*b* (black). Thus, as the latch plate 574 and indicator wheel 616 rotate together with operator gear 515, when the black ON/DISCHARGED ring 616*d* is positioned behind light indicator pipe 534*a*, the circuit breaker assembly is ON and the main springs 516 are discharged, and when the black OFF/CHARGED ring 616*b* is positioned behind light indicator pipe 534*b*, the circuit breaker assembly is OFF and the main springs 516 are charged. An optical indicator for an enclosed operating mechanism is shown in U.S. Pat. No. 3,916,133.

Lockout limit switch 541*a*, which is actuated by manual/auto lockout slide 550, is mounted, using any appropriate fastening or mounting apparatus, such as two screws 592 and two lockwashers 603, on an inside surface of upper gear housing 512 using apertures 512*c* and 512*d*. Limit button switch 541*a* and limit switch 614 are also shown and described in FIGS. 6 and 7.

Figure 13:
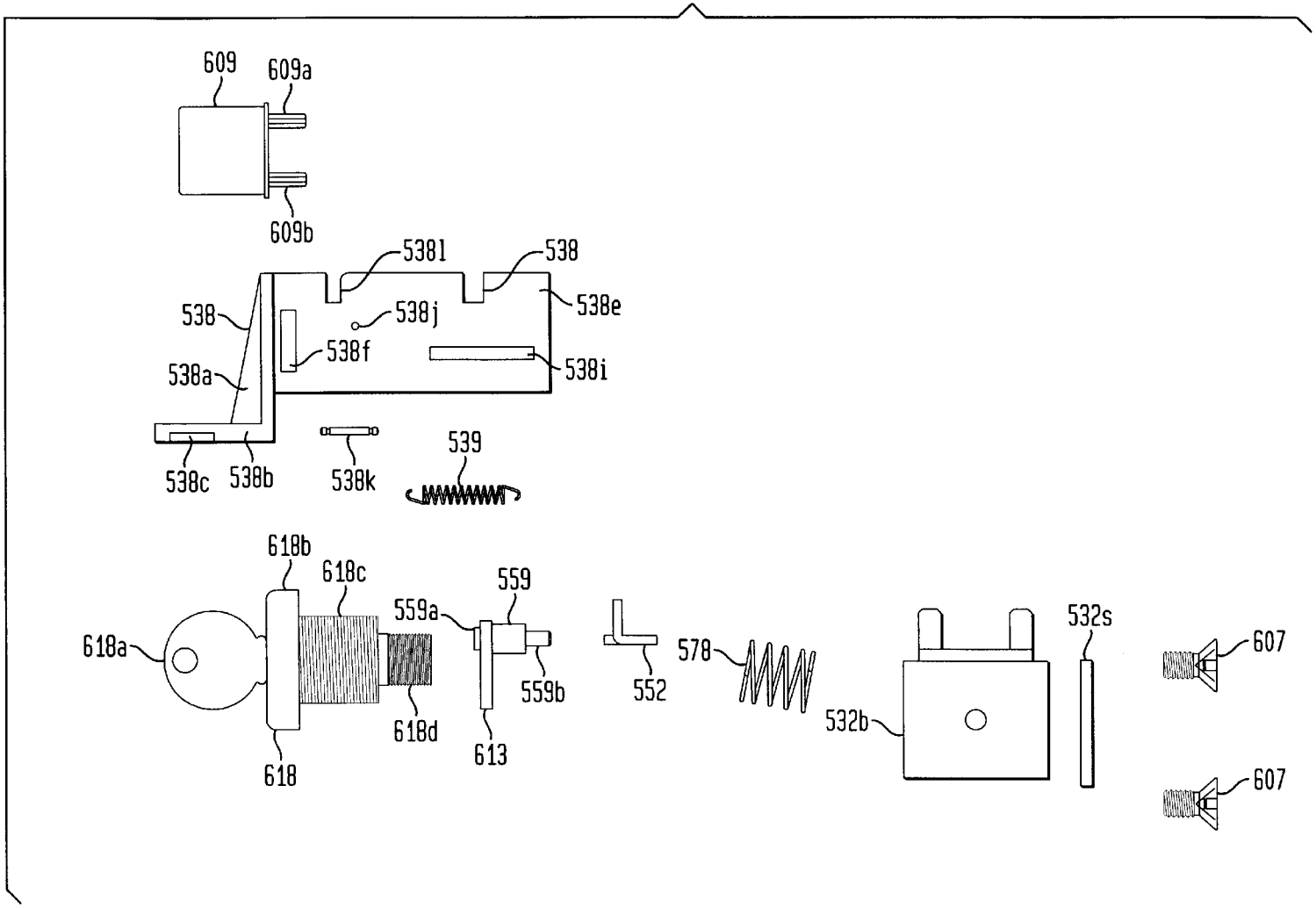
FIG. 13 is a side view of the hasp assembly, cylinder lock assembly, solenoid assembly and OFF switch button.

As shown in FIGS. 1, 2, 13, 15 and 16, a cylinder lock 618 is mounted in the main external housing 543 using recessed cylinder lock aperture 5431. Also, middle cylinder lock member 618*c*, which receives key 618*a*, is insertedly fitted through cylinder lock aperture 512*s* of upper gear housing 512 and secured using cylinder lock arm 613, which is threadedly secured on rear cylinder lock member 618*d*, while lock base 618*b* rests inside external housing cylinder lock aperture 5431. In particular, as shown in FIGS. 8 and 13, cylinder lock arm 613 has a tapered end 613*u* having a lock arm pin aperture 618*v*, which receives an end 559*a* of lock arm pin 559. Another end 559*b* of lock arm pin 559 is insertedly fitted in lifter aperture 552*b* of vertical lifter mounting member 552*a* of lifter 552. Also, lifter 552 has a horizontal lifter member 552*c*, whose surface is perpendicularly oriented with respect to vertical lifter mounting member 552*a*. Additionally, horizontal lifter member 552*c* has a wider left end 552*d* which tapers to a narrower right end 552*e*, which is integrally formed with vertical lifter mounting member 552*a*. Horizontal lifter member 552*c* is insertedly fitted through horizontal lifter aperture 538*i* of locking hasp member 538*e* of locking hasp 538. Thus, when a user turns a key 618*a* so as to rotate clockwise cylinder lock arm 613 from its left oriented horizontal position to a perpendicularly oriented position, the cylinder lock arm 613 rotateably moves lifter 552 upwardly so that horizontal lifter member 552*c* slides upwardly and transversely from left to right thereby lifting locking hasp member 538*e* of locking hasp assembly 538 to a locking position with respect to latch plate 574.

As further regards locking hasp 538, it comprises horizontal locking member 538*b* which is perpendicularly oriented with respect to vertical member 538*a*, as well as locking hasp securing member 538*e*, all of which are integrally formed together. Horizontal locking member 538*b* of locking hasp assembly 538 has a locking hasp aperture 538*c* for receiving a locking hasp (not shown) so as to resist unauthorized or inadvertent tampering with the circuit breaker assembly. Lockout slide 550 has a locking end 550*a* that slides into vertical lockout slide aperture 538*f* of locking hasp securing member 538*e* when a user slides the lockout slide 550 from its manual (unlocked to allow manual use) position to its automatic (locked to prevent manual use) position. Finally, hasp springs 539*a* and 539*b* are secured on each side of locking hasp member using hasp spring pin 538*r*, which fits in hasp spring pin aperture 538*j* and which projects from both sides of locking hasp securing member 538*e*. The other ends of hasp springs 539*a* and 539*b* are secured to hasp spring apertures 510*s* on lower gear housing 510.

As shown in FIGS. 6 to 9, 11, 16, 18 and 24, also mounted at the base of lower gear housing 510 is straight lever switch 614, which is mounted using a straight lever switch bracket 549 and two pozidrive screws 592 and two lockwashers 103 at straight lever switch mounting apertures 510*cc* and 510*dd*. The button switch 614*a* of straight lever switch 614 is positioned adjacent to the vertical member 553*b* of trip rod 553. When activated, the OFF/TRIP button 609 forces trip rod 553 forward so as to cause trip rod member 553*c* to actuate a trip button (FIG. 24) on the circuit breaker assembly 100, and vertical member 553*b* actuates straight lever switch 614 so as to cause the electric motor 521 to drive the circuit breaker assembly to its OFF position, as shown in FIGS. 6 and 7. To avoid actuating the trip button, a screw or other suitably appropriate limit apparatus (not shown) may be mounted adjacent that vertical trip rod member 553*b* and the button switch 614*a* of straight lever switch 614 so as to limit movement of the trip rod 553 so as to allow actuation of the local OFF operation using electric motor 521 but prevent tripping of the circuit breaker assembly 100.

A D-shaped latch assembly 640 is shown in FIGS. 8, 9, 11, 16 to 18 and 23 to 25. As shown in the referenced Figures, the assembly 640 comprises D-shaped latch 544, latch lever 545, solenoid link pin 576, roll pin 593, dowel pin 617, latch lever spacer 581, latch bellcrank 561, bellcrank return spring 560, bellcrank pivot bushing 547, bellcrank pivot shaft 562 and push-on retainer 587.

Figure 25A:
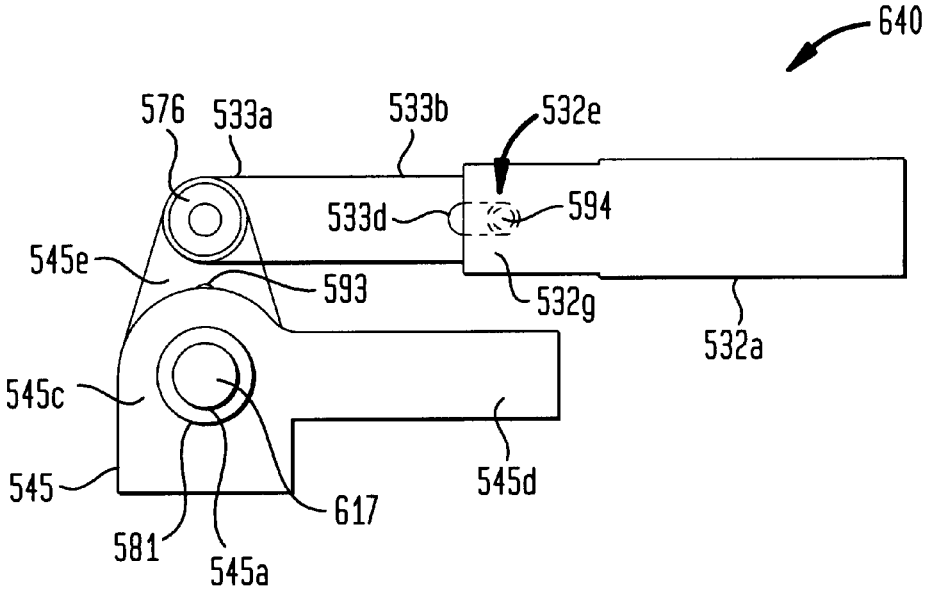
FIGS. 25A and 25B are a front and side view of the D-latch assembly.
Figure 25B:
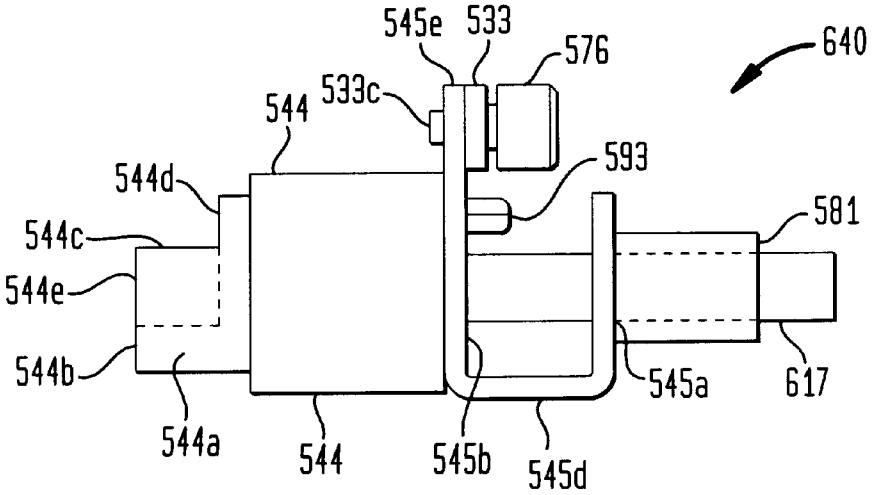
Figure 26B:
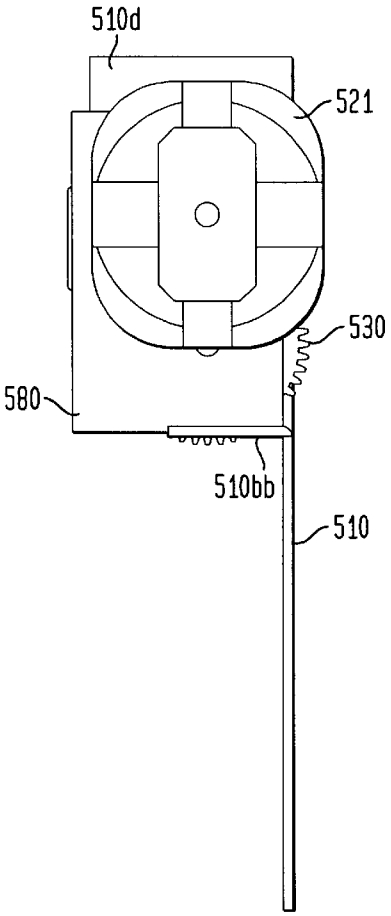
FIGS. 26A and 26B are front and side views of some components of the motor operated stored energy assembly, including the lower gear housing, electric motor and its gearing and the worm assembly.
Figure 26A:
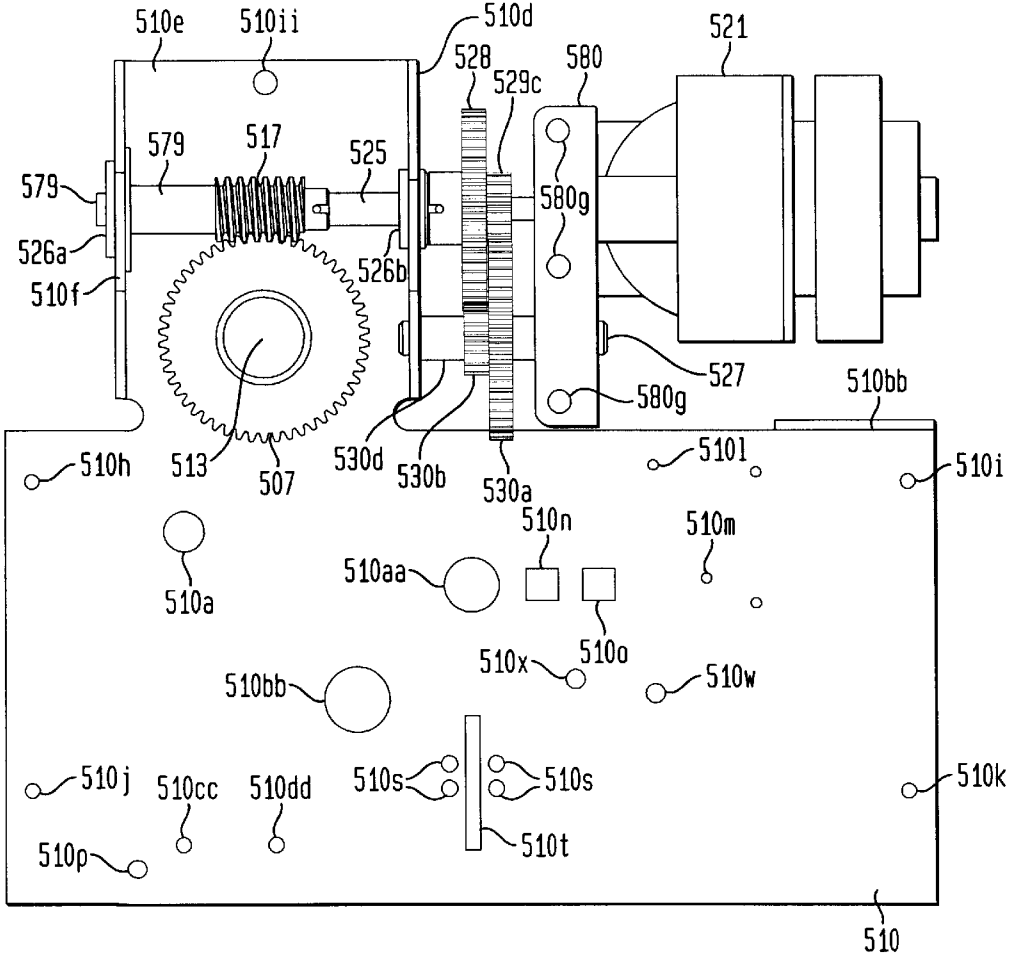
Figure 27B:
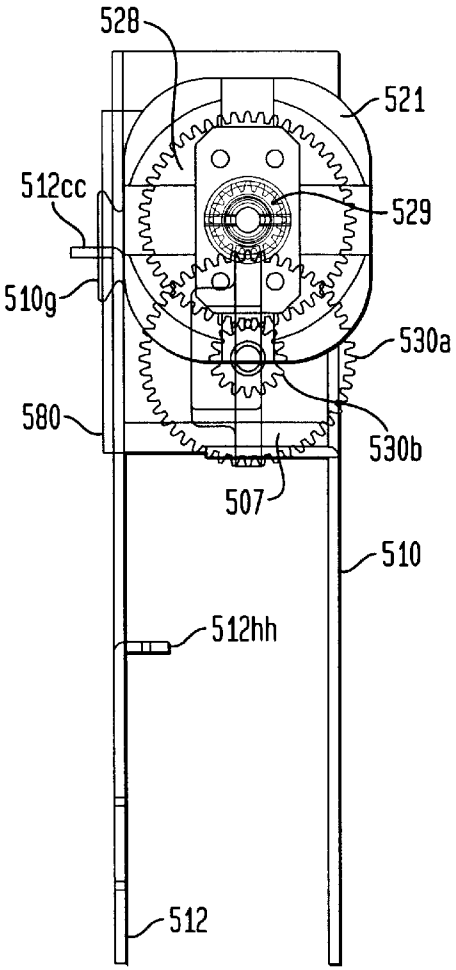
FIGS. 27A and 27B are through views of FIGS. 26A and 26B.
Figure 27A:
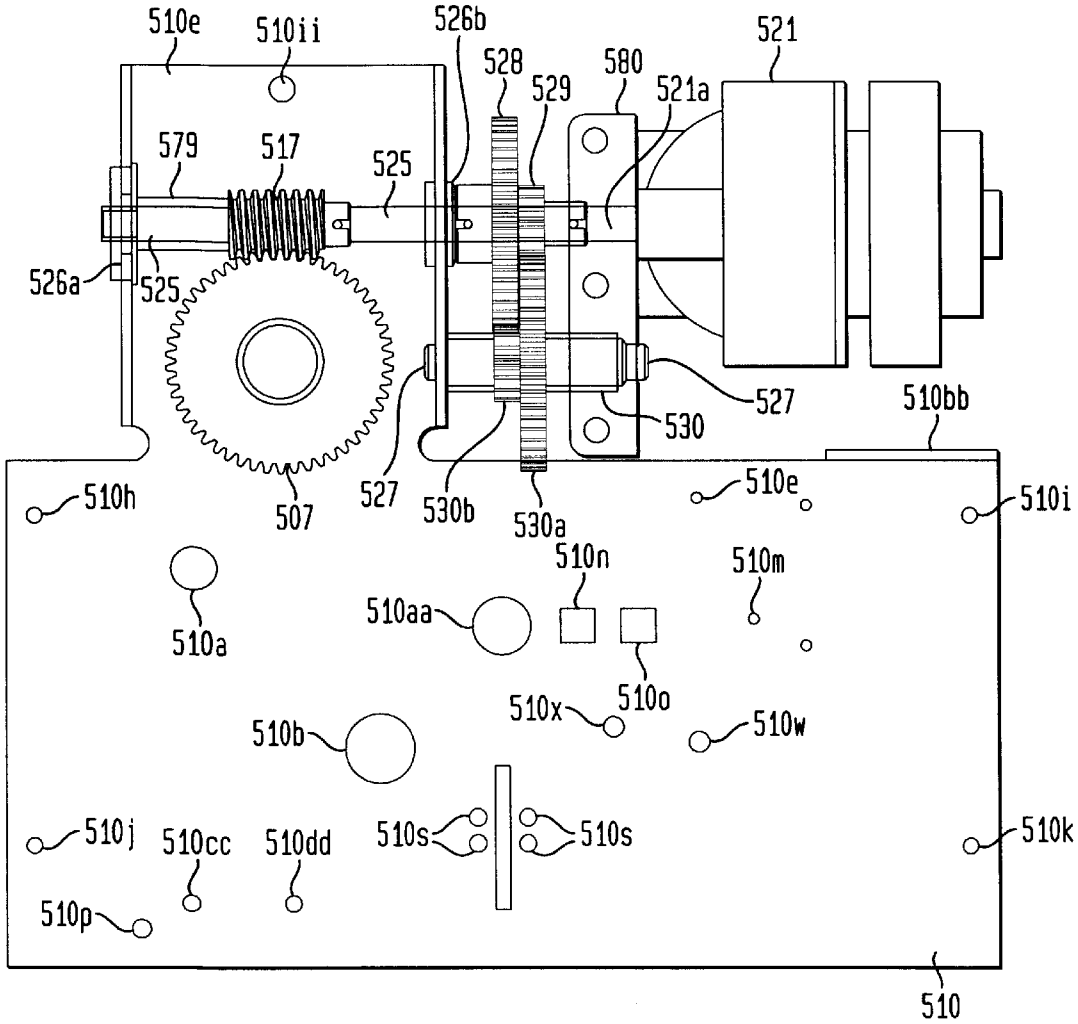
Figure 28A:
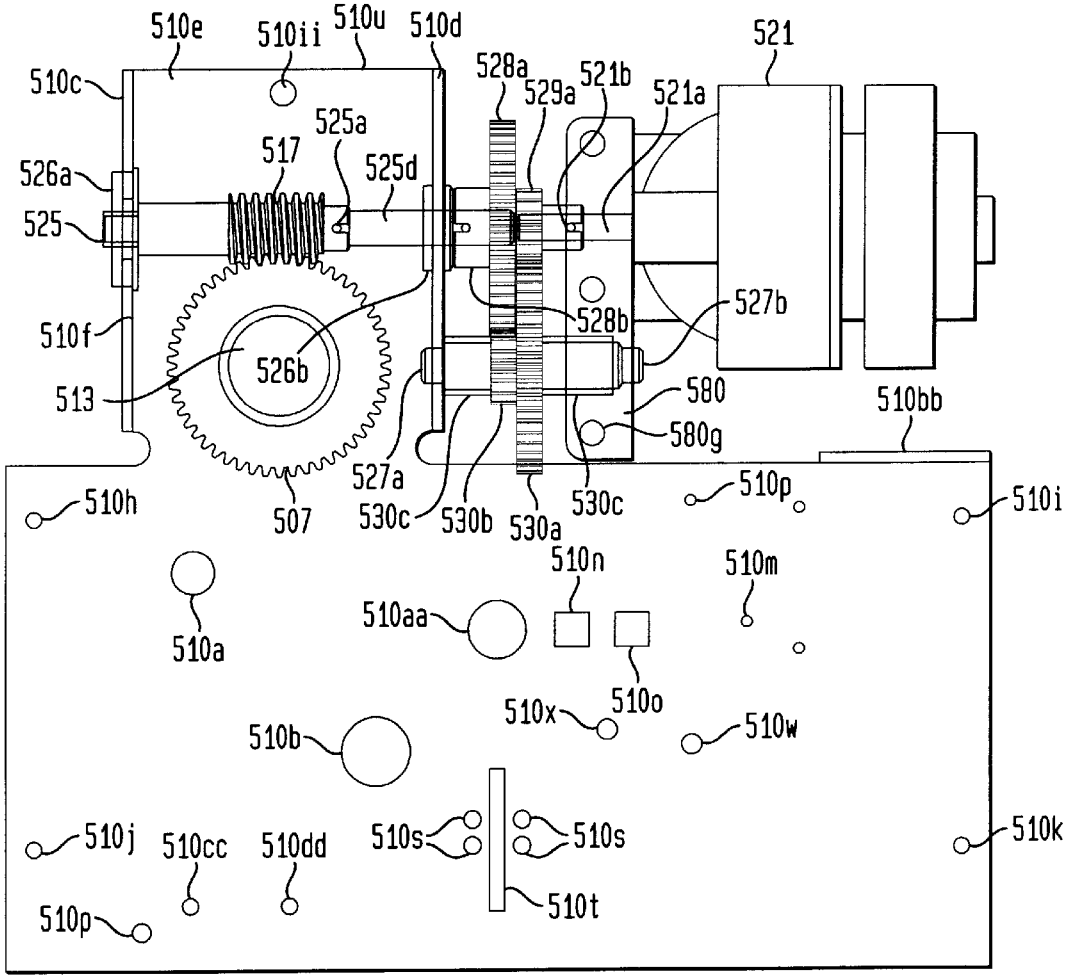
FIGS. 28A and 28B are enlarged views of FIGS. 27A and 27B.
Figure 28B:
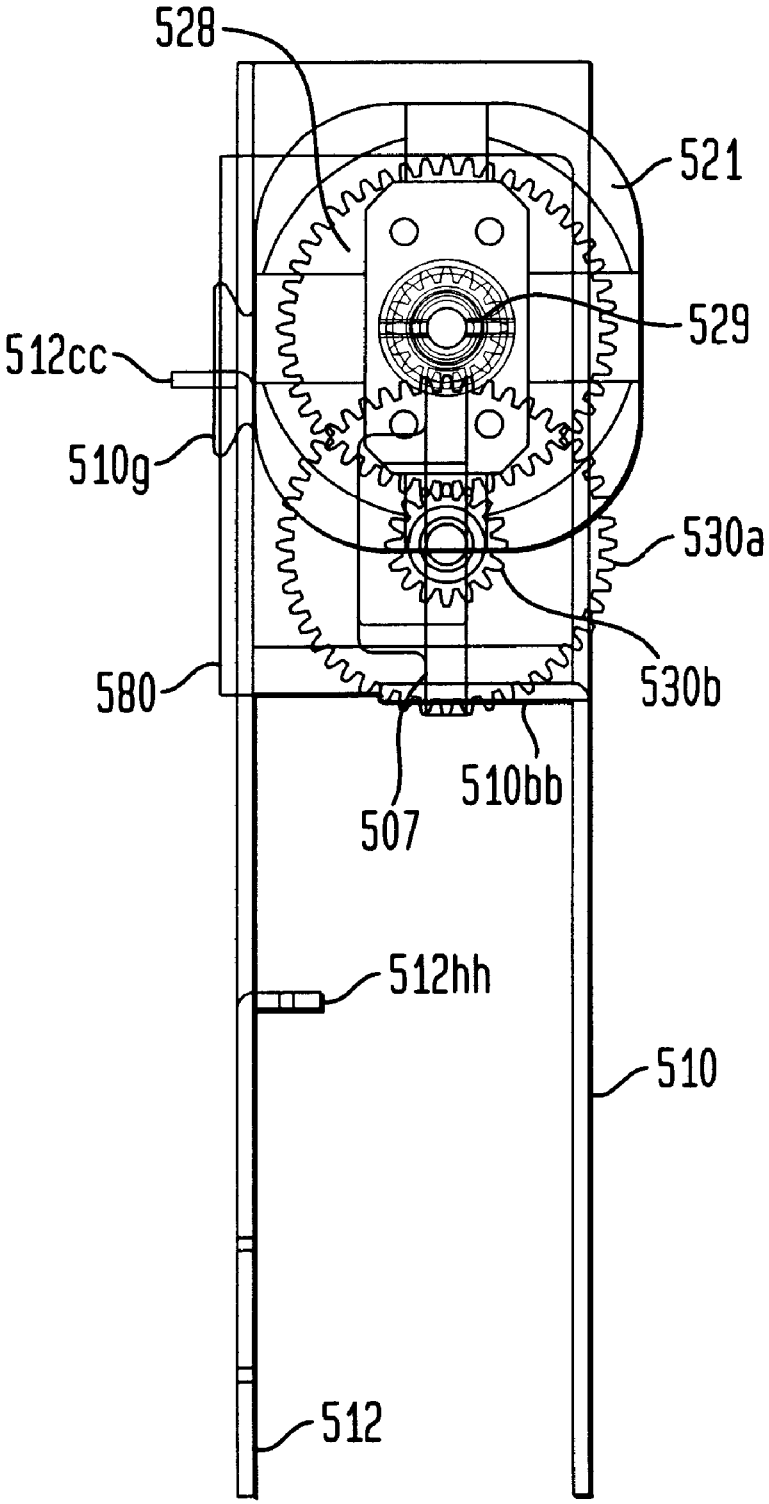
Figure 29B:
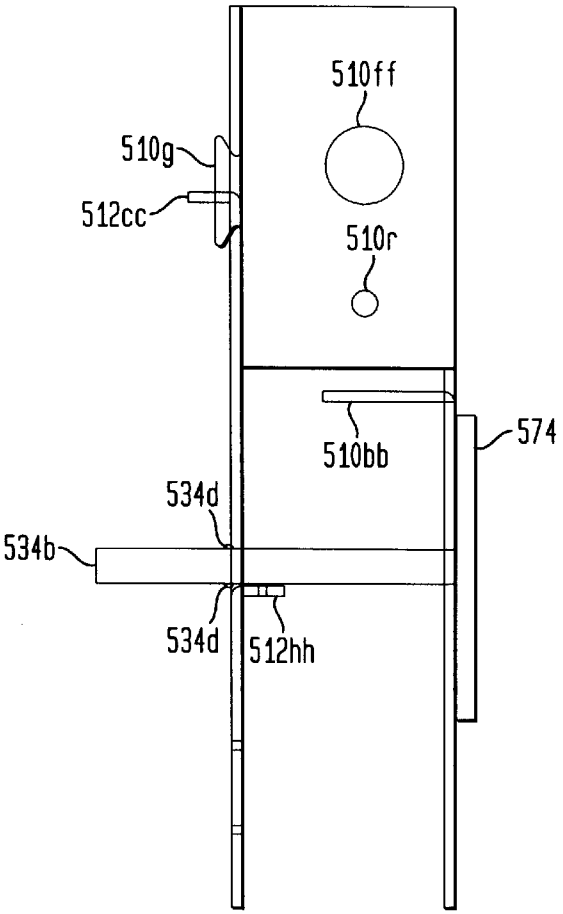
FIGS. 29A and 29B are front and side views of some components of the motor operated stored energy assembly, including the upper and lower gear housings, the indicator light pipes and the circular indicator light pattern wheel.
Figure 29A:
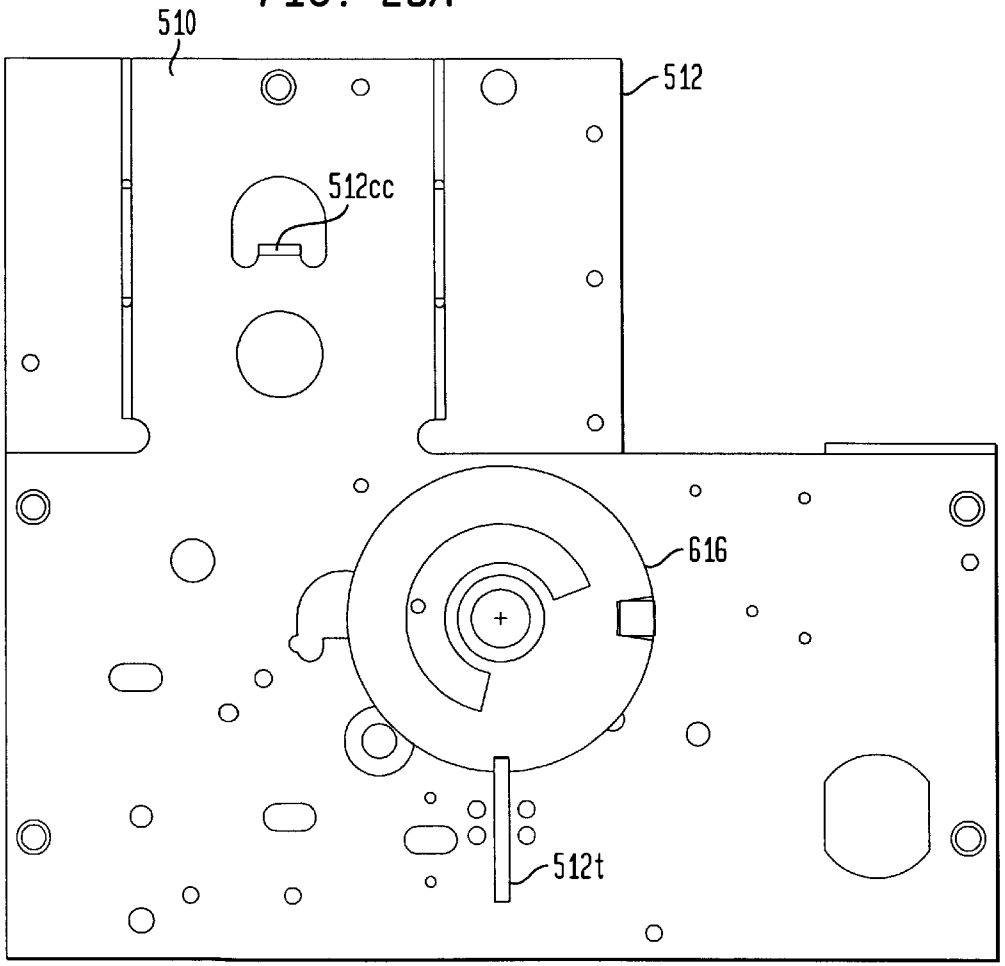

Referring again to the referenced Figures, including FIGS. 25A and 25B, the dowel pin 617 is inserted through dowel pin receiving apertures 545*a* and 545*b* of latch lever 545 and further inserted in a dowel pin receiving aperture (not shown) of D-shaped latch 544. The latch 544 has a D-shaped or cylindrical member 544*a* integrally associated with partial cylindrical member 544*b* having a flat surface 544*c* perpendicularly oriented with respect to semi-circular outer end surface 544*e* of partial cylindrical member 544*b* and to semi-circular end surface 544*d* of cylindrical member 544*a*. A roll pin 593 is also insertedly fitted into a roll pin aperture (not shown) in D-shaped latch 544 and the generally tapered or triangular shaped latch lever end 545*e* of latch lever 545. The latch lever spacer 581 shown in the referenced Figures fits over the dowel pin 617 so as to space the partially cylindrical latch lever member 544*b* with respect to the inner surfaces of the upper gear housing 512 and the lower gear housing 510. Latch lever 545 also has a rectangular shaped hasp interfering member 545*d*, which partially fits in hasp interfering aperture 5381 of hasp 538. The hasp interfering member 545*d* is integrally associated with and is perpendicularly oriented with respect to partially semi-circular latch lever member 545*c*.

Solenoid link pin 576 is used to rotateably connect or link the tapered end of latch lever 545 to an end 533*a* (having a solenoid link pin aperture) of solenoid link 533. Another end 533*b* (having a solenoid plunger connecting aperture 533*d*) is operably connected or linked to a slotted aperture (not shown) at end 532*g* to solenoid cylindrical plunger 532 using a roll pin 594 and solenoid roll pin aperture 532*e*. A solenoid end 532*f* is designed to fit within a solenoid plunger 532*a* receiving aperture (not shown) of solenoid 532*b*. Solenoid spring 578 operates to apply force to the solenoid plunger 532*a* so that it moves outwardly from solenoid 532*b* and to its original position. The ON push-button switch 548, which is used to actuate the D-latch assembly 640 and the solenoid 532, is also returned to its original position by the force of solenoid plunger spring 578. The solenoid 532 is mounted at an appropriate angle on the outside surface of lower gear housing 512 using solenoid mounting apertures 532*h* and 532*i* and appropriate fastening apparatus, such as screws 607 and spacer 532*s*, and lower gear solenoid mounting apertures 510*x* and 510*w*.

The D-shaped latch assembly 640 operates as follows: when the operator pushes the ON push button switch 548, it depresses push button rod 564 through push button rod aperture 512*u* of upper gear housing 512 so as to actuate latch bell crank 561, thereby rotating D-shaped latch 544 which releases latch plate 574 so as to allow operator gear 515 to rotate, thereby allowing the charged main springs 516 to release so as to force drive connector 504 and slide plate 522 upwardly so as to move the toggle handle 103 of the circuit breaker assembly 100 from its OFF position to its ON position.

In particular, the latch bellcrank 561 comprises a mounting surface 561*a* and two perpendicular rectangular flanges, namely a push button rod flange 561*b* and a solenoid link pin flange 561*c*, as well as a rotateable bellcrank latch mounting pin aperture (not shown), which receives bellcrank lath pivot bushing 547, bellcrank return spring 560 and bellcrank latch pivot shaft 562, which is secured on the bellcrank latch mounting flange 512*hh* of upper gear housing 512 using push-on retainer 587.

As discussed, the push button rod 564 pushes the push button flange 561*b* of bellcrank latch 561 so that it pivots about pivot bushing 547, pivot shaft 562 as well as bellcrank return spring 560 which resists the clockwise rotation of bellcrank latch 561. As the bellcrank latch rotates clockwise, solenoid link pin flange 561*c* pushes solenoid link pin 576, located in the tapered end 545*e* of latch lever 545 so as to rotate clockwise latch 544, dowel pin 617 and spacer 581. In this way, the D-shaped latch member 544*b* of latch 544 also rotates clockwise so that it no longer interferes with latch stop 5741 on latch plate 574. As a result, the latch plate 574 and the operator gear 515 may rotate, as discussed above and as shown in FIGS. 23 to 25.

Also, when the ON push button switch 548 is actuated so as to depress ON button rod 564 and partially rotate clockwise D-shaped latch assembly 640, rectangular shaped hasp interfering member 545 rotates into slotted aperture 5381 of hasp 538. In this way, hasp 538 is prevented from being removed while the stored energy circuit breaker assembly 200 moves the toggle handle 103 of the circuit breaker assembly 100 to its ON position.

As discussed, and as is shown in FIGS. 8, 9, 11, 14 to 22, is a pinion gear assembly comprising pinion gear carrier 536, which is used to mount driver/pinion gear 518*s* and idler/pinion gear 518*a*. Operator handle/pinion shaft aperture 510*b* in lower gear housing plate 510 is used to receive the operator handle/pinion shaft 513. Pinion gear carrier post or stop 557 projects perpendicularly from the inside surface of lower gear housing 510 towards main housing 511, and is used to limit rotational movement of charge gear carrier 536, as is discussed further below. The main operator gear 515 has a kickout cam or latch plate 574 and a cam following pin or post structure 542, which fits within cam following aperture 504*m* of drive connector 504. Cam following pin or post structure 542 moves horizontally within cam following aperture 504 of drive connector or slide plate 504 so as to cause the drive connector or slide plate 504 to move linearly and vertically.

Also shown in FIGS. 2, 3, 6, 8, 9, 11, 15 and 16 are a manual/auto lockout slide plate 550 having a locking extension member 550*a*. As discussed, locking hasp vertically slotted apertures 510*t* and 512*t* receives locking hasp 538. Manual/auto lockout slide plate 550 has a lockout slide retainer 555 which is secured by placing securing end 555*b* in lock slide retainer aperture 550*b* using retainer 597 fitted in circumferential slot 555*c* so that button end 555*a* projects outwardly through generally oval shaped lock slide retainer aperture 512*w* of upper gear housing 512. A manual/auto lockout slide handle 546 (secured by retainer 597), which a user may grasp and slide horizontally to move the manual/auto slide plate 750 between its left or manual and right or automatic positions, is secured by using retainer 597 to retain securing end 546*b* in lockout slide handle aperture 550*e* and allowing handle end 546*a* to project through upper gear housing lockout slide handle aperture 512*ff* and main external housing lockout slide handle aperture 543*g*. Both lockout slide retainer 555 and manual auto lockout slide handle 546 are securely associated with lockout slide plate 550 using shoulder rivets or any other suitably appropriate securing apparatus. If the manual/auto lockout slide handle 546 is in its manual position, a user may operate OFF button 609 and ON button 548. If the manual/auto lockout slide handle 546 is in its automatic position, then a user cannot actuate OFF button 609 or ON button 548, which are blocked by the "automatic" position of the manual/auto lockout slide handle 550.

OFF button 609 receives and actuates trip rod 553 through trip rod aperture 512*d* of upper gear housing 512. ON button 548 receives and actuates ON button rod 564 through ON button rod aperture 512*u*. Also, the ON button legs 548*x* and 548*xx* fit in ON button leg apertures 512*x* and 512*xx* of upper gear housing 512 to allow ON button 548 to be depressed in the manual position when ON button leg lockout slide aperture 550*c* is aligned with ON button leg aperture 512*x* of upper gear housing 512. When the manual/auto lockout slide plate 550 is in its first or left manual position, then the ON button 548 and the OFF button 609 cannot be depressed because the lockout slide plate 550 interferes with the depression of those buttons since the lockout slide button apertures are not aligned with the corresponding apertures in the upper gear housing 512. When the manual/auto lockout slide is moved to the right so that it is in its automatic position, button switch flange 550*g* depresses an actuation button (not shown) of button switches 535*a* and 535*b* (see FIG. 6) which are also switches S2A and S2B of the electrical schematics shown in FIGS. 6 and 7. Thus, switches 535*a* (S2A) and 535*b* (S2B) are open when the manual/auto lockout slide 550 is in its manual position, and they are closed for automatic operation when the manual auto lockout slide 550 is in its automatic position.

Finally, the manual/auto lockout slide 550 is biased or restrained in either its manual or automatic position using two lockout slide spring pins 563, lockout slide toggle pin 554 and lockout slide toggle spring 558. In particular, lockout slide spring pins fit in lower and upper lockout slide spring pin apertures 512*y* while lockout slide toggle pin 554 fits in lockout slide toggle pin aperture 550*z* of lockout slide 550 and further projects through oval-shaped upper gear housing lockout slide pin aperture 512*z*. Also, each lockout slide spring pin 563 fit into lockout upper and lower slide pin spring aperture 558*y* and lockout slide toggle pin 554 fits in middle lockout slide toggle pin spring aperture 558*z*. In this way, the lockout slide 550 is biased into either its manual or automatic positions using the lockout slide toggle spring.

When the charging springs 516*a* and 516*b* are fully charged, the main contact of the circuit breaker assembly 100 may be either manually or electrically closed as follows. As discussed, pressing ON button 548 causes the D-latch assembly 544 to rotate clockwise so that latch 574*l* of latch plate 574 is free to rotate clockwise past the flat surface of D-latch 544. As discussed, this allows the main operator gear 515 to rotate and the drive connector or slide plate 504 to move relatively rapidly in an upward direction so as to force the toggle handle 103 of the circuit breaker assembly 100 to its ON position using toggle handle slide 522.

When the charging springs 516*a* and 516*b* are not fully charged, electrical operation is as follows:

When electric power is applied, an electric motor 510 is used to drive a reduction gear assembly 630, which rotates a worm 517 and corresponding worm gear 507, which drives handle/pinion shaft 513 through unidirectional clutches 519*a* and 519*b* as previously discussed. The shaft 513 rotates until charge gear carrier 536 is stopped by the charge gear block stop 557*a*. The charge gear carrier 536 carries driver/pinion gear 518*s* and idler/pinion gear 518*a* into contact with a main charging or operator gear 515 if the stored energy operating mechanism or charging springs 516*a* and 516*b* are not fully charged. The idler/pinion gear 518*a* then rotates the main charging gear 515 clockwise so as to carry the pin/cam follower 542 in a cyclic motion, which is translated into linear motion of the drive connector or slide plate 504. The main charging gear 515 has twelve teeth 515*t* missing out of a thirty-two gear tooth pattern so that the idler/pinion gear 518*a* is only able to drive the main charging gear 515 to a point or position where the pin/cam follower 542 has been carried a few degrees past the position of top dead center of the main operator gear 515 or in the proper overcenter position. This also allows the electric motor 521 to coast to its resting position so that it is not necessary to electrically or mechanically brake the electric motor 521.

When the main charging gear 515 has been driven as far as the idler/pinion and driver/pinion gears 518*a* 518*s* may drive it, the force of the operating springs 516*a* and 516*b* causes it to continue to rotate until the latch 574*l* of latch plate 574 catches D-latch 544 so as to stop its rotation. By moving laterally in a horizontal slot operator 504*m* in the drive connector or slide plate 504, the cyclic motion of the pin/cam follower 542 causes the drive connector 504 and the toggle handle slide 522 to move linearly as guided by the guide rods or slide shafts 503*a* and 503*b*. The linear motion of the drive connector 504 moves the toggle handle 103 of the circuit breaker assembly 100 so as to open the main contacts of the circuit breaker assembly 100. The linear motion of the drive connector 522 also stretches or charges the charging springs 516*a* and 516*b*, which are attached, secured or otherwise fastened between slotted apertures of drive connector 504 and anchor points of main housing assembly plate 511 as previously discussed. In this way, the energy stored in the charging operating springs 516 may be used to close relatively rapidly the main contacts of the circuit breaker assembly 100 by forcing the circuit breaker toggle handle 101 to its ON position.

A list of the components is as follows:

| | |
|---|---|
| 501 | Adapter Base |
| 502 | Operator Gear Shaft Spacer |
| 503 | Slide Shaft |
| 504 | Drive Connector |
| 505 | — |
| 506 | — |
| 507 | Worm Gear |
| 508 | Slide Bushing |
| 509 | — |
| 510 | Lower Gear Housing |
| 511 | Housing |
| 512 | Upper Gear Housing |
| 513 | Pinion Shaft |
| 514 | Operator Gear Shaft |
| 515 | Operator Gear |
| 516 | Main Spring |
| 517 | Worm |
| 518 | Pinion Gear |
| 519 | Clutch |
| 520 | Pinion Shaft Bearing |
| 521 | Motor |
| 522 | Slide |
| 523 | Spring Centering Washer |
| 524 | Over Toggle Spring |
| 525 | Worm Shaft |
| 526 | Flange Bearing |
| 527 | Motor Standoff Shaft |
| 528 | Final Reduction Gear |
| 529 | Motor Gear |
| 530 | Cluster Gear |
| 531 | Roller Arm Switch |
| 532 | Solenoid |
| 533 | Solenoid Link |
| 534 | Indicator Light Pipe |
| 535 | Lever Switch |
| 536 | Gear Carrier |
| 537 | Handle |
| 538 | Hasp |
| 539 | Hasp Spring |
| 540 | Closure Screw |
| 541 | Button Switch |
| 542 | Cam Follower |
| 543 | Cover Molding |
| 544 | Latch |
| 545 | Latch Lever |
| 546 | Lockout Slide Handle |
| 547 | Pivot Bushing |
| 548 | Push Button |
| 549 | Switch Bracket |
| 550 | Lockout Slide |
| 551 | Trip Arm |
| 552 | Lifter |
| 553 | Trip Rod |
| 554 | Lock Slide Toggle Pin |
| 555 | Lock Slide Retainer |
| 556 | Gear Carrier Stop Sleeve |
| 557 | Gear Carrier Stop |
| 558 | Lock Slide Toggle Spring |
| 559 | Lock Arm Pit |
| 560 | Return Spring |
| 561 | Latch Bellcrank |
| 562 | Pivot Shaft |
| 563 | Lock Slide Spring Pin |
| 564 | On Button Rod |
| 565 | Handle Hub |
| 566 | Handle Return Spring |
| 567 | Motor Switch Spacer |
| 568 | Idler Gear Shaft |
| 569 | Idler Gear Roller |
| 570 | Idler Gear Bearing |
| 571 | Wave Washer |
| 572 | Backup Washer |
| 573 | — |
| 574 | Latch Plate |
| 575 | Operator Gear Bushing |
| 576 | Solenoid Link Pin |
| 577 | Hasp Return Spring Pin |

-continued

| | |
|---|---|
| 578 | Solenoid Spring |
| 579 | Worm Gear Spacer |
| 580 | Motor Mounting Plate |
| 581 | Spacer |
| 582 | Spacer |
| 583 | Backup Washer |
| 584 | Roll Pin, 1/8 × 1/2 |
| 585 | Threaded Insert, 10-31 |
| 586 | Threaded Insert, 3.5 mm |
| 587 | Push-On Retainer, .079 ID |
| 588 | Washer, 1/4 |
| 589 | Washer, 3/16 |
| 590 | Push-On Retainer, Plastic |
| 591 | Screw, 4 mm × 10 Pozidrive |
| 592 | Screw, 2 mm × 16 Pozidrive |
| 593 | Roll Pin, 3/32 × 1/2 |
| 594 | Roll Pin, 3/32 × 5/8 |
| 595 | Roll Pin, 1/16 × 1/2 |
| 596 | Lock Washer, 4 mm |
| 597 | Retainer, 3/16 |
| 598 | Screw, 4 mm × 10 SOC HD |
| 599 | Retainer, 3/8 |
| 600 | Retainer, 1/2 |
| 601 | Screw, 3 mm × 10 Pozidrive |
| 602 | Lockwasher, 3 mm |
| 603 | Lockwasher, 2.5 mm |
| 604 | Washer, 3.5 mm |
| 605 | Terminal Screw Assembly, 3.5 mm |
| 606 | Screw, Flat HD, 3.5 mm × 10 |
| 607 | Screw, Flat HD, 8-32 × 1/4 |
| 608 | Screw, 4 mm × 20 Posidrive |
| 609 | Push Button |
| 610 | Lock Out Button |
| 611 | — |
| 612 | — |
| 613 | Cylinder Lock Arm |
| 614 | Switch, Straight Lever |
| 615 | Pushrod, Hinge Switch |
| 616 | Indicator Wheel |
| 617 | Dowel Pin 3/16 × 1 1/2 |
| 618 | Cylinder Lock |

While the present invention has been described in connection with what are believed to be the most practical and preferred embodiments as currently contemplated, it should be understood that the present invention is not limited to the disclosed embodiments. Accordingly, the present invention is intended to cover various modifications and comparable arrangements, methods and structures that are within the scope of the claims.

What is claimed:

1. A stored energy circuit breaker actuation apparatus for use with a circuit breaker assembly, having an actuation handle for actuating the circuit breaker assembly to at least one operating state, comprising:

a housing;

an operator handle assembly comprising an operator handle and operator handle shaft;

an operator gear assembly comprising an operator gear and a movement following member;

a pinion gear assembly comprising a pinion gear carrier and at least one pinion gear, wherein said pinion gear carrier is pivotally associated with said operator handle shaft and said at least one pinion gear is pivotally associated with said pinion gear carrier, and wherein said pinion gear carrier is movable so that said at least one pinion gear may contact and rotate said operator gear;

a stored energy charging and discharging assembly comprising a movement translation apparatus assembly, having at least one charging state movement direction and at least one discharge state movement direction, which is operatively associated said operator gear movement following member and with the actuation handle of the circuit breaker assembly, wherein said movement translation apparatus assembly translates rotational movement of said operator gear into linear movement of said movement translation apparatus assembly thereby moving the actuation handle of the circuit breaker assembly so as to actuate the circuit breaker assembly to at least one of its operating states;

an energy storage assembly comprising a structure that stores energy when charged and releases energy when discharged, wherein said energy storage assembly is operatively associated with said stored energy charging and discharging assembly so as to store energy when said movement translation apparatus assembly moves in said at least one charging state movement direction and to discharge energy when said movement translation apparatus moves in said at least discharging state movement direction;

a release apparatus operatively associated with said operator gear assembly so as to release said operator gear assembly and allow it to rotate, thereby allowing said movement translation apparatus to move in said at least one discharge movement direction; and a circuit breaker actuation apparatus operatively associated with said movement translation assembly so as to move in the same direction as said movement translation assembly, wherein said operator handle and said pinion gear assembly are operatively connected by said operator handle shaft so that moving said operator handle and correspondingly said operator handle shaft in at least one direction also rotates said at least one pinion gear, thereby rotating said operator gear assembly so as to cause said movement translation apparatus assembly to move in said at least one charging state movement direction so as to charge said energy storage assembly by storing energy therein.

2. The stored energy circuit breaker actuation apparatus of claim 1 further comprising:

an electric motor assembly;

a reset translation assembly operatively associated with said electric motor assembly and with said operator handle shaft and said pinion gear assembly;

an actuating assembly operatively associated with said electric motor assembly, which when actuated causes said electric motor assembly to operate so as to operate said reset translation assembly and thereby rotate said operator handle shaft in at least one direction and also rotate said at least one pinion gear, thereby rotating said operator gear assembly so as to cause said movement translation apparatus assembly to move in said at least one charging state movement direction so as to charge said energy storage assembly by storing energy therein.

3. The stored energy circuit breaker actuation apparatus of claim 2, wherein said reset translation assembly comprises a worm driven by said electric motor assembly, where said worm further drives a worm gear mounted on said operator handle shaft so as to rotate said operator handle shaft.

4. The stored energy circuit breaker actuation apparatus of claim 2, wherein said actuating assembly comprises an electric switch for actuating said electric motor assembly.

5. The stored energy circuit breaker actuation apparatus of claim 2, wherein said electric motor assembly comprises:

an electric motor;

at least one drive shaft; and a reduction gear assembly, wherein said electric motor drives said at least one drive shaft which drives said reduction gear assembly and said reset translation assembly.

6. The stored energy circuit breaker actuation apparatus of claim 5, wherein said apparatus further comprises an electronic control module for controlling operation of the electric motor.

7. The stored energy circuit breaker actuation apparatus of claim 6, wherein said electronic control module comprises a silicon-controlled rectifier.

8. The stored energy circuit breaker actuation apparatus of claim 1, wherein said movement following member comprises a cam following pin member.

9. The stored energy circuit breaker actuation apparatus of claim 1, wherein said at least one pinion gear comprises an idler pinion gear operatively associated with a driver pinion gear, which drives said operator gear.

10. The stored energy circuit breaker actuation apparatus of claim 1, wherein said movement translation apparatus comprises:

a drive plate, wherein said drive plate has a movement following member aperture for receiving said movement following member;

at least one guide shaft, wherein said drive plate is movably mounted on said at least one guide shaft.

11. The stored energy circuit breaker actuation apparatus of claim 10, wherein said circuit breaker actuation apparatus comprises a circuit breaker actuator plate operatively associated with said drive plate so as to move with said drive plate, thereby actuating the circuit breaker assembly to at least one operating state.

12. The stored energy circuit breaker actuation apparatus of claim 11, wherein said circuit breaker actuator plate is slideably mounted on said at least one guide shaft and is operatively mounted with respect to said drive plate so as to move with said drive plate.

13. The stored energy circuit breaker actuation apparatus of claim 12, wherein said circuit breaker actuation plate is a circuit breaker toggle plate having a toggle handle aperture for receiving a circuit breaker toggle handle.

14. The stored energy circuit breaker actuation apparatus of claim 1, wherein said energy storage assembly comprises at least one spring operatively associated with said movement translation apparatus so that said at least one spring is charged when said movement translation assembly moves in said at least one movement charging direction.

15. The stored energy circuit breaker actuation apparatus of claim 14, wherein said at least one spring comprises two springs.

16. The stored energy circuit breaker actuation apparatus of claim 15, wherein each of said springs has a first hook end for mounting with respect to said housing and a second hook end for mounting with respect to said movement translation apparatus.

17. The stored energy circuit breaker actuation apparatus of claim 2, wherein said housing comprises an external housing, a lower gear housing, an upper gear housing and a main internal housing, wherein said external housing houses said lower and upper gear housings and said main internal housing, and further wherein said lower gear housing houses at least said reset translation assembly, and further wherein said electric motor is mounted on said upper gear housing and further wherein said main internal housing houses said stored energy charging and discharging assembly, including said movement translation assembly, and further houses said energy storage assembly.

18. The stored energy circuit breaker actuation apparatus of claim 2, wherein said operator gear has a release cam and further wherein said release apparatus comprises:

a release switch;

a release structure operatively associated with said release switch and with said release cam of said operator gear so that said release structure interferes with rotational movement of said release cam and said operator gear when said stored energy circuit breaker actuation apparatus has been charged and does not interfere with rotational movement of said release cam when said release switch is actuated so as to cause said release structure to release said release cam.

19. The stored energy circuit breaker actuation apparatus of claim 18, wherein said release switch is a mechanical ON switch.

20. The stored energy circuit breaker actuation apparatus of claim 19, wherein said release structure comprises a latch further comprising a semi-cylindrical member, which rotates when said release switch is actuated so that it does not interfere movement of said release cam and of said operator gear, thereby allowing the stored energy assembly to discharge so as to cause said movement translation assembly to move in said at least one discharging state movement direction.

* * * * *